US006503059B1

(12) United States Patent
Frost et al.

(10) Patent No.: US 6,503,059 B1
(45) Date of Patent: Jan. 7, 2003

(54) FOURTH-STAGE TURBINE BUCKET AIRFOIL

(75) Inventors: Wilson Frost, North Muskegon, MI (US); Mark Edward Stegemiller, Franklin, OH (US); Andrew Charles Powis, Madeira, OH (US); Peter P. Pirolla, Greenville, SC (US); David John Humanchuk, Simpsonville, SC (US); Gunnar Leif Siden, Greenville, SC (US)

(73) Assignee: General Electric Company, Schenectady, NY (US)

( * ) Notice: Subject to any disclaimer, the term of this patent is extended or adjusted under 35 U.S.C. 154(b) by 27 days.

(21) Appl. No.: 09/899,543

(22) Filed: Jul. 6, 2001

(51) Int. Cl.[7] ..... F01D 5/14
(52) U.S. Cl. ..... 416/223 A; 416/DIG. 2
(58) Field of Search ..... 416/223 A, 243, 416/DIG. 2, DIG. 5

(56) References Cited

U.S. PATENT DOCUMENTS

| | | | | |
|---|---|---|---|---|
| 5,267,834 A | 12/1993 | Dinh et al. | ..... | 416/223 A |
| 5,299,915 A | 4/1994 | Dinh et al. | ..... | 416/223 A |
| 5,980,209 A | 11/1999 | Barry et al. | ..... | 416/223 A |
| 6,398,489 B1 | 6/2002 | Burdgick et al. | ..... | 415/191 X |
| 6,450,770 B1 | 9/2002 | Wang et al. | ..... | 416/223 A |
| 6,461,109 B1 | 10/2002 | Wedlake et al. | ..... | 415/192 |
| 6,461,110 B1 | 10/2002 | By et al. | ..... | 416/223 A |

OTHER PUBLICATIONS

U.S. patent application Ser. No. 09/886,406, Pirolla et al., filed Jun. 2001.
U.S. patent application Ser. No. 09/903,853, Bielek et al., filed Jul. 2001.
U.S. patent application Ser. No. 09/987,433, Xu et al., filed Nov., 2001.

*Primary Examiner*—Edward K. Look
*Assistant Examiner*—Richard A. Edgar
(74) *Attorney, Agent, or Firm*—Nixon & Vanderhye

(57) ABSTRACT

The fourth-stage buckets have airfoil profiles substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at the radially innermost aerodynamic section of the airfoil and X and Y are coordinate values defining the airfoil profile at each distance Z. The X, Y and Z values may be scaled as a function of the same constant or number to provide a scaled-up or scaled-down airfoil section for the bucket.

10 Claims, 6 Drawing Sheets

FOURTH-STAGE TURBINE BUCKET AIRFOIL

The present invention relates to a turbine bucket for a gas turbine stage and particularly relates to a fourth-stage turbine bucket airfoil profile.

BACKGROUND OF THE INVENTION

This invention was made with Government support under Contract No. DE-FC21-95MC31176 awarded by the Department of Energy. The Government has certain rights in this invention.

In recent years, advanced gas turbines have trended toward increasing firing temperatures and efforts to improve cooling of the various turbine components. In a particular gas turbine design of the assignee, a high output turbine that uses a combination of steam and air cooling to meet a 60% combined cycle efficiency i s undergoing development. It will be appreciated that the design and construction of the turbine buckets and particularly the buckets of the fourth turbine stage of that turbine require optimized aerodynamic efficiency, as well as aerodynamic and mechanical bucket loading.

BRIEF SUMMARY OF THE INVENTION

In accordance with an embodiment of the present invention, there is provided a unique turbine bucket airfoil profile for a turbine stage, preferably the fourth stage, which may be defined by a unique loci of points to achieve the necessary efficiency in loading requirements whereby improved turbine performance is obtained. It will be appreciated that the nominal profile given by the X, Y, Z coordinates of Table I, which follows, define this unique loci of points. The coordinates given in inches in Table I are for a cold, i.e., room-temperature profile for each cross-section of the bucket. Each defined cross-section is joined smoothly with adjacent cross-sections to form the complete airfoil shape. It will also be appreciated that as the bucket heats up in use, the profile will change as a result of stress and temperature. Thus, the cold or room-temperature profile is given by the X, Y, Z coordinates for manufacturing purposes. Because a manufactured bucket airfoil profile may be different than the nominal airfoil profile given in the following table, a distance of ±0.160 inches from the nominal profile in a direction normal to any surface location along the nominal profile and which includes any coating process, defines the profile envelope for this design. The design is robust to this variation without impairment of the mechanical and aerodynamic functions.

It will also be appreciated that the airfoil can be scaled-up or scaled-down geometrically for introduction into other similar turbine designs. Consequently, the X, Y and Z coordinates of the nominal airfoil profile given below are a function of the same constant or number. That is, the X, Y and Z coordinate values given in the Table may be multiplied or divided by the same constant or number to provide a scaled-up or scaled-down version of the bucket airfoil profile, while retaining the airfoil section shape.

In a preferred embodiment according to the present invention, there is provided a turbine bucket having a bucket airfoil shape in an envelope within ±0.160 inches in a direction normal to any airfoil surface location wherein the airfoil has an uncoated nominal profile substantially in accordance with Cartesian coordinates values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinates defining the airfoil profile at each distance Z, the profiles at the Z distances being joined smoothly with one another to form the complete airfoil shape.

In a further preferred embodiment according to the present invention, there is provided a turbine bucket having an uncoated nominal airfoil profile substantially in accordance with Cartesian coordinates values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinates defining the airfoil profile at each distance Z, the profiles at the Z distances being joined smoothly with one another to form the complete airfoil bucket profile, the X, Y and Z values being scaled as a function of the same constant or number to provide a scaled-up or scaled-down bucket airfoil.

In a further preferred embodiment according to the present invention, there is provided a turbine comprising a turbine wheel having a plurality of buckets, each of the buckets having an airfoil shape in an envelope within ±0.160 inches in a direction normal to any bucket airfoil surface location wherein the airfoil has an uncoated nominal profile substantially in accordance with Cartesian coordinates values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinates defining the airfoil profile at each distance Z, the profiles at the Z distances being joined smoothly with one another to form the complete airfoil shape.

In a further preferred embodiment according to the present invention, there is provided a turbine comprising a turbine wheel having a plurality of buckets, each of the buckets having an uncoated nominal airfoil profile substantially in accordance with Cartesian coordinates values of X, Y and Z set forth in inches in Table I wherein Z is a perpendicular distance from a plane normal to a radius of the turbine centerline and containing the X and Y values with the Z value commencing at zero in an X, Y plane at the radially innermost aerodynamic section of the airfoil and X and Y are coordinates defining the airfoil profile at each distance Z, the profiles at the z distances being joined smoothly with one another to form the complete airfoil shape, the X and Y values being scaled as a function of the same constant or number to provide a scaled-up or scaled-down bucket airfoil.

DETAILED DESCRIPTION OF THE INVENTION

Figure 1:
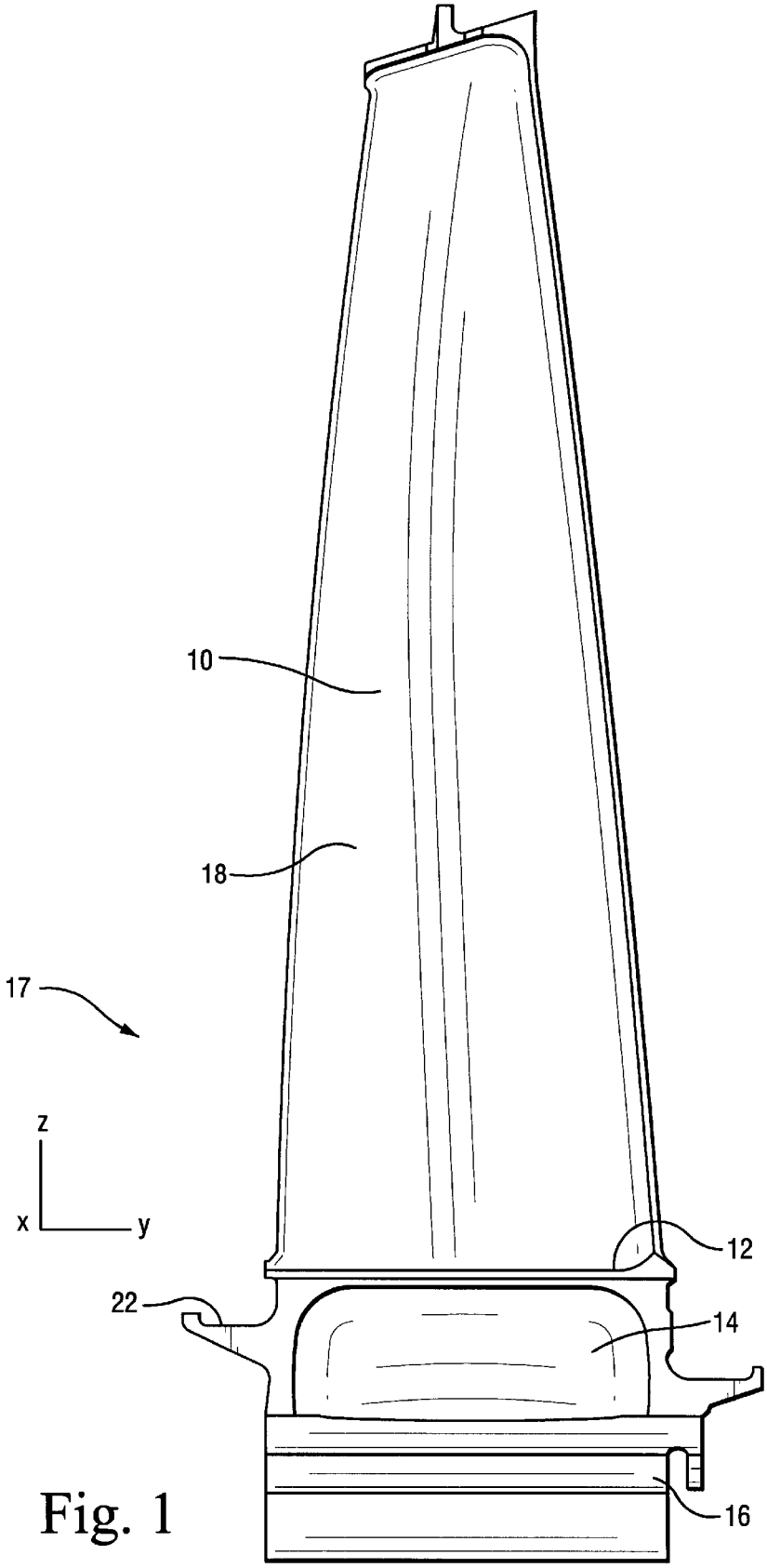
FIG. 1 is a side elevational view of a turbine bucket including an airfoil, shank and dovetail constructed in accordance with a preferred embodiment of the present invention.
Figure 2:
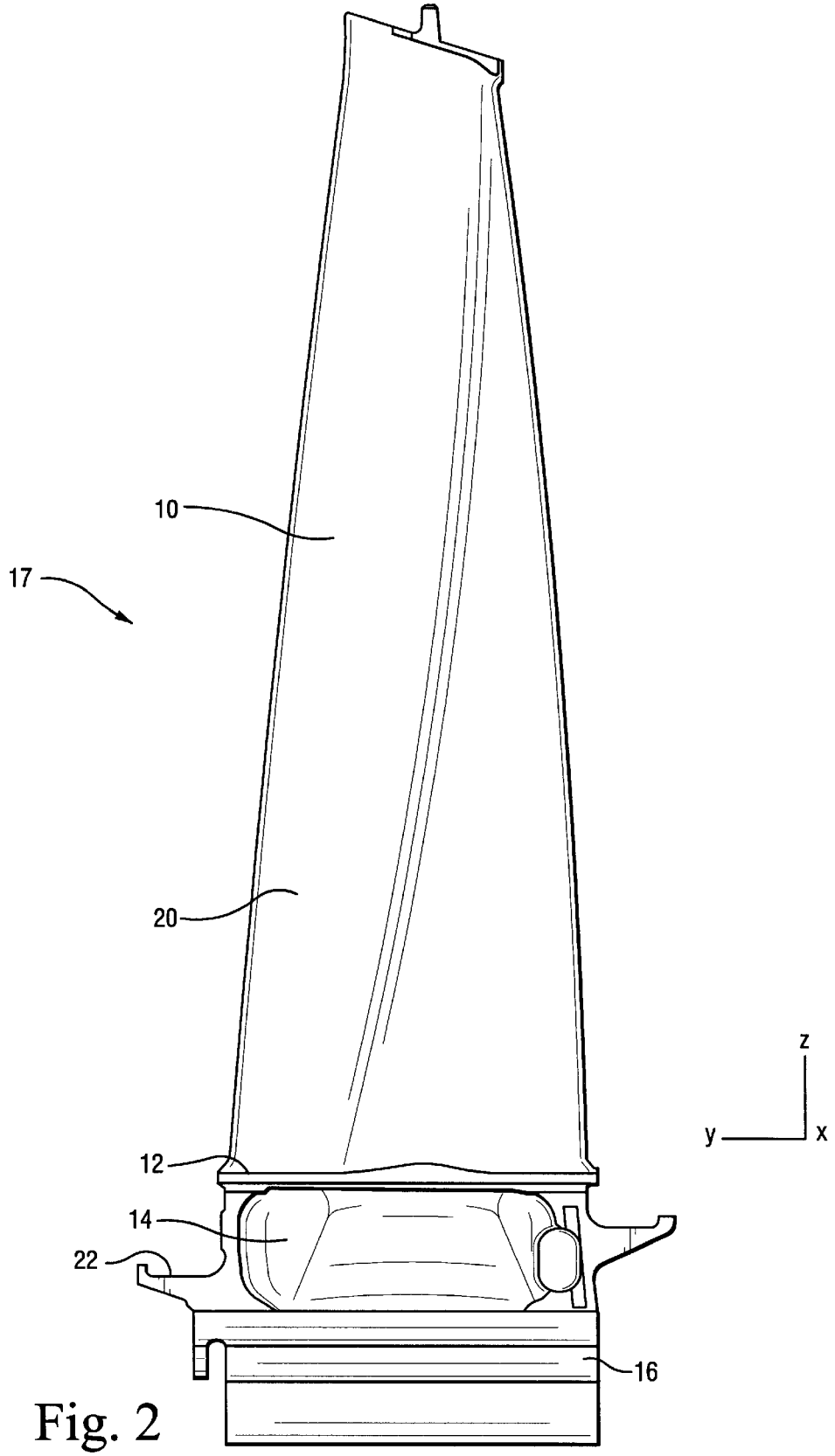
FIG. 2 is a view similar to FIG. 1 illustrating the opposite side of the bucket.
Figure 3:
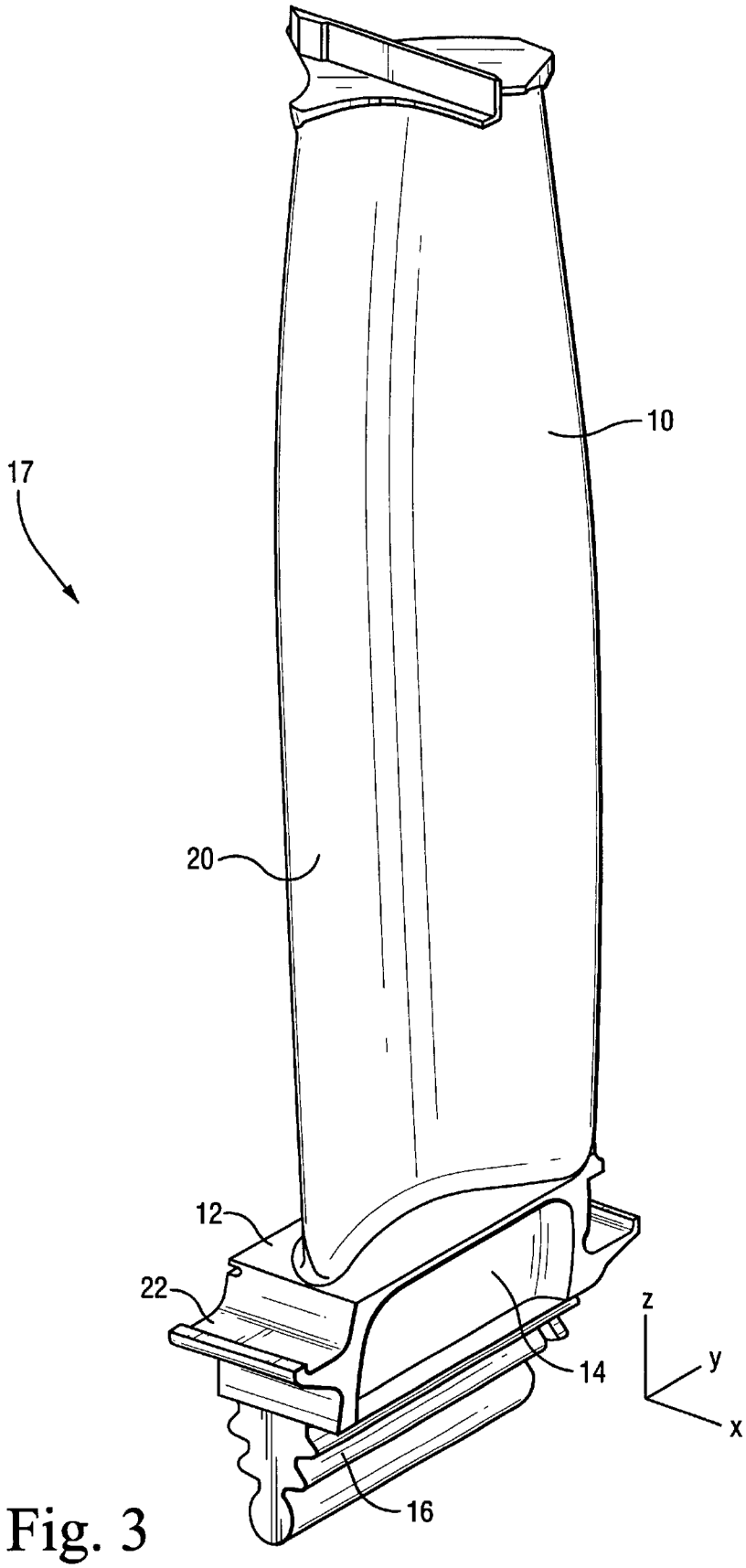
FIG. 3 is a perspective view thereof as seen from the leading edge of the bucket.
Figure 4:
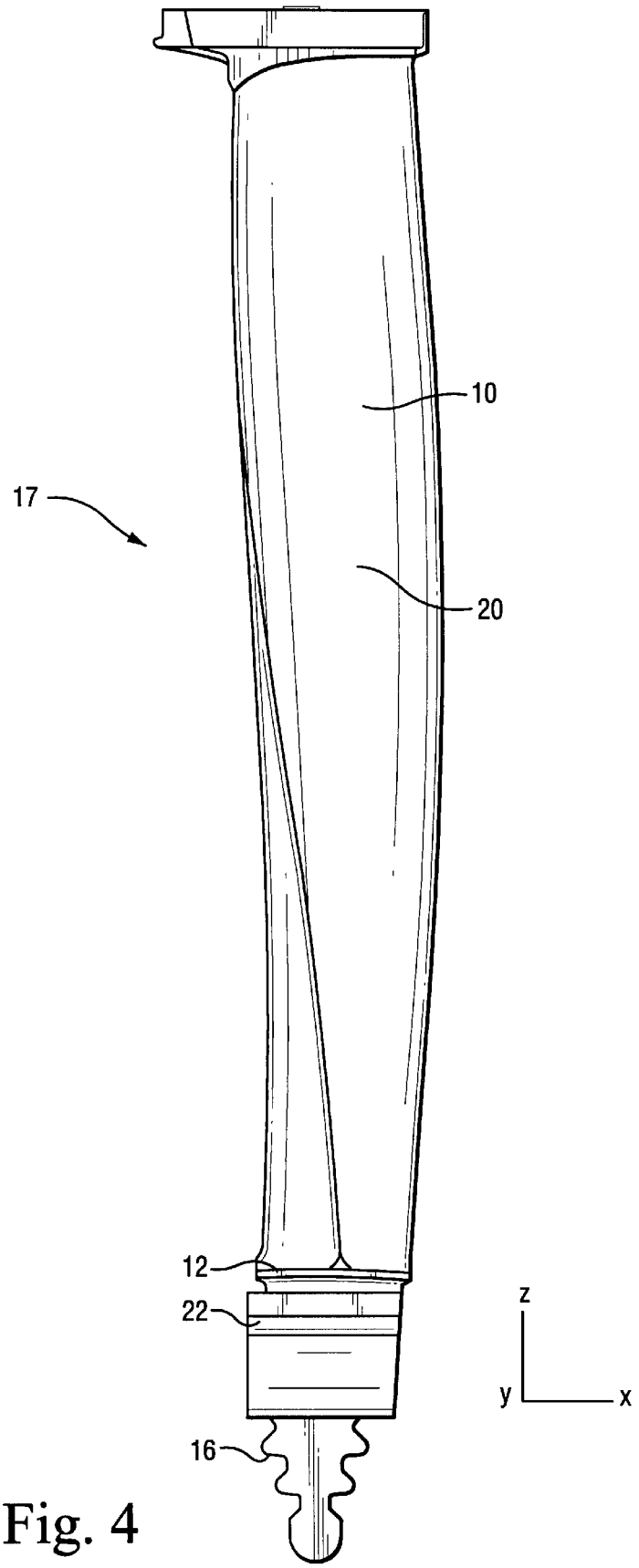
FIG. 4 is an axial view of the bucket as viewed from its leading edge.
Figure 5:
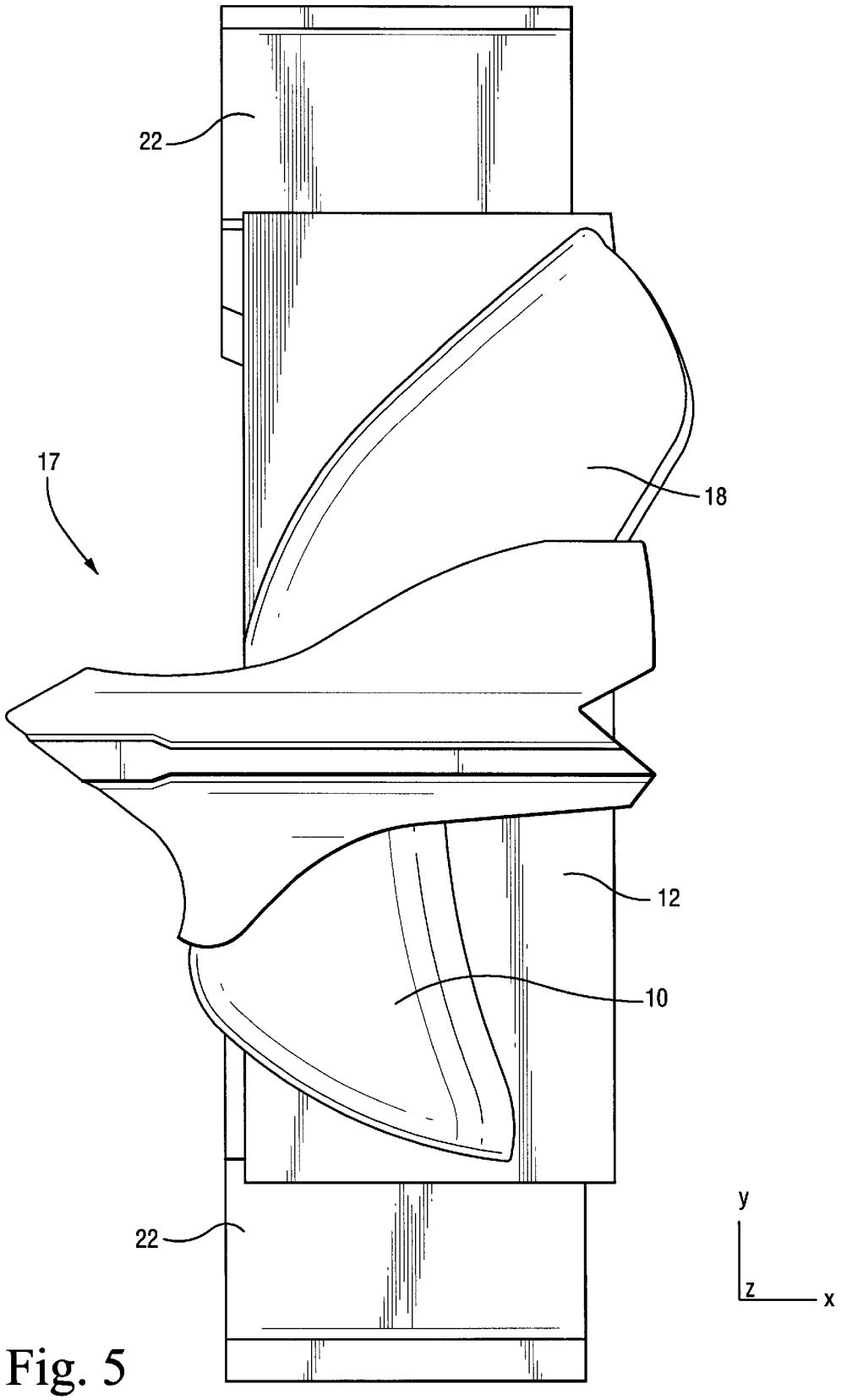
FIG. 5 is an enlarged end view of the bucket as viewed radially inwardly.

Referring now to the drawing figures, particularly to FIGS. 1 and 2, there is illustrated a turbine blade constructed in accordance with the present invention and including an airfoil 10 mounted on a platform 12 carried by a shank 14. The radially inner end of the shank 14 carries a dovetail 16 for coupling the blade to a turbine wheel, not shown. The airfoil 10, platform 12 and dovetail 16 are collectively referred to as a bucket, generally designated 17. The airfoil 10 has a compound curvature with suction and pressure sides 18 and 20, respectively. As conventional, it will be appreciated that the dovetail 16 mates in dovetail openings in a turbine wheel and that a plurality of buckets, preferably eighty-eight buckets, are circumferentially spaced one from the other about the wheel and turbine rotor axis. Additionally, there are wheelspace seals 22, i.e., angel wings, formed on the axially forward and aft sides of shank 14. Preferably, the bucket is integrally cast with cooling, preferably air-cooling, passages, not shown, internal to the bucket including airfoil 10.

Referring now to the drawing figures, there is shown a Cartesian coordinate system defined by X, Y and Z axes. The values for the X, Y and Z coordinates are set forth in inches in Table I which follows. The Cartesian coordinate system has orthogonally-related X, Y and Z axes with the Z axis extending perpendicular to a plane normal to a radius from the centerline of the turbine rotor, i.e., normal to a plane containing the X and Y values. The Z distance commences at zero in the X, Y plane at the radially innermost aerodynamic section. The Y axis lies parallel to the turbine rotor centerline, i.e., the rotary axis. By defining X and Y coordinate values at selected locations in a Z direction normal to the X, Y plane, the profile of airfoil 10 can be ascertained. By connecting the X and Y values with smooth, continuing arcs, each profile section at each distance Z is fixed. The surface profiles at the various surface locations between the distances Z are connected smoothly to one another to form the airfoil. The tabular values given in Table I below are in inches and represent airfoil profiles at ambient, non-operating or non-hot conditions and are for an uncoated airfoil. The sign convention assigns a positive value to the value Z and positive and negative values for the X and Y coordinates, as typically used in a Cartesian coordinate system.

The Table I values are generated and shown to three decimal places for determining the profiles of the airfoil. Further, there are typical manufacturing tolerances as well as coatings which must be accounted for in the actual profile of the airfoil. Accordingly, the values for the profile given in Table I are for a nominal airfoil. It will therefore be appreciated that typical manufacturing tolerances, i.e., plus or minus values and coating thicknesses, are additive to the X and Y values given in Table I below. Accordingly, a distance of ±0.160 inches in a direction normal to any surface location along the airfoil profile defines an airfoil profile envelope for this particular bucket design and turbine.

The coordinate values given in inches in Table I below provide the preferred nominal profile envelope.

TABLE I

| X | Y | Z |
|---|---|---|
| −0.127 | 53.197 | 0.000 |
| 0.390 | 52.472 | 0.000 |
| 0.076 | 52.872 | 0.000 |
| 0.500 | 52.798 | 0.000 |
| 0.301 | 52.563 | 0.000 |
| 0.531 | 52.674 | 0.000 |
| 0.389 | 53.164 | 0.000 |
| −0.061 | 53.087 | 0.000 |
| 0.006 | 52.979 | 0.000 |
| 0.427 | 53.042 | 0.000 |
| 0.222 | 52.663 | 0.000 |
| 0.465 | 52.920 | 0.000 |
| 0.147 | 52.766 | 0.000 |
| 0.549 | 52.547 | 0.000 |
| 0.505 | 52.434 | 0.000 |
| −0.426 | 53.760 | 0.000 |
| 0.351 | 53.285 | 0.000 |
| −0.190 | 53.307 | 0.000 |
| 0.207 | 53.775 | 0.000 |
| 0.276 | 53.530 | 0.000 |
| −0.531 | 53.992 | 0.000 |
| −0.312 | 53.531 | 0.000 |
| 0.174 | 53.898 | 0.000 |
| −0.370 | 53.645 | 0.000 |
| −0.480 | 53.875 | 0.000 |
| −0.252 | 53.419 | 0.000 |
| 0.144 | 54.022 | 0.000 |
| 0.313 | 53.407 | 0.000 |
| 0.241 | 53.652 | 0.000 |
| 0.115 | 54.147 | 0.000 |
| 0.026 | 54.649 | 0.000 |
| −0.669 | 54.350 | 0.000 |
| 0.089 | 54.272 | 0.000 |
| −0.626 | 54.229 | 0.000 |
| −0.803 | 54.841 | 0.000 |
| 0.011 | 54.776 | 0.000 |
| −0.744 | 54.593 | 0.000 |
| 0.045 | 54.523 | 0.000 |
| −0.580 | 54.110 | 0.000 |
| 0.066 | 54.397 | 0.000 |
| −0.708 | 54.471 | 0.000 |
| −0.776 | 54.717 | 0.000 |
| −0.002 | 54.903 | 0.000 |
| −0.827 | 54.967 | 0.000 |
| −0.011 | 55.540 | 0.000 |
| −0.858 | 55.220 | 0.000 |
| −0.017 | 55.413 | 0.000 |
| −0.010 | 55.030 | 0.000 |
| −0.845 | 55.093 | 0.000 |
| −0.866 | 55.347 | 0.000 |
| −0.868 | 55.475 | 0.000 |
| −0.018 | 55.285 | 0.000 |
| −0.002 | 55.667 | 0.000 |
| −0.854 | 55.730 | 0.000 |
| −0.016 | 55.158 | 0.000 |
| −0.864 | 55.603 | 0.000 |
| 0.101 | 56.296 | 0.000 |
| 0.048 | 56.047 | 0.000 |
| −0.667 | 56.469 | 0.000 |
| −0.816 | 55.982 | 0.000 |
| 0.170 | 56.542 | 0.000 |
| −0.787 | 56.106 | 0.000 |
| 0.134 | 56.420 | 0.000 |
| 0.011 | 55.794 | 0.000 |
| −0.838 | 55.856 | 0.000 |
| −0.753 | 56.229 | 0.000 |
| 0.028 | 55.921 | 0.000 |
| −0.713 | 56.350 | 0.000 |
| 0.073 | 56.172 | 0.000 |
| −0.294 | 57.136 | 0.000 |
| −0.560 | 56.701 | 0.000 |
| 0.516 | 57.364 | 0.000 |
| 0.348 | 57.020 | 0.000 |
| −0.218 | 57.239 | 0.000 |
| 0.299 | 56.902 | 0.000 |
| 0.401 | 57.136 | 0.000 |
| −0.616 | 56.586 | 0.000 |

TABLE I-continued

| X | Y | Z |
|---|---|---|
| 0.457 | 57.251 | 0.000 |
| −0.499 | 56.813 | 0.000 |
| −0.366 | 57.031 | 0.000 |
| 0.209 | 56.664 | 0.000 |
| −0.435 | 56.923 | 0.000 |
| 0.252 | 56.784 | 0.000 |
| −0.140 | 57.339 | 0.000 |
| 0.285 | 57.815 | 0.000 |
| 0.375 | 57.905 | 0.000 |
| 0.652 | 58.170 | 0.000 |
| 0.110 | 57.630 | 0.000 |
| 0.642 | 57.586 | 0.000 |
| −0.059 | 57.438 | 0.000 |
| 1.076 | 58.216 | 0.000 |
| 0.709 | 57.695 | 0.000 |
| 0.467 | 57.994 | 0.000 |
| 0.197 | 57.723 | 0.000 |
| 0.578 | 57.476 | 0.000 |
| 0.025 | 57.535 | 0.000 |
| 0.999 | 58.115 | 0.000 |
| 0.778 | 57.802 | 0.000 |
| 0.559 | 58.083 | 0.000 |
| 0.923 | 58.012 | 0.000 |
| 0.849 | 57.908 | 0.000 |
| 1.319 | 58.764 | 0.000 |
| 1.717 | 59.075 | 0.000 |
| 1.756 | 58.977 | 0.000 |
| 1.667 | 58.885 | 0.000 |
| 1.156 | 58.316 | 0.000 |
| 0.745 | 58.257 | 0.000 |
| 1.513 | 58.929 | 0.000 |
| 1.030 | 58.513 | 0.000 |
| 1.404 | 58.606 | 0.000 |
| 1.416 | 58.847 | 0.000 |
| 1.126 | 58.597 | 0.000 |
| 1.610 | 59.012 | 0.000 |
| 1.222 | 58.681 | 0.000 |
| 1.320 | 58.511 | 0.000 |
| 0.935 | 58.428 | 0.000 |
| 0.840 | 58.343 | 0.000 |
| 1.491 | 58.701 | 0.000 |
| 1.578 | 53.794 | 0.000 |
| 1.237 | 58.414 | 0.000 |
| 0.119 | 52.782 | 0.500 |
| 0.498 | 52.685 | 0.500 |
| 0.357 | 52.486 | 0.500 |
| 0.269 | 52.577 | 0.500 |
| 0.468 | 52.808 | 0.500 |
| 0.049 | 52.888 | 0.500 |
| −0.148 | 53.214 | 0.500 |
| 0.395 | 53.052 | 0.500 |
| 0.433 | 52.930 | 0.500 |
| 0.471 | 52.448 | 0.500 |
| 0.515 | 52.560 | 0.500 |
| −0.018 | 52.995 | 0.500 |
| 0.191 | 52.678 | 0.500 |
| 0.358 | 53.173 | 0.500 |
| −0.084 | 53.104 | 0.500 |
| 0.179 | 53.781 | 0.500 |
| 0.283 | 53.415 | 0.500 |
| 0.247 | 53.537 | 0.500 |
| −0.328 | 53.549 | 0.500 |
| −0.540 | 54.010 | 0.500 |
| 0.117 | 54.028 | 0.500 |
| −0.384 | 53.663 | 0.500 |
| −0.491 | 53.893 | 0.500 |
| −0.270 | 53.436 | 0.500 |
| 0.212 | 53.659 | 0.500 |
| −0.439 | 53.777 | 0.500 |
| −0.210 | 53.324 | 0.500 |
| 0.320 | 53.294 | 0.500 |
| 0.147 | 53.904 | 0.500 |
| −0.745 | 54.610 | 0.500 |
| −0.022 | 54.904 | 0.500 |
| −0.631 | 54.247 | 0.500 |
| 0.004 | 54.652 | 0.500 |
| −0.711 | 54.488 | 0.500 |

TABLE I-continued

| X | Y | Z |
|---|---|---|
| 0.021 | 54.526 | 0.500 |
| 0.090 | 54.152 | 0.500 |
| −0.673 | 54.367 | 0.500 |
| −0.011 | 54.778 | 0.500 |
| −0.801 | 54.858 | 0.500 |
| −0.775 | 54.733 | 0.500 |
| 0.064 | 54.276 | 0.500 |
| 0.042 | 54.401 | 0.500 |
| −0.587 | 54.128 | 0.500 |
| −0.822 | 54.983 | 0.500 |
| −0.839 | 55.108 | 0.500 |
| −0.033 | 55.411 | 0.500 |
| −0.850 | 55.235 | 0.500 |
| −0.035 | 55.158 | 0.500 |
| −0.855 | 55.489 | 0.500 |
| −0.036 | 55.285 | 0.500 |
| −0.026 | 55.538 | 0.500 |
| −0.030 | 55.031 | 0.500 |
| −0.849 | 55.615 | 0.500 |
| −0.855 | 55.362 | 0.500 |
| −0.016 | 55.665 | 0.500 |
| 0.132 | 56.411 | 0.500 |
| −0.793 | 55.991 | 0.500 |
| −0.725 | 56.236 | 0.500 |
| 0.170 | 56.532 | 0.500 |
| −0.682 | 56.355 | 0.500 |
| 0.018 | 55.916 | 0.500 |
| 0.098 | 56.288 | 0.500 |
| 0.040 | 56.041 | 0.500 |
| −0.633 | 56.473 | 0.500 |
| −0.001 | 55.791 | 0.500 |
| 0.067 | 56.165 | 0.500 |
| −0.836 | 55.742 | 0.500 |
| −0.762 | 56.115 | 0.500 |
| −0.818 | 55.867 | 0.500 |
| 0.532 | 57.341 | 0.500 |
| 0.413 | 57.117 | 0.500 |
| −0.090 | 57.326 | 0.500 |
| −0.247 | 57.127 | 0.500 |
| 0.257 | 56.770 | 0.500 |
| 0.471 | 57.230 | 0.500 |
| 0.306 | 56.887 | 0.500 |
| −0.321 | 57.024 | 0.500 |
| −0.391 | 56.918 | 0.500 |
| −0.521 | 56.700 | 0.500 |
| 0.358 | 57.003 | 0.500 |
| 0.212 | 56.651 | 0.500 |
| −0.458 | 56.810 | 0.500 |
| −0.580 | 56.588 | 0.500 |
| −0.170 | 57.228 | 0.500 |
| 0.705 | 58.145 | 0.500 |
| 1.025 | 58.079 | 0.500 |
| −0.008 | 57.423 | 0.500 |
| 0.801 | 57.772 | 0.500 |
| 0.873 | 57.876 | 0.500 |
| 0.520 | 57.971 | 0.500 |
| 0.948 | 57.978 | 0.500 |
| 1.104 | 58.179 | 0.500 |
| 0.799 | 58.231 | 0.500 |
| 0.612 | 58.059 | 0.500 |
| 0.595 | 57.451 | 0.500 |
| 0.661 | 57.560 | 0.500 |
| 0.339 | 57.794 | 0.500 |
| 0.076 | 57.518 | 0.500 |
| 0.250 | 57.703 | 0.500 |
| 0.730 | 57.667 | 0.500 |
| 0.429 | 57.883 | 0.500 |
| 0.162 | 57.612 | 0.500 |
| 1.082 | 58.485 | 0.500 |
| 1.563 | 58.899 | 0.500 |
| 1.266 | 58.374 | 0.500 |
| 1.660 | 58.982 | 0.500 |
| 0.988 | 58.401 | 0.500 |
| 1.370 | 58.735 | 0.500 |
| 1.435 | 58.564 | 0.500 |
| 0.893 | 58.316 | 0.500 |
| 1.521 | 58.657 | 0.500 |

TABLE I-continued

| X | Y | Z |
|---|---|---|
| 1.184 | 58.277 | 0.500 |
| 1.466 | 58.817 | 0.500 |
| 1.768 | 59.033 | 0.500 |
| 1.350 | 58.469 | 0.500 |
| 1.274 | 58.652 | 0.500 |
| 1.178 | 58.569 | 0.500 |
| 1.698 | 58.839 | 0.500 |
| 1.787 | 58.929 | 0.500 |
| 1.609 | 58.749 | 0.500 |
| 0.463 | 52.698 | 1.000 |
| 0.021 | 52.905 | 1.000 |
| 0.321 | 52.501 | 1.000 |
| 0.398 | 52.942 | 1.000 |
| 0.361 | 53.063 | 1.000 |
| 0.324 | 53.183 | 1.000 |
| 0.235 | 52.593 | 1.000 |
| 0.433 | 52.462 | 1.000 |
| −0.170 | 53.232 | 1.000 |
| −0.045 | 53.012 | 1.000 |
| 0.433 | 52.821 | 1.000 |
| 0.479 | 52.573 | 1.000 |
| 0.159 | 52.694 | 1.000 |
| −0.108 | 53.122 | 1.000 |
| 0.088 | 52.798 | 1.000 |
| −0.288 | 53.454 | 1.000 |
| −0.550 | 54.028 | 1.000 |
| 0.216 | 53.546 | 1.000 |
| 0.119 | 53.912 | 1.000 |
| −0.399 | 53.681 | 1.000 |
| 0.288 | 53.304 | 1.000 |
| −0.230 | 53.343 | 1.000 |
| 0.150 | 53.790 | 1.000 |
| 0.090 | 54.035 | 1.000 |
| −0.452 | 53.796 | 1.000 |
| −0.502 | 53.912 | 1.000 |
| 0.251 | 53.425 | 1.000 |
| 0.182 | 53.668 | 1.000 |
| −0.345 | 53.567 | 1.000 |
| −0.019 | 54.656 | 1.000 |
| 0.063 | 54.158 | 1.000 |
| 0.017 | 54.406 | 1.000 |
| −0.043 | 54.907 | 1.000 |
| 0.039 | 54.282 | 1.000 |
| −0.774 | 54.750 | 1.000 |
| −0.032 | 54.781 | 1.000 |
| −0.746 | 54.627 | 1.000 |
| −0.595 | 54.146 | 1.000 |
| −0.714 | 54.506 | 1.000 |
| −0.638 | 54.265 | 1.000 |
| −0.799 | 54.874 | 1.000 |
| −0.002 | 54.531 | 1.000 |
| −0.677 | 54.385 | 1.000 |
| −0.832 | 55.124 | 1.000 |
| −0.028 | 55.663 | 1.000 |
| −0.818 | 54.999 | 1.000 |
| −0.048 | 55.412 | 1.000 |
| −0.841 | 55.250 | 1.000 |
| −0.845 | 55.376 | 1.000 |
| −0.833 | 55.628 | 1.000 |
| −0.049 | 55.033 | 1.000 |
| −0.842 | 55.502 | 1.000 |
| −0.040 | 55.537 | 1.000 |
| −0.052 | 55.285 | 1.000 |
| −0.053 | 55.159 | 1.000 |
| 0.131 | 56.402 | 1.000 |
| −0.818 | 55.753 | 1.000 |
| −0.599 | 56.475 | 1.000 |
| −0.735 | 56.122 | 1.000 |
| −0.695 | 56.242 | 1.000 |
| 0.034 | 56.036 | 1.000 |
| −0.797 | 55.878 | 1.000 |
| −0.011 | 55.788 | 1.000 |
| 0.062 | 56.159 | 1.000 |
| −0.650 | 56.360 | 1.000 |
| 0.095 | 56.281 | 1.000 |
| −0.769 | 56.001 | 1.000 |
| 0.009 | 55.913 | 1.000 |

TABLE I-continued

| X | Y | Z |
|---|---|---|
| 0.172 | 56.521 | 1.000 |
| −0.417 | 56.807 | 1.000 |
| 0.216 | 56.640 | 1.000 |
| −0.200 | 57.117 | 1.000 |
| 0.426 | 57.098 | 1.000 |
| −0.482 | 56.699 | 1.000 |
| 0.042 | 57.408 | 1.000 |
| −0.543 | 56.588 | 1.000 |
| −0.041 | 57.313 | 1.000 |
| −0.275 | 57.016 | 1.000 |
| 0.548 | 57.319 | 1.000 |
| 0.263 | 56.756 | 1.000 |
| 0.486 | 57.209 | 1.000 |
| 0.314 | 56.872 | 1.000 |
| −0.122 | 57.216 | 1.000 |
| 0.368 | 56.986 | 1.000 |
| −0.348 | 56.912 | 1.000 |
| 1.132 | 58.141 | 1.000 |
| 0.898 | 57.844 | 1.000 |
| 0.665 | 58.033 | 1.000 |
| 0.974 | 57.944 | 1.000 |
| 0.214 | 57.593 | 1.000 |
| 0.573 | 57.947 | 1.000 |
| 0.302 | 57.683 | 1.000 |
| 0.751 | 57.638 | 1.000 |
| 1.213 | 58.238 | 1.000 |
| 0.758 | 58.119 | 1.000 |
| 1.052 | 58.043 | 1.000 |
| 0.824 | 57.742 | 1.000 |
| 0.127 | 57.501 | 1.000 |
| 0.681 | 57.533 | 1.000 |
| 0.851 | 58.204 | 1.000 |
| 0.614 | 57.427 | 1.000 |
| 0.391 | 57.772 | 1.000 |
| 0.482 | 57.860 | 1.000 |
| 1.818 | 58.881 | 1.000 |
| 1.296 | 53.333 | 1.000 |
| 1.552 | 58.612 | 1.000 |
| 1.639 | 58.703 | 1.000 |
| 1.817 | 58.988 | 1.000 |
| 1.229 | 58.539 | 1.000 |
| 1.465 | 58.520 | 1.000 |
| 1.039 | 58.372 | 1.000 |
| 1.708 | 58.950 | 1.000 |
| 0.945 | 58.288 | 1.000 |
| 1.515 | 58.786 | 1.000 |
| 1.380 | 58.427 | 1.000 |
| 1.324 | 58.622 | 1.000 |
| 1.134 | 58.456 | 1.000 |
| 1.728 | 58.792 | 1.000 |
| 1.611 | 58.868 | 1.000 |
| 1.420 | 58.704 | 1.000 |
| 0.440 | 52.589 | 1.500 |
| 0.193 | 52.610 | 1.500 |
| 0.055 | 52.816 | 1.500 |
| 0.393 | 52.479 | 1.500 |
| 0.124 | 52.711 | 1.500 |
| −0.011 | 52.923 | 1.500 |
| 0.360 | 52.955 | 1.500 |
| −0.195 | 53.250 | 1.500 |
| 0.282 | 52.517 | 1.500 |
| 0.424 | 52.713 | 1.500 |
| 0.288 | 53.196 | 1.500 |
| −0.074 | 53.031 | 1.500 |
| 0.394 | 52.835 | 1.500 |
| 0.324 | 53.076 | 1.500 |
| −0.136 | 53.140 | 1.500 |
| −0.253 | 53.361 | 1.500 |
| 0.182 | 53.557 | 1.500 |
| 0.118 | 53.799 | 1.500 |
| −0.310 | 53.473 | 1.500 |
| −0.417 | 53.700 | 1.500 |
| 0.252 | 53.316 | 1.500 |
| −0.364 | 53.586 | 1.500 |
| 0.149 | 53.678 | 1.500 |
| 0.088 | 53.921 | 1.500 |
| −0.516 | 53.931 | 1.500 |

TABLE I-continued

| X | Y | Z |
|---|---|---|
| 0.060 | 54.043 | 1.500 |
| −0.468 | 53.815 | 1.500 |
| −0.562 | 54.047 | 1.500 |
| 0.217 | 53.436 | 1.500 |
| −0.056 | 54.786 | 1.500 |
| −0.028 | 54.537 | 1.500 |
| −0.749 | 54.645 | 1.500 |
| 0.011 | 54.289 | 1.500 |
| −0.797 | 54.891 | 1.500 |
| 0.034 | 54.166 | 1.500 |
| −0.718 | 54.524 | 1.500 |
| −0.684 | 54.403 | 1.500 |
| −0.043 | 54.661 | 1.500 |
| −0.065 | 54.911 | 1.500 |
| −0.606 | 54.165 | 1.500 |
| −0.646 | 54.283 | 1.500 |
| −0.775 | 54.768 | 1.500 |
| −0.010 | 54.413 | 1.500 |
| −0.817 | 55.641 | 1.500 |
| −0.826 | 55.140 | 1.500 |
| −0.054 | 55.537 | 1.500 |
| −0.070 | 55.036 | 1.500 |
| −0.814 | 55.016 | 1.500 |
| −0.064 | 55.412 | 1.500 |
| −0.828 | 55.516 | 1.500 |
| −0.040 | 55.662 | 1.500 |
| −0.072 | 55.162 | 1.500 |
| −0.070 | 55.287 | 1.500 |
| −0.833 | 55.266 | 1.500 |
| −0.834 | 55.391 | 1.500 |
| 0.174 | 56.511 | 1.500 |
| −0.022 | 55.786 | 1.500 |
| −0.665 | 56.248 | 1.500 |
| 0.132 | 56.393 | 1.500 |
| −0.617 | 56.363 | 1.500 |
| 0.093 | 56.274 | 1.500 |
| 0.027 | 56.032 | 1.500 |
| −0.708 | 56.130 | 1.500 |
| 0.001 | 55.909 | 1.500 |
| −0.799 | 55.765 | 1.500 |
| −0.744 | 56.010 | 1.500 |
| −0.563 | 56.477 | 1.500 |
| −0.775 | 55.888 | 1.500 |
| 0.058 | 56.153 | 1.500 |
| 0.009 | 57.298 | 1.500 |
| 0.439 | 57.079 | 1.500 |
| −0.304 | 56.906 | 1.500 |
| 0.324 | 56.856 | 1.500 |
| −0.230 | 57.007 | 1.500 |
| 0.092 | 57.391 | 1.500 |
| −0.073 | 57.203 | 1.500 |
| −0.374 | 56.802 | 1.500 |
| 0.633 | 57.401 | 1.500 |
| −0.153 | 57.106 | 1.500 |
| 0.221 | 56.627 | 1.500 |
| −0.442 | 56.696 | 1.500 |
| 0.380 | 56.968 | 1.500 |
| 0.566 | 57.295 | 1.500 |
| 0.501 | 57.188 | 1.500 |
| 0.271 | 56.743 | 1.500 |
| −0.505 | 56.588 | 1.500 |
| 0.809 | 58.092 | 1.500 |
| 0.922 | 57.811 | 1.500 |
| 0.847 | 57.710 | 1.500 |
| 0.702 | 57.506 | 1.500 |
| 0.902 | 58.176 | 1.500 |
| 0.534 | 57.836 | 1.500 |
| 1.241 | 58.198 | 1.500 |
| 1.159 | 58.103 | 1.500 |
| 0.717 | 58.007 | 1.500 |
| 0.999 | 57.909 | 1.500 |
| 0.353 | 57.662 | 1.500 |
| 0.773 | 57.609 | 1.500 |
| 0.265 | 57.573 | 1.500 |
| 0.625 | 57.922 | 1.500 |
| 1.078 | 58.007 | 1.500 |
| 0.178 | 57.483 | 1.500 |

TABLE I-continued

| X | Y | Z |
|---|---|---|
| 0.443 | 57.750 | 1.500 |
| 1.669 | 58.656 | 1.500 |
| 1.278 | 58.508 | 1.500 |
| 1.324 | 58.292 | 1.500 |
| 1.847 | 58.833 | 1.500 |
| 1.754 | 58.916 | 1.500 |
| 1.373 | 58.590 | 1.500 |
| 1.494 | 58.476 | 1.500 |
| 1.468 | 58.672 | 1.500 |
| 1.090 | 58.343 | 1.500 |
| 1.563 | 58.754 | 1.500 |
| 1.864 | 58.940 | 1.500 |
| 1.659 | 58.835 | 1.500 |
| 0.996 | 58.260 | 1.500 |
| 1.581 | 58.566 | 1.500 |
| 1.184 | 58.426 | 1.500 |
| 1.409 | 58.384 | 1.500 |
| 1.757 | 58.745 | 1.500 |
| 0.381 | 52.729 | 2.000 |
| 0.247 | 53.209 | 2.000 |
| 0.085 | 52.729 | 2.000 |
| 0.283 | 53.089 | 2.000 |
| 0.157 | 52.628 | 2.000 |
| 0.018 | 52.834 | 2.000 |
| 0.349 | 52.496 | 2.000 |
| −0.167 | 53.159 | 2.000 |
| 0.396 | 52.605 | 2.000 |
| −0.108 | 53.050 | 2.000 |
| 0.318 | 52.970 | 2.000 |
| 0.352 | 52.850 | 2.000 |
| −0.225 | 53.270 | 2.000 |
| 0.239 | 52.535 | 2.000 |
| −0.046 | 52.941 | 2.000 |
| −0.438 | 53.720 | 2.000 |
| 0.212 | 53.328 | 2.000 |
| 0.052 | 53.930 | 2.000 |
| −0.578 | 54.067 | 2.000 |
| 0.144 | 53.568 | 2.000 |
| 0.025 | 54.052 | 2.000 |
| 0.081 | 53.809 | 2.000 |
| −0.281 | 53.381 | 2.000 |
| −0.534 | 53.950 | 2.000 |
| −0.487 | 53.835 | 2.000 |
| 0.112 | 53.688 | 2.000 |
| −0.335 | 53.493 | 2.000 |
| 0.177 | 53.448 | 2.000 |
| −0.388 | 53.606 | 2.000 |
| 0.000 | 54.174 | 2.000 |
| −0.754 | 54.664 | 2.000 |
| −0.059 | 54.543 | 2.000 |
| −0.658 | 54.303 | 2.000 |
| −0.073 | 54.667 | 2.000 |
| −0.619 | 54.184 | 2.000 |
| −0.797 | 54.909 | 2.000 |
| −0.693 | 54.422 | 2.000 |
| −0.091 | 54.915 | 2.000 |
| −0.022 | 54.296 | 2.000 |
| −0.778 | 54.786 | 2.000 |
| −0.042 | 54.420 | 2.000 |
| −0.725 | 54.542 | 2.000 |
| −0.083 | 54.791 | 2.000 |
| −0.812 | 55.033 | 2.000 |
| −0.825 | 55.281 | 2.000 |
| −0.071 | 55.537 | 2.000 |
| −0.801 | 55.654 | 2.000 |
| −0.054 | 55.661 | 2.000 |
| −0.815 | 55.530 | 2.000 |
| −0.095 | 55.040 | 2.000 |
| −0.823 | 55.406 | 2.000 |
| −0.091 | 55.289 | 2.000 |
| −0.822 | 55.157 | 2.000 |
| −0.083 | 55.413 | 2.000 |
| −0.095 | 55.164 | 2.000 |
| −0.719 | 56.018 | 2.000 |
| −0.679 | 56.137 | 2.000 |
| −0.634 | 56.253 | 2.000 |
| 0.178 | 56.499 | 2.000 |

TABLE I-continued

| X | Y | Z |
|---|---|---|
| −0.753 | 55.899 | 2.000 |
| −0.583 | 56.366 | 2.000 |
| −0.527 | 56.477 | 2.000 |
| 0.132 | 56.383 | 2.000 |
| 0.054 | 56.147 | 2.000 |
| −0.034 | 55.784 | 2.000 |
| −0.780 | 55.777 | 2.000 |
| 0.091 | 56.266 | 2.000 |
| 0.021 | 56.027 | 2.000 |
| −0.009 | 55.906 | 2.000 |
| 0.142 | 57.374 | 2.000 |
| 0.652 | 57.374 | 2.000 |
| −0.466 | 56.586 | 2.000 |
| 0.583 | 57.270 | 2.000 |
| 0.334 | 56.839 | 2.000 |
| 0.057 | 57.282 | 2.000 |
| −0.401 | 56.692 | 2.000 |
| 0.278 | 56.727 | 2.000 |
| 0.453 | 57.058 | 2.000 |
| −0.106 | 57.094 | 2.000 |
| −0.184 | 56.997 | 2.000 |
| −0.025 | 57.189 | 2.000 |
| 0.517 | 57.165 | 2.000 |
| −0.260 | 56.398 | 2.000 |
| −0.332 | 56.796 | 2.000 |
| 0.392 | 56.949 | 2.000 |
| 0.226 | 56.614 | 2.000 |
| 1.104 | 57.969 | 2.000 |
| 0.952 | 58.148 | 2.000 |
| 0.870 | 57.677 | 2.000 |
| 0.795 | 57.578 | 2.000 |
| 0.404 | 57.640 | 2.000 |
| 1.186 | 58.063 | 2.000 |
| 0.860 | 58.065 | 2.000 |
| 0.676 | 57.897 | 2.000 |
| 1.046 | 58.231 | 2.000 |
| 1.025 | 57.873 | 2.000 |
| 0.767 | 57.981 | 2.000 |
| 1.268 | 58.156 | 2.000 |
| 0.494 | 57.726 | 2.000 |
| 0.723 | 57.477 | 2.000 |
| 0.946 | 57.776 | 2.000 |
| 0.315 | 57.552 | 2.000 |
| 0.584 | 57.812 | 2.000 |
| 1.352 | 58.249 | 2.000 |
| 0.228 | 57.464 | 2.000 |
| 1.609 | 58.520 | 2.000 |
| 1.233 | 58.396 | 2.000 |
| 1.697 | 58.608 | 2.000 |
| 1.515 | 58.640 | 2.000 |
| 1.421 | 58.559 | 2.000 |
| 1.785 | 58.696 | 2.000 |
| 1.800 | 58.882 | 2.000 |
| 1.326 | 58.477 | 2.000 |
| 1.705 | 58.802 | 2.000 |
| 1.436 | 58.340 | 2.000 |
| 1.874 | 58.783 | 2.000 |
| 1.139 | 58.313 | 2.000 |
| 1.908 | 58.889 | 2.000 |
| 1.522 | 58.430 | 2.000 |
| 1.610 | 58.721 | 2.000 |
| −0.203 | 53.179 | 2.500 |
| 0.334 | 52.745 | 2.500 |
| 0.301 | 52.515 | 2.500 |
| 0.111 | 52.647 | 2.500 |
| −0.145 | 53.070 | 2.500 |
| 0.349 | 52.623 | 2.500 |
| 0.041 | 52.749 | 2.500 |
| 0.202 | 53.223 | 2.500 |
| 0.272 | 52.985 | 2.500 |
| −0.086 | 52.961 | 2.500 |
| 0.237 | 53.104 | 2.500 |
| 0.305 | 52.866 | 2.500 |
| −0.024 | 52.854 | 2.500 |
| 0.192 | 52.554 | 2.500 |
| −0.598 | 54.087 | 2.500 |
| 0.038 | 53.819 | 2.500 |

TABLE I-continued

| X | Y | Z |
|---|---|---|
| −0.416 | 53.626 | 2.500 |
| 0.100 | 53.580 | 2.500 |
| −0.365 | 53.513 | 2.500 |
| 0.010 | 53.940 | 2.500 |
| 0.133 | 53.460 | 2.500 |
| −0.259 | 53.290 | 2.500 |
| −0.465 | 53.740 | 2.500 |
| −0.313 | 53.401 | 2.500 |
| −0.556 | 53.970 | 2.500 |
| −0.016 | 54.061 | 2.500 |
| 0.167 | 53.341 | 2.500 |
| −0.512 | 53.855 | 2.500 |
| 0.069 | 53.699 | 2.500 |
| −0.080 | 54.427 | 2.500 |
| −0.707 | 54.441 | 2.500 |
| −0.638 | 54.204 | 2.500 |
| −0.108 | 54.673 | 2.500 |
| −0.737 | 54.562 | 2.500 |
| −0.040 | 54.182 | 2.500 |
| −0.117 | 54.796 | 2.500 |
| −0.674 | 54.322 | 2.500 |
| −0.061 | 54.304 | 2.500 |
| −0.762 | 54.683 | 2.500 |
| −0.095 | 54.549 | 2.500 |
| −0.784 | 54.805 | 2.500 |
| −0.819 | 55.298 | 2.500 |
| −0.125 | 55.043 | 2.500 |
| −0.814 | 55.421 | 2.500 |
| −0.801 | 54.927 | 2.500 |
| −0.122 | 55.167 | 2.500 |
| −0.071 | 55.659 | 2.500 |
| −0.812 | 55.050 | 2.500 |
| −0.785 | 55.667 | 2.500 |
| −0.803 | 55.545 | 2.500 |
| −0.091 | 55.537 | 2.500 |
| −0.819 | 55.174 | 2.500 |
| −0.123 | 54.920 | 2.500 |
| −0.105 | 55.414 | 2.500 |
| −0.116 | 55.291 | 2.500 |
| −0.693 | 56.027 | 2.500 |
| 0.089 | 56.256 | 2.500 |
| −0.650 | 56.143 | 2.500 |
| 0.049 | 56.139 | 2.500 |
| −0.730 | 55.908 | 2.500 |
| −0.490 | 56.477 | 2.500 |
| 0.181 | 56.486 | 2.500 |
| −0.602 | 56.257 | 2.500 |
| −0.048 | 55.781 | 2.500 |
| −0.548 | 56.368 | 2.500 |
| 0.133 | 56.372 | 2.500 |
| −0.760 | 55.789 | 2.500 |
| 0.012 | 56.021 | 2.500 |
| −0.020 | 55.901 | 2.500 |
| 0.533 | 57.139 | 2.500 |
| 0.468 | 57.034 | 2.500 |
| −0.059 | 57.081 | 2.500 |
| 0.601 | 57.242 | 2.500 |
| 0.232 | 56.599 | 2.500 |
| −0.359 | 56.688 | 2.500 |
| 0.671 | 57.344 | 2.500 |
| 0.191 | 57.355 | 2.500 |
| 0.023 | 57.174 | 2.500 |
| 0.287 | 56.710 | 2.500 |
| −0.427 | 56.584 | 2.500 |
| 0.344 | 56.820 | 2.500 |
| −0.289 | 56.789 | 2.500 |
| 0.106 | 57.266 | 2.500 |
| −0.138 | 56.986 | 2.500 |
| −0.215 | 56.889 | 2.500 |
| 0.404 | 56.928 | 2.500 |
| 0.454 | 57.618 | 2.500 |
| 0.817 | 57.544 | 2.500 |
| 1.294 | 55.113 | 2.500 |
| 0.970 | 57.739 | 2.500 |
| 1.001 | 58.120 | 2.500 |
| 0.544 | 57.703 | 2.500 |
| 0.743 | 57.445 | 2.500 |

TABLE I-continued

| X | Y | Z |
|---|---|---|
| 1.378 | 55.204 | 2.500 |
| 1.211 | 58.021 | 2.500 |
| 0.817 | 57.955 | 2.500 |
| 1.094 | 58.202 | 2.500 |
| 1.130 | 57.928 | 2.500 |
| 0.725 | 57.871 | 2.500 |
| 0.893 | 57.642 | 2.500 |
| 1.049 | 57.834 | 2.500 |
| 0.909 | 58.037 | 2.500 |
| 0.634 | 57.788 | 2.500 |
| 0.278 | 57.444 | 2.500 |
| 0.365 | 57.531 | 2.500 |
| 1.900 | 58.732 | 2.500 |
| 1.656 | 58.688 | 2.500 |
| 1.374 | 58.446 | 2.500 |
| 1.845 | 58.848 | 2.500 |
| 1.636 | 58.472 | 2.500 |
| 1.811 | 58.646 | 2.500 |
| 1.463 | 58.295 | 2.500 |
| 1.949 | 58.836 | 2.500 |
| 1.187 | 58.284 | 2.500 |
| 1.750 | 58.768 | 2.500 |
| 1.280 | 58.365 | 2.500 |
| 1.549 | 58.384 | 2.500 |
| 1.562 | 58.607 | 2.500 |
| 1.723 | 58.559 | 2.500 |
| 1.467 | 58.527 | 2.500 |
| 0.297 | 52.641 | 3.000 |
| 0.188 | 53.120 | 3.000 |
| 0.283 | 52.763 | 3.000 |
| 0.250 | 52.534 | 3.000 |
| 0.062 | 52.667 | 3.000 |
| 0.255 | 52.883 | 3.000 |
| −0.129 | 52.982 | 3.000 |
| 0.222 | 53.001 | 3.000 |
| −0.243 | 53.200 | 3.000 |
| −0.006 | 52.769 | 3.000 |
| −0.069 | 52.875 | 3.000 |
| 0.142 | 52.574 | 3.000 |
| 0.153 | 53.237 | 3.000 |
| −0.187 | 53.091 | 3.000 |
| −0.448 | 53.647 | 3.000 |
| 0.119 | 53.355 | 3.000 |
| 0.052 | 53.592 | 3.000 |
| −0.036 | 53.950 | 3.000 |
| 0.085 | 53.474 | 3.000 |
| −0.061 | 54.071 | 3.000 |
| 0.021 | 53.711 | 3.000 |
| −0.539 | 53.875 | 3.000 |
| −0.582 | 53.991 | 3.000 |
| −0.349 | 53.422 | 3.000 |
| −0.296 | 53.311 | 3.000 |
| −0.495 | 53.761 | 3.000 |
| −0.008 | 53.831 | 3.000 |
| −0.399 | 53.534 | 3.000 |
| −0.155 | 54.802 | 3.000 |
| −0.659 | 54.224 | 3.000 |
| −0.724 | 54.462 | 3.000 |
| −0.136 | 54.557 | 3.000 |
| −0.122 | 54.434 | 3.000 |
| −0.751 | 54.581 | 3.000 |
| −0.147 | 54.679 | 3.000 |
| −0.774 | 54.702 | 3.000 |
| −0.085 | 54.191 | 3.000 |
| −0.105 | 54.313 | 3.000 |
| −0.693 | 54.342 | 3.000 |
| −0.622 | 54.107 | 3.000 |
| −0.792 | 54.824 | 3.000 |
| −0.806 | 54.946 | 3.000 |
| −0.112 | 55.537 | 3.000 |
| −0.814 | 55.069 | 3.000 |
| −0.090 | 55.658 | 3.000 |
| −0.158 | 55.048 | 3.000 |
| −0.153 | 55.170 | 3.000 |
| −0.768 | 55.680 | 3.000 |
| −0.790 | 55.559 | 3.000 |
| −0.130 | 55.415 | 3.000 |

TABLE I-continued

| X | Y | Z |
|---|---|---|
| −0.805 | 55.437 | 3.000 |
| −0.144 | 55.293 | 3.000 |
| −0.817 | 55.192 | 3.000 |
| −0.158 | 54.925 | 3.000 |
| −0.814 | 55.314 | 3.000 |
| 0.003 | 56.014 | 3.000 |
| −0.706 | 55.918 | 3.000 |
| 0.133 | 56.359 | 3.000 |
| 0.184 | 56.471 | 3.000 |
| −0.512 | 56.369 | 3.000 |
| −0.666 | 56.034 | 3.000 |
| −0.451 | 56.476 | 3.000 |
| −0.620 | 56.148 | 3.000 |
| −0.386 | 56.580 | 3.000 |
| −0.569 | 56.260 | 3.000 |
| 0.086 | 56.246 | 3.000 |
| −0.063 | 55.778 | 3.000 |
| −0.740 | 55.800 | 3.000 |
| −0.032 | 55.897 | 3.000 |
| 0.238 | 56.582 | 3.000 |
| 0.043 | 56.131 | 3.000 |
| 0.154 | 57.248 | 3.000 |
| 0.619 | 57.213 | 3.000 |
| −0.012 | 57.067 | 3.000 |
| 0.550 | 57.111 | 3.000 |
| 0.764 | 57.411 | 3.000 |
| −0.092 | 56.974 | 3.000 |
| 0.240 | 57.337 | 3.000 |
| 0.355 | 56.798 | 3.000 |
| −0.170 | 56.879 | 3.000 |
| 0.691 | 57.313 | 3.000 |
| −0.245 | 56.781 | 3.000 |
| 0.482 | 57.008 | 3.000 |
| 0.417 | 56.904 | 3.000 |
| 0.295 | 56.691 | 3.000 |
| 0.071 | 57.158 | 3.000 |
| −0.317 | 56.682 | 3.000 |
| 1.236 | 57.978 | 3.000 |
| 1.049 | 58.091 | 3.000 |
| 0.839 | 57.509 | 3.000 |
| 0.774 | 57.846 | 3.000 |
| 0.593 | 57.679 | 3.000 |
| 0.414 | 57.510 | 3.000 |
| 1.141 | 58.173 | 3.000 |
| 1.154 | 57.886 | 3.000 |
| 1.319 | 58.068 | 3.000 |
| 0.327 | 57.424 | 3.000 |
| 0.503 | 57.595 | 3.000 |
| 1.488 | 58.247 | 3.000 |
| 0.683 | 57.763 | 3.000 |
| 0.865 | 57.928 | 3.000 |
| 0.916 | 57.605 | 3.000 |
| 1.403 | 58.158 | 3.000 |
| 1.074 | 57.794 | 3.000 |
| 0.994 | 57.700 | 3.000 |
| 0.957 | 58.010 | 3.000 |
| 1.420 | 58.414 | 3.000 |
| 1.748 | 58.509 | 3.000 |
| 1.234 | 58.253 | 3.000 |
| 1.326 | 58.334 | 3.000 |
| 1.889 | 58.812 | 3.000 |
| 1.513 | 58.494 | 3.000 |
| 1.574 | 58.335 | 3.000 |
| 1.661 | 58.422 | 3.000 |
| 1.924 | 58.681 | 3.000 |
| 1.607 | 58.574 | 3.000 |
| 1.836 | 58.595 | 3.000 |
| 1.794 | 58.733 | 3.000 |
| 1.986 | 58.780 | 3.000 |
| 1.700 | 58.654 | 3.000 |
| 0.229 | 52.782 | 3.500 |
| 0.089 | 52.595 | 3.500 |
| −0.056 | 52.791 | 3.500 |
| 0.202 | 52.901 | 3.500 |
| −0.231 | 53.113 | 3.500 |
| −0.284 | 53.223 | 3.500 |
| 0.243 | 52.661 | 3.500 |

TABLE I-continued

| X | Y | Z |
|---|---|---|
| 0.102 | 53.254 | 3.500 |
| 0.011 | 52.689 | 3.500 |
| −0.117 | 52.897 | 3.500 |
| 0.196 | 52.555 | 3.500 |
| 0.136 | 53.136 | 3.500 |
| −0.175 | 53.004 | 3.500 |
| 0.170 | 53.019 | 3.500 |
| −0.387 | 53.444 | 3.500 |
| −0.609 | 54.013 | 3.500 |
| −0.084 | 53.962 | 3.500 |
| −0.435 | 53.556 | 3.500 |
| −0.028 | 53.724 | 3.500 |
| −0.336 | 53.333 | 3.500 |
| 0.034 | 53.488 | 3.500 |
| −0.057 | 53.843 | 3.500 |
| −0.482 | 53.669 | 3.500 |
| −0.109 | 54.082 | 3.500 |
| 0.068 | 53.371 | 3.500 |
| −0.569 | 53.897 | 3.500 |
| −0.527 | 53.783 | 3.500 |
| 0.002 | 53.606 | 3.500 |
| −0.647 | 54.129 | 3.500 |
| −0.714 | 54.364 | 3.500 |
| −0.131 | 54.202 | 3.500 |
| −0.766 | 54.602 | 3.500 |
| −0.742 | 54.482 | 3.500 |
| −0.682 | 54.246 | 3.500 |
| −0.179 | 54.565 | 3.500 |
| −0.801 | 54.844 | 3.500 |
| −0.188 | 54.686 | 3.500 |
| −0.150 | 54.322 | 3.500 |
| −0.166 | 54.443 | 3.500 |
| −0.786 | 54.723 | 3.500 |
| −0.194 | 54.808 | 3.500 |
| −0.173 | 55.296 | 3.500 |
| −0.815 | 55.209 | 3.500 |
| −0.109 | 55.656 | 3.500 |
| −0.811 | 54.965 | 3.500 |
| −0.751 | 55.693 | 3.500 |
| −0.808 | 55.331 | 3.500 |
| −0.185 | 55.174 | 3.500 |
| −0.135 | 55.537 | 3.500 |
| −0.777 | 55.573 | 3.500 |
| −0.156 | 55.417 | 3.500 |
| −0.192 | 55.052 | 3.500 |
| −0.816 | 55.087 | 3.500 |
| −0.195 | 54.930 | 3.500 |
| −0.796 | 55.453 | 3.500 |
| −0.005 | 56.007 | 3.500 |
| 0.037 | 56.122 | 3.500 |
| 0.188 | 56.456 | 3.500 |
| −0.682 | 55.927 | 3.500 |
| −0.079 | 55.775 | 3.500 |
| −0.535 | 56.262 | 3.500 |
| −0.044 | 55.892 | 3.500 |
| 0.244 | 56.564 | 3.500 |
| −0.476 | 56.369 | 3.500 |
| 0.134 | 56.346 | 3.500 |
| −0.589 | 56.152 | 3.500 |
| −0.638 | 56.041 | 3.500 |
| −0.413 | 56.473 | 3.500 |
| −0.346 | 56.575 | 3.500 |
| −0.720 | 55.811 | 3.500 |
| 0.084 | 56.235 | 3.500 |
| 0.288 | 57.317 | 3.500 |
| 0.118 | 57.141 | 3.500 |
| −0.125 | 56.867 | 3.500 |
| −0.046 | 56.960 | 3.500 |
| 0.375 | 57.402 | 3.500 |
| 0.498 | 56.981 | 3.500 |
| −0.275 | 56.675 | 3.500 |
| 0.202 | 57.230 | 3.500 |
| 0.567 | 57.082 | 3.500 |
| 0.431 | 56.879 | 3.500 |
| 0.366 | 56.775 | 3.500 |
| 0.711 | 57.279 | 3.500 |
| −0.201 | 56.772 | 3.500 |

TABLE I-continued

| X | Y | Z |
|---|---|---|
| 0.035 | 57.052 | 3.500 |
| 0.785 | 57.376 | 3.500 |
| 0.304 | 56.670 | 3.500 |
| 0.638 | 57.181 | 3.500 |
| 1.097 | 57.751 | 3.500 |
| 0.821 | 57.819 | 3.500 |
| 1.279 | 58.223 | 3.500 |
| 0.552 | 57.571 | 3.500 |
| 1.512 | 58.199 | 3.500 |
| 0.861 | 57.471 | 3.500 |
| 1.003 | 57.982 | 3.500 |
| 1.344 | 58.022 | 3.500 |
| 1.187 | 58.143 | 3.500 |
| 1.178 | 57.843 | 3.500 |
| 0.939 | 57.566 | 3.500 |
| 0.912 | 57.900 | 3.500 |
| 0.463 | 57.487 | 3.500 |
| 0.731 | 57.737 | 3.500 |
| 1.017 | 57.659 | 3.500 |
| 0.641 | 57.654 | 3.500 |
| 1.428 | 58.111 | 3.500 |
| 1.261 | 57.933 | 3.500 |
| 1.095 | 58.062 | 3.500 |
| 1.947 | 58.627 | 3.500 |
| 1.859 | 58.543 | 3.500 |
| 1.684 | 58.372 | 3.500 |
| 1.557 | 58.461 | 3.500 |
| 1.464 | 58.382 | 3.500 |
| 1.932 | 58.774 | 3.500 |
| 1.650 | 58.540 | 3.500 |
| 2.019 | 58.722 | 3.500 |
| 1.744 | 58.619 | 3.500 |
| 1.837 | 58.697 | 3.500 |
| 1.371 | 58.302 | 3.500 |
| 1.771 | 58.458 | 3.500 |
| 1.598 | 58.286 | 3.500 |
| −0.107 | 52.815 | 4.000 |
| 0.187 | 52.683 | 4.000 |
| 0.033 | 52.618 | 4.000 |
| 0.147 | 52.921 | 4.000 |
| 0.139 | 52.578 | 4.000 |
| −0.276 | 53.137 | 4.000 |
| 0.174 | 52.803 | 4.000 |
| −0.327 | 53.246 | 4.000 |
| −0.043 | 52.712 | 4.000 |
| 0.083 | 53.155 | 4.000 |
| 0.116 | 53.038 | 4.000 |
| −0.166 | 52.920 | 4.000 |
| −0.222 | 53.028 | 4.000 |
| −0.559 | 53.806 | 4.000 |
| −0.133 | 53.975 | 4.000 |
| −0.078 | 53.739 | 4.000 |
| 0.049 | 53.271 | 4.000 |
| −0.157 | 54.094 | 4.000 |
| −0.600 | 53.920 | 4.000 |
| −0.426 | 53.468 | 4.000 |
| −0.017 | 53.504 | 4.000 |
| −0.517 | 53.693 | 4.000 |
| −0.377 | 53.357 | 4.000 |
| −0.049 | 53.621 | 4.000 |
| −0.472 | 53.580 | 4.000 |
| −0.638 | 54.035 | 4.000 |
| −0.107 | 53.857 | 4.000 |
| 0.016 | 53.388 | 4.000 |
| −0.734 | 54.386 | 4.000 |
| −0.233 | 54.816 | 4.000 |
| −0.781 | 54.624 | 4.000 |
| −0.759 | 54.504 | 4.000 |
| −0.673 | 54.151 | 4.000 |
| −0.222 | 54.574 | 4.000 |
| −0.705 | 54.268 | 4.000 |
| −0.229 | 54.695 | 4.000 |
| −0.797 | 54.744 | 4.000 |
| −0.809 | 54.864 | 4.000 |
| −0.178 | 54.213 | 4.000 |
| −0.211 | 54.453 | 4.000 |
| −0.196 | 54.333 | 4.000 |

TABLE I-continued

| X | Y | Z |
|---|---|---|
| −0.785 | 55.468 | 4.000 |
| −0.127 | 55.655 | 4.000 |
| −0.817 | 55.106 | 4.000 |
| −0.762 | 55.587 | 4.000 |
| −0.201 | 55.299 | 4.000 |
| −0.157 | 55.538 | 4.000 |
| −0.802 | 55.348 | 4.000 |
| −0.813 | 55.228 | 4.000 |
| −0.226 | 55.058 | 4.000 |
| −0.216 | 55.179 | 4.000 |
| −0.181 | 55.419 | 4.000 |
| −0.232 | 54.937 | 4.000 |
| −0.733 | 55.705 | 4.000 |
| −0.816 | 54.985 | 4.000 |
| 0.251 | 56.545 | 4.000 |
| −0.374 | 56.469 | 4.000 |
| 0.033 | 56.112 | 4.000 |
| −0.500 | 56.263 | 4.000 |
| −0.094 | 55.772 | 4.000 |
| −0.698 | 55.821 | 4.000 |
| −0.439 | 56.367 | 4.000 |
| 0.192 | 56.439 | 4.000 |
| −0.656 | 55.935 | 4.000 |
| −0.305 | 56.569 | 4.000 |
| 0.082 | 56.223 | 4.000 |
| −0.056 | 55.887 | 4.000 |
| −0.610 | 56.047 | 4.000 |
| 0.135 | 56.332 | 4.000 |
| −0.557 | 56.156 | 4.000 |
| −0.014 | 56.000 | 4.000 |
| 0.000 | 56.946 | 4.000 |
| 0.730 | 57.244 | 4.000 |
| 0.513 | 56.953 | 4.000 |
| 0.444 | 56.853 | 4.000 |
| −0.080 | 56.855 | 4.000 |
| −0.157 | 56.762 | 4.000 |
| 0.313 | 56.649 | 4.000 |
| 0.336 | 57.296 | 4.000 |
| 0.165 | 57.124 | 4.000 |
| 0.656 | 57.148 | 4.000 |
| 0.584 | 57.051 | 4.000 |
| 0.082 | 57.035 | 4.000 |
| 0.422 | 57.380 | 4.000 |
| 0.806 | 57.339 | 4.000 |
| −0.232 | 56.666 | 4.000 |
| 0.250 | 57.210 | 4.000 |
| 0.378 | 56.752 | 4.000 |
| 1.323 | 58.191 | 4.000 |
| 0.599 | 57.547 | 4.000 |
| 1.202 | 57.798 | 4.000 |
| 0.867 | 57.792 | 4.000 |
| 1.140 | 58.032 | 4.000 |
| 0.958 | 57.872 | 4.000 |
| 1.535 | 58.149 | 4.000 |
| 1.049 | 57.952 | 4.000 |
| 0.777 | 57.710 | 4.000 |
| 0.688 | 57.629 | 4.000 |
| 1.451 | 58.062 | 4.000 |
| 1.120 | 57.708 | 4.000 |
| 1.040 | 57.617 | 4.000 |
| 1.231 | 58.112 | 4.000 |
| 0.961 | 57.525 | 4.000 |
| 1.621 | 58.235 | 4.000 |
| 0.510 | 57.464 | 4.000 |
| 1.284 | 57.887 | 4.000 |
| 0.883 | 57.433 | 4.000 |
| 1.367 | 57.975 | 4.000 |
| 1.693 | 58.505 | 4.000 |
| 1.600 | 58.427 | 4.000 |
| 1.508 | 58.348 | 4.000 |
| 1.879 | 58.660 | 4.000 |
| 1.975 | 58.733 | 4.000 |
| 2.048 | 58.663 | 4.000 |
| 1.794 | 58.405 | 4.000 |
| 1.707 | 58.321 | 4.000 |
| 1.786 | 58.582 | 4.000 |
| 1.881 | 58.490 | 4.000 |

TABLE I-continued

| X | Y | Z |
|---|---|---|
| 1.415 | 58.270 | 4.000 |
| 1.968 | 58.573 | 4.000 |
| 0.060 | 53.058 | 4.500 |
| −0.217 | 52.946 | 4.500 |
| 0.028 | 53.174 | 4.500 |
| 0.081 | 52.601 | 4.500 |
| 0.117 | 52.825 | 4.500 |
| −0.098 | 52.737 | 4.500 |
| 0.129 | 52.705 | 4.500 |
| −0.271 | 53.053 | 4.500 |
| −0.322 | 53.162 | 4.500 |
| 0.091 | 52.942 | 4.500 |
| −0.024 | 52.642 | 4.500 |
| −0.160 | 52.840 | 4.500 |
| −0.037 | 53.406 | 4.500 |
| −0.069 | 53.522 | 4.500 |
| −0.510 | 53.605 | 4.500 |
| −0.156 | 53.872 | 4.500 |
| −0.372 | 53.272 | 4.500 |
| −0.466 | 53.493 | 4.500 |
| −0.666 | 54.060 | 4.500 |
| −0.129 | 53.755 | 4.500 |
| −0.182 | 53.989 | 4.500 |
| −0.005 | 53.290 | 4.500 |
| −0.631 | 53.945 | 4.500 |
| −0.100 | 53.638 | 4.500 |
| −0.593 | 53.831 | 4.500 |
| −0.552 | 53.717 | 4.500 |
| −0.420 | 53.382 | 4.500 |
| −0.777 | 54.528 | 4.500 |
| −0.204 | 54.108 | 4.500 |
| −0.254 | 54.465 | 4.500 |
| −0.729 | 54.292 | 4.500 |
| −0.271 | 54.825 | 4.500 |
| −0.224 | 54.226 | 4.500 |
| −0.755 | 54.409 | 4.500 |
| −0.241 | 54.345 | 4.500 |
| −0.795 | 54.646 | 4.500 |
| −0.270 | 54.705 | 4.500 |
| −0.817 | 54.886 | 4.500 |
| −0.699 | 54.175 | 4.500 |
| −0.808 | 54.766 | 4.500 |
| −0.264 | 54.585 | 4.500 |
| −0.246 | 55.185 | 4.500 |
| −0.713 | 55.717 | 4.500 |
| −0.809 | 55.246 | 4.500 |
| −0.267 | 54.945 | 4.500 |
| −0.145 | 55.654 | 4.500 |
| −0.820 | 55.006 | 4.500 |
| −0.205 | 55.422 | 4.500 |
| −0.746 | 55.601 | 4.500 |
| −0.259 | 55.065 | 4.500 |
| −0.817 | 55.126 | 4.500 |
| −0.228 | 55.304 | 4.500 |
| −0.794 | 55.366 | 4.500 |
| −0.177 | 55.539 | 4.500 |
| −0.773 | 55.484 | 4.500 |
| −0.580 | 56.052 | 4.500 |
| −0.525 | 56.159 | 4.500 |
| −0.630 | 55.942 | 4.500 |
| −0.108 | 55.769 | 4.500 |
| −0.401 | 56.365 | 4.500 |
| 0.029 | 56.103 | 4.500 |
| 0.137 | 56.317 | 4.500 |
| 0.196 | 56.422 | 4.500 |
| −0.263 | 56.562 | 4.500 |
| −0.021 | 55.993 | 4.500 |
| 0.258 | 56.525 | 4.500 |
| 0.081 | 56.211 | 4.500 |
| −0.674 | 55.831 | 4.500 |
| −0.334 | 56.465 | 4.500 |
| −0.066 | 55.882 | 4.500 |
| −0.465 | 56.263 | 4.500 |
| −0.113 | 56.750 | 4.500 |
| 0.458 | 56.826 | 4.500 |
| −0.035 | 56.841 | 4.500 |
| 0.528 | 56.923 | 4.500 |

TABLE I-continued

| X | Y | Z |
|---|---|---|
| 0.674 | 57.114 | 4.500 |
| 0.211 | 57.105 | 4.500 |
| 0.904 | 57.393 | 4.500 |
| 0.296 | 57.190 | 4.500 |
| 0.601 | 57.019 | 4.500 |
| 0.389 | 56.727 | 4.500 |
| 0.046 | 56.931 | 4.500 |
| 0.826 | 57.301 | 4.500 |
| 0.128 | 57.018 | 4.500 |
| −0.190 | 56.657 | 4.500 |
| 0.469 | 57.357 | 4.500 |
| 0.750 | 57.208 | 4.500 |
| 0.382 | 57.274 | 4.500 |
| 0.323 | 56.627 | 4.500 |
| 1.389 | 57.926 | 4.500 |
| 1.642 | 58.184 | 4.500 |
| 1.143 | 57.663 | 4.500 |
| 1.557 | 58.099 | 4.500 |
| 1.093 | 57.923 | 4.500 |
| 1.366 | 58.158 | 4.500 |
| 1.473 | 58.013 | 4.500 |
| 0.734 | 57.603 | 4.500 |
| 0.823 | 57.683 | 4.500 |
| 1.062 | 57.574 | 4.500 |
| 1.306 | 57.839 | 4.500 |
| 0.982 | 57.484 | 4.500 |
| 1.275 | 58.080 | 4.500 |
| 0.645 | 57.522 | 4.500 |
| 1.003 | 57.843 | 4.500 |
| 1.224 | 57.752 | 4.500 |
| 0.557 | 57.440 | 4.500 |
| 1.458 | 58.236 | 4.500 |
| 0.913 | 57.764 | 4.500 |
| 1.184 | 58.002 | 4.500 |
| 1.814 | 58.352 | 4.500 |
| 1.642 | 58.391 | 4.500 |
| 1.919 | 58.622 | 4.500 |
| 1.550 | 58.314 | 4.500 |
| 1.728 | 58.268 | 4.500 |
| 1.901 | 58.435 | 4.500 |
| 1.827 | 58.545 | 4.500 |
| 2.072 | 58.603 | 4.500 |
| 1.734 | 58.468 | 4.500 |
| 1.989 | 58.518 | 4.500 |
| 2.018 | 58.688 | 4.500 |
| −0.695 | 54.086 | 5.000 |
| 0.021 | 52.626 | 5.000 |
| 0.058 | 52.848 | 5.000 |
| −0.463 | 53.409 | 5.000 |
| −0.028 | 53.195 | 5.000 |
| 0.004 | 53.080 | 5.000 |
| 0.069 | 52.729 | 5.000 |
| −0.083 | 52.669 | 5.000 |
| −0.589 | 53.744 | 5.000 |
| −0.627 | 53.857 | 5.000 |
| −0.091 | 53.425 | 5.000 |
| −0.152 | 53.656 | 5.000 |
| −0.230 | 54.005 | 5.000 |
| −0.370 | 53.189 | 5.000 |
| −0.154 | 52.764 | 5.000 |
| −0.321 | 53.081 | 5.000 |
| −0.122 | 53.540 | 5.000 |
| −0.215 | 52.867 | 5.000 |
| −0.206 | 53.888 | 5.000 |
| −0.180 | 53.772 | 5.000 |
| −0.549 | 53.632 | 5.000 |
| 0.033 | 52.964 | 5.000 |
| −0.662 | 53.971 | 5.000 |
| −0.507 | 53.520 | 5.000 |
| −0.060 | 53.310 | 5.000 |
| −0.417 | 53.299 | 5.000 |
| −0.269 | 52.973 | 5.000 |
| −0.752 | 54.318 | 5.000 |
| −0.297 | 54.477 | 5.000 |
| −0.308 | 54.835 | 5.000 |
| −0.286 | 54.358 | 5.000 |
| −0.309 | 54.716 | 5.000 |

TABLE I-continued

| X | Y | Z |
|---|---|---|
| −0.305 | 54.596 | 5.000 |
| −0.809 | 54.671 | 5.000 |
| −0.725 | 54.201 | 5.000 |
| −0.271 | 54.240 | 5.000 |
| −0.824 | 54.909 | 5.000 |
| −0.252 | 54.122 | 5.000 |
| −0.775 | 54.435 | 5.000 |
| −0.794 | 54.552 | 5.000 |
| −0.819 | 54.790 | 5.000 |
| −0.302 | 54.954 | 5.000 |
| −0.228 | 55.425 | 5.000 |
| −0.291 | 55.073 | 5.000 |
| −0.817 | 55.147 | 5.000 |
| −0.197 | 55.540 | 5.000 |
| −0.804 | 55.266 | 5.000 |
| −0.785 | 55.384 | 5.000 |
| −0.161 | 55.654 | 5.000 |
| −0.823 | 55.028 | 5.000 |
| −0.729 | 55.616 | 5.000 |
| −0.692 | 55.729 | 5.000 |
| −0.254 | 55.308 | 5.000 |
| −0.275 | 55.191 | 5.000 |
| −0.760 | 55.501 | 5.000 |
| −0.650 | 55.841 | 5.000 |
| −0.120 | 55.766 | 5.000 |
| −0.221 | 56.555 | 5.000 |
| −0.027 | 55.986 | 5.000 |
| 0.140 | 56.302 | 5.000 |
| −0.429 | 56.263 | 5.000 |
| 0.026 | 56.093 | 5.000 |
| −0.075 | 55.877 | 5.000 |
| −0.363 | 56.362 | 5.000 |
| −0.602 | 55.950 | 5.000 |
| −0.491 | 56.161 | 5.000 |
| −0.294 | 56.460 | 5.000 |
| 0.202 | 56.404 | 5.000 |
| −0.549 | 56.057 | 5.000 |
| 0.266 | 56.505 | 5.000 |
| 0.081 | 56.198 | 5.000 |
| 0.174 | 57.001 | 5.000 |
| 0.617 | 56.987 | 5.000 |
| 0.332 | 56.604 | 5.000 |
| 0.343 | 57.170 | 5.000 |
| −0.147 | 56.647 | 5.000 |
| 0.091 | 56.915 | 5.000 |
| −0.069 | 56.738 | 5.000 |
| 0.401 | 56.702 | 5.000 |
| 0.768 | 57.172 | 5.000 |
| 0.258 | 57.086 | 5.000 |
| 0.543 | 56.893 | 5.000 |
| 0.845 | 57.263 | 5.000 |
| 0.515 | 57.334 | 5.000 |
| 0.010 | 56.828 | 5.000 |
| 0.429 | 57.252 | 5.000 |
| 0.924 | 57.353 | 5.000 |
| 0.471 | 56.798 | 5.000 |
| 0.692 | 57.080 | 5.000 |
| 1.410 | 57.877 | 5.000 |
| 1.494 | 57.963 | 5.000 |
| 1.047 | 57.814 | 5.000 |
| 1.164 | 57.618 | 5.000 |
| 0.868 | 57.656 | 5.000 |
| 1.227 | 57.971 | 5.000 |
| 0.779 | 57.576 | 5.000 |
| 1.083 | 57.530 | 5.000 |
| 1.245 | 57.705 | 5.000 |
| 1.136 | 57.893 | 5.000 |
| 1.327 | 57.792 | 5.000 |
| 0.957 | 57.735 | 5.000 |
| 0.603 | 57.416 | 5.000 |
| 0.691 | 57.496 | 5.000 |
| 1.003 | 57.442 | 5.000 |
| 1.662 | 58.131 | 5.000 |
| 1.958 | 58.584 | 5.000 |
| 1.317 | 58.048 | 5.000 |
| 1.683 | 58.355 | 5.000 |
| 1.578 | 58.047 | 5.000 |

TABLE I-continued

| X | Y | Z |
|---|---|---|
| 1.591 | 58.279 | 5.000 |
| 1.774 | 58.432 | 5.000 |
| 1.408 | 58.126 | 5.000 |
| 1.748 | 58.215 | 5.000 |
| 2.059 | 58.638 | 5.000 |
| 1.920 | 58.380 | 5.000 |
| 2.093 | 58.544 | 5.000 |
| 2.007 | 58.462 | 5.000 |
| 1.499 | 58.203 | 5.000 |
| 1.866 | 58.508 | 5.000 |
| 1.834 | 58.298 | 5.000 |
| −0.085 | 53.217 | 5.500 |
| −0.213 | 52.794 | 5.500 |
| 0.007 | 52.754 | 5.500 |
| −0.419 | 53.219 | 5.500 |
| −0.661 | 53.886 | 5.500 |
| −0.144 | 52.693 | 5.500 |
| −0.271 | 52.897 | 5.500 |
| −0.176 | 53.560 | 5.500 |
| −0.146 | 53.445 | 5.500 |
| −0.588 | 53.661 | 5.500 |
| −0.507 | 53.439 | 5.500 |
| −0.042 | 52.653 | 5.500 |
| −0.204 | 53.675 | 5.500 |
| −0.626 | 53.773 | 5.500 |
| −0.549 | 53.550 | 5.500 |
| −0.055 | 53.102 | 5.500 |
| −0.464 | 53.329 | 5.500 |
| −0.279 | 54.022 | 5.500 |
| −0.231 | 53.790 | 5.500 |
| −0.116 | 53.331 | 5.500 |
| −0.372 | 53.111 | 5.500 |
| −0.003 | 52.871 | 5.500 |
| −0.256 | 53.905 | 5.500 |
| −0.323 | 53.003 | 5.500 |
| −0.026 | 52.987 | 5.500 |
| −0.694 | 54.000 | 5.500 |
| −0.345 | 54.609 | 5.500 |
| −0.829 | 54.815 | 5.500 |
| −0.316 | 54.255 | 5.500 |
| −0.725 | 54.114 | 5.500 |
| −0.822 | 54.697 | 5.500 |
| −0.752 | 54.229 | 5.500 |
| −0.299 | 54.138 | 5.500 |
| −0.776 | 54.345 | 5.500 |
| −0.330 | 54.373 | 5.500 |
| −0.347 | 54.727 | 5.500 |
| −0.796 | 54.462 | 5.500 |
| −0.344 | 54.845 | 5.500 |
| −0.340 | 54.491 | 5.500 |
| −0.811 | 54.579 | 5.500 |
| −0.321 | 55.081 | 5.500 |
| −0.829 | 54.934 | 5.500 |
| −0.249 | 55.428 | 5.500 |
| −0.214 | 55.541 | 5.500 |
| −0.175 | 55.653 | 5.500 |
| −0.278 | 55.313 | 5.500 |
| −0.774 | 55.403 | 5.500 |
| −0.745 | 55.517 | 5.500 |
| −0.814 | 55.170 | 5.500 |
| −0.335 | 54.963 | 5.500 |
| −0.710 | 55.630 | 5.500 |
| −0.302 | 55.198 | 5.500 |
| −0.825 | 55.052 | 5.500 |
| −0.797 | 55.287 | 5.500 |
| −0.516 | 56.061 | 5.500 |
| −0.572 | 55.957 | 5.500 |
| −0.083 | 55.871 | 5.500 |
| 0.273 | 56.484 | 5.500 |
| −0.131 | 55.763 | 5.500 |
| −0.179 | 56.547 | 5.500 |
| 0.207 | 56.386 | 5.500 |
| −0.670 | 55.742 | 5.500 |
| 0.082 | 56.185 | 5.500 |
| −0.623 | 55.850 | 5.500 |
| −0.032 | 55.977 | 5.500 |
| 0.143 | 56.286 | 5.500 |

TABLE I-continued

| X | Y | Z |
|---|---|---|
| −0.456 | 56.163 | 5.500 |
| −0.392 | 56.262 | 5.500 |
| 0.023 | 56.082 | 5.500 |
| −0.324 | 56.359 | 5.500 |
| −0.253 | 56.454 | 5.500 |
| 0.484 | 56.769 | 5.500 |
| −0.103 | 56.637 | 5.500 |
| 0.561 | 57.311 | 5.500 |
| 0.136 | 56.899 | 5.500 |
| 0.863 | 57.223 | 5.500 |
| 0.055 | 56.814 | 5.500 |
| −0.025 | 56.726 | 5.500 |
| 0.412 | 56.676 | 5.500 |
| 0.785 | 57.134 | 5.500 |
| 0.632 | 56.954 | 5.500 |
| 0.648 | 57.391 | 5.500 |
| 0.474 | 57.231 | 5.500 |
| 0.708 | 57.045 | 5.500 |
| 0.388 | 57.149 | 5.500 |
| 0.942 | 57.312 | 5.500 |
| 0.557 | 56.862 | 5.500 |
| 0.303 | 57.067 | 5.500 |
| 1.022 | 57.399 | 5.500 |
| 0.219 | 56.984 | 5.500 |
| 0.342 | 56.580 | 5.500 |
| 0.735 | 57.471 | 5.500 |
| 1.597 | 57.995 | 5.500 |
| 1.089 | 57.785 | 5.500 |
| 0.912 | 57.629 | 5.500 |
| 1.269 | 57.940 | 5.500 |
| 1.359 | 58.016 | 5.500 |
| 1.000 | 57.707 | 5.500 |
| 1.347 | 57.743 | 5.500 |
| 0.823 | 57.550 | 5.500 |
| 1.430 | 57.828 | 5.500 |
| 1.265 | 57.658 | 5.500 |
| 1.102 | 57.486 | 5.500 |
| 1.513 | 57.912 | 5.500 |
| 1.179 | 57.862 | 5.500 |
| 1.183 | 57.572 | 5.500 |
| 1.631 | 58.244 | 5.500 |
| 1.905 | 58.470 | 5.500 |
| 2.099 | 58.584 | 5.500 |
| 1.814 | 58.394 | 5.500 |
| 1.996 | 58.545 | 5.500 |
| 2.110 | 58.485 | 5.500 |
| 1.937 | 58.324 | 5.500 |
| 1.681 | 58.078 | 5.500 |
| 1.722 | 58.319 | 5.500 |
| 1.851 | 58.242 | 5.500 |
| 1.766 | 58.161 | 5.500 |
| 2.023 | 58.405 | 5.500 |
| 1.449 | 58.093 | 5.500 |
| 1.540 | 58.169 | 5.500 |
| −0.328 | 54.040 | 6.000 |
| −0.330 | 52.929 | 6.000 |
| −0.697 | 53.917 | 6.000 |
| −0.426 | 53.143 | 6.000 |
| −0.592 | 53.581 | 6.000 |
| −0.208 | 52.729 | 6.000 |
| −0.057 | 52.780 | 6.000 |
| −0.283 | 53.809 | 6.000 |
| −0.088 | 53.012 | 6.000 |
| −0.379 | 53.035 | 6.000 |
| −0.258 | 53.695 | 6.000 |
| −0.513 | 53.360 | 6.000 |
| −0.066 | 52.897 | 6.000 |
| −0.664 | 53.804 | 6.000 |
| −0.231 | 53.581 | 6.000 |
| −0.307 | 53.924 | 6.000 |
| −0.108 | 52.681 | 6.000 |
| −0.553 | 53.470 | 6.000 |
| −0.115 | 53.126 | 6.000 |
| −0.143 | 53.240 | 6.000 |
| −0.173 | 53.353 | 6.000 |
| −0.202 | 53.467 | 6.000 |
| −0.274 | 52.825 | 6.000 |

TABLE I-continued

| X | Y | Z |
|---|---|---|
| −0.629 | 53.692 | 6.000 |
| −0.727 | 54.030 | 6.000 |
| −0.470 | 53.251 | 6.000 |
| −0.835 | 54.725 | 6.000 |
| −0.828 | 54.607 | 6.000 |
| −0.362 | 54.272 | 6.000 |
| −0.384 | 54.740 | 6.000 |
| −0.378 | 54.857 | 6.000 |
| −0.385 | 54.623 | 6.000 |
| −0.815 | 54.491 | 6.000 |
| −0.381 | 54.505 | 6.000 |
| −0.837 | 54.842 | 6.000 |
| −0.799 | 54.375 | 6.000 |
| −0.778 | 54.259 | 6.000 |
| −0.374 | 54.338 | 6.000 |
| −0.754 | 54.144 | 6.000 |
| −0.347 | 54.155 | 6.000 |
| −0.690 | 55.645 | 6.000 |
| −0.328 | 55.205 | 6.000 |
| −0.230 | 55.543 | 6.000 |
| −0.268 | 55.432 | 6.000 |
| −0.366 | 54.974 | 6.000 |
| −0.300 | 55.319 | 6.000 |
| −0.810 | 55.192 | 6.000 |
| −0.834 | 54.959 | 6.000 |
| −0.825 | 55.076 | 6.000 |
| −0.350 | 55.090 | 6.000 |
| −0.729 | 55.534 | 6.000 |
| −0.789 | 55.308 | 6.000 |
| −0.762 | 55.422 | 6.000 |
| −0.188 | 55.652 | 6.000 |
| −0.646 | 55.754 | 6.000 |
| 0.022 | 56.071 | 6.000 |
| −0.420 | 56.164 | 6.000 |
| 0.213 | 56.367 | 6.000 |
| −0.483 | 56.065 | 6.000 |
| 0.147 | 56.270 | 6.000 |
| 0.281 | 56.462 | 6.000 |
| −0.542 | 55.964 | 6.000 |
| −0.212 | 56.448 | 6.000 |
| −0.285 | 56.356 | 6.000 |
| −0.141 | 55.760 | 6.000 |
| 0.083 | 56.172 | 6.000 |
| −0.036 | 55.969 | 6.000 |
| −0.090 | 55.865 | 6.000 |
| −0.354 | 56.261 | 6.000 |
| −0.137 | 56.538 | 6.000 |
| 0.351 | 56.556 | 6.000 |
| −0.596 | 55.860 | 6.000 |
| 0.519 | 57.208 | 6.000 |
| 0.881 | 57.184 | 6.000 |
| 0.348 | 57.047 | 6.000 |
| 0.423 | 56.649 | 6.000 |
| 0.571 | 56.831 | 6.000 |
| 0.960 | 57.270 | 6.000 |
| 0.605 | 57.288 | 6.000 |
| 0.019 | 56.714 | 6.000 |
| 0.497 | 56.741 | 6.000 |
| 1.040 | 57.356 | 6.000 |
| 0.264 | 56.966 | 6.000 |
| 0.099 | 56.799 | 6.000 |
| 0.647 | 56.921 | 6.000 |
| 0.433 | 57.128 | 6.000 |
| 0.724 | 57.009 | 6.000 |
| −0.060 | 56.627 | 6.000 |
| 0.802 | 57.097 | 6.000 |
| 0.692 | 57.367 | 6.000 |
| 0.181 | 56.883 | 6.000 |
| 1.531 | 57.860 | 6.000 |
| 1.220 | 57.832 | 6.000 |
| 1.121 | 57.441 | 6.000 |
| 1.043 | 57.678 | 6.000 |
| 1.283 | 57.610 | 6.000 |
| 1.698 | 58.025 | 6.000 |
| 1.399 | 57.983 | 6.000 |
| 0.779 | 57.445 | 6.000 |
| 0.867 | 57.523 | 6.000 |

TABLE I-continued

| X | Y | Z |
|---|---|---|
| 1.615 | 57.943 | 6.000 |
| 0.955 | 57.601 | 6.000 |
| 1.310 | 57.908 | 6.000 |
| 1.448 | 57.777 | 6.000 |
| 1.131 | 57.755 | 6.000 |
| 1.365 | 57.694 | 6.000 |
| 1.202 | 57.526 | 6.000 |
| 1.852 | 58.356 | 6.000 |
| 2.137 | 58.527 | 6.000 |
| 1.489 | 58.059 | 6.000 |
| 2.039 | 58.347 | 6.000 |
| 1.868 | 58.187 | 6.000 |
| 1.953 | 58.267 | 6.000 |
| 1.670 | 58.208 | 6.000 |
| 1.761 | 58.282 | 6.000 |
| 1.943 | 58.431 | 6.000 |
| 2.033 | 58.505 | 6.000 |
| 1.783 | 58.106 | 6.000 |
| 1.579 | 58.134 | 6.000 |
| 2.126 | 58.426 | 6.000 |
| −0.760 | 54.062 | 6.500 |
| −0.733 | 53.949 | 6.500 |
| −0.312 | 53.717 | 6.500 |
| −0.704 | 53.837 | 6.500 |
| −0.125 | 52.808 | 6.500 |
| −0.132 | 52.924 | 6.500 |
| −0.637 | 53.614 | 6.500 |
| −0.523 | 53.284 | 6.500 |
| −0.338 | 52.858 | 6.500 |
| −0.563 | 53.393 | 6.500 |
| −0.152 | 53.038 | 6.500 |
| −0.260 | 53.491 | 6.500 |
| −0.287 | 53.604 | 6.500 |
| −0.391 | 52.962 | 6.500 |
| −0.232 | 53.378 | 6.500 |
| −0.672 | 53.725 | 6.500 |
| −0.482 | 53.176 | 6.500 |
| −0.336 | 53.831 | 6.500 |
| −0.601 | 53.503 | 6.500 |
| −0.177 | 52.711 | 6.500 |
| −0.204 | 53.265 | 6.500 |
| −0.358 | 53.945 | 6.500 |
| −0.274 | 52.761 | 6.500 |
| −0.177 | 53.152 | 6.500 |
| −0.377 | 54.060 | 6.500 |
| −0.438 | 53.068 | 6.500 |
| −0.805 | 54.290 | 6.500 |
| −0.785 | 54.176 | 6.500 |
| −0.419 | 54.755 | 6.500 |
| −0.422 | 54.522 | 6.500 |
| −0.407 | 54.290 | 6.500 |
| −0.847 | 54.753 | 6.500 |
| −0.835 | 54.521 | 6.500 |
| −0.822 | 54.405 | 6.500 |
| −0.393 | 54.175 | 6.500 |
| −0.416 | 54.406 | 6.500 |
| −0.410 | 54.870 | 6.500 |
| −0.423 | 54.638 | 6.500 |
| −0.844 | 54.636 | 6.500 |
| −0.845 | 54.869 | 6.500 |
| −0.198 | 55.652 | 6.500 |
| −0.351 | 55.214 | 6.500 |
| −0.669 | 55.659 | 6.500 |
| −0.805 | 55.215 | 6.500 |
| −0.285 | 55.437 | 6.500 |
| −0.711 | 55.550 | 6.500 |
| −0.244 | 55.545 | 6.500 |
| −0.396 | 54.986 | 6.500 |
| −0.824 | 55.100 | 6.500 |
| −0.780 | 55.328 | 6.500 |
| −0.838 | 54.985 | 6.500 |
| −0.321 | 55.326 | 6.500 |
| −0.748 | 55.440 | 6.500 |
| −0.376 | 55.100 | 6.500 |
| −0.172 | 56.440 | 6.500 |
| −0.621 | 55.764 | 6.500 |
| −0.568 | 55.868 | 6.500 |

TABLE I-continued

| X | Y | Z |
|---|---|---|
| 0.023 | 56.061 | 6.500 |
| −0.038 | 55.962 | 6.500 |
| 0.290 | 56.441 | 6.500 |
| 0.220 | 56.348 | 6.500 |
| −0.245 | 56.350 | 6.500 |
| −0.149 | 55.757 | 6.500 |
| 0.152 | 56.254 | 6.500 |
| 0.086 | 56.158 | 6.500 |
| −0.096 | 56.528 | 6.500 |
| −0.450 | 56.068 | 6.500 |
| −0.095 | 55.860 | 6.500 |
| −0.316 | 56.259 | 6.500 |
| −0.511 | 55.969 | 6.500 |
| 0.362 | 56.532 | 6.500 |
| −0.385 | 56.164 | 6.500 |
| 0.586 | 56.800 | 6.500 |
| 0.143 | 56.733 | 6.500 |
| 0.899 | 57.144 | 6.500 |
| 0.663 | 56.887 | 6.500 |
| 0.735 | 57.341 | 6.500 |
| 0.978 | 57.228 | 6.500 |
| 0.392 | 57.027 | 6.500 |
| 1.140 | 57.396 | 6.500 |
| 0.225 | 56.865 | 6.500 |
| 0.062 | 56.700 | 6.500 |
| 0.510 | 56.712 | 6.500 |
| −0.018 | 56.615 | 6.500 |
| 0.562 | 57.185 | 6.500 |
| 0.436 | 56.622 | 6.500 |
| 0.819 | 57.059 | 6.500 |
| 0.741 | 56.973 | 6.500 |
| 0.648 | 57.263 | 6.500 |
| 0.308 | 56.946 | 6.500 |
| 0.477 | 57.106 | 6.500 |
| 1.059 | 57.312 | 6.500 |
| 1.302 | 57.562 | 6.500 |
| 0.908 | 57.495 | 6.500 |
| 1.632 | 57.889 | 6.500 |
| 1.384 | 57.644 | 6.500 |
| 1.084 | 57.648 | 6.500 |
| 1.438 | 57.949 | 6.500 |
| 1.349 | 57.875 | 6.500 |
| 0.821 | 57.418 | 6.500 |
| 1.527 | 58.023 | 6.500 |
| 1.221 | 57.479 | 6.500 |
| 1.467 | 57.726 | 6.500 |
| 1.260 | 57.800 | 6.500 |
| 1.172 | 57.724 | 6.500 |
| 1.549 | 57.808 | 6.500 |
| 1.716 | 57.970 | 6.500 |
| 0.996 | 57.572 | 6.500 |
| 1.617 | 58.097 | 6.500 |
| 1.898 | 53.317 | 6.500 |
| 1.884 | 58.130 | 6.500 |
| 2.055 | 58.289 | 6.500 |
| 1.979 | 58.390 | 6.500 |
| 2.170 | 58.466 | 6.500 |
| 2.069 | 58.463 | 6.500 |
| 1.969 | 58.210 | 6.500 |
| 1.707 | 58.171 | 6.500 |
| 1.798 | 58.244 | 6.500 |
| 2.141 | 58.367 | 6.500 |
| 1.800 | 58.051 | 6.500 |
| −0.319 | 53.517 | 7.000 |
| −0.220 | 53.067 | 7.000 |
| −0.367 | 53.742 | 7.000 |
| −0.455 | 52.996 | 7.000 |
| −0.409 | 53.969 | 7.000 |
| −0.344 | 53.629 | 7.000 |
| −0.249 | 52.743 | 7.000 |
| −0.243 | 53.180 | 7.000 |
| −0.579 | 53.318 | 7.000 |
| −0.405 | 52.892 | 7.000 |
| −0.616 | 53.427 | 7.000 |
| −0.744 | 53.870 | 7.000 |
| −0.268 | 53.292 | 7.000 |
| −0.540 | 53.210 | 7.000 |

TABLE I-continued

| X | Y | Z |
|---|---|---|
| −0.715 | 53.758 | 7.000 |
| −0.499 | 53.102 | 7.000 |
| −0.651 | 53.537 | 7.000 |
| −0.389 | 53.855 | 7.000 |
| −0.202 | 52.953 | 7.000 |
| −0.344 | 52.795 | 7.000 |
| −0.426 | 54.082 | 7.000 |
| −0.294 | 53.405 | 7.000 |
| −0.197 | 52.839 | 7.000 |
| −0.771 | 53.982 | 7.000 |
| −0.684 | 53.647 | 7.000 |
| −0.440 | 54.197 | 7.000 |
| −0.815 | 54.208 | 7.000 |
| −0.440 | 54.886 | 7.000 |
| −0.451 | 54.311 | 7.000 |
| −0.452 | 54.771 | 7.000 |
| −0.459 | 54.656 | 7.000 |
| −0.852 | 54.896 | 7.000 |
| −0.461 | 54.541 | 7.000 |
| −0.832 | 54.322 | 7.000 |
| −0.458 | 54.426 | 7.000 |
| −0.854 | 54.551 | 7.000 |
| −0.845 | 54.436 | 7.000 |
| −0.794 | 54.094 | 7.000 |
| −0.858 | 54.781 | 7.000 |
| −0.859 | 54.666 | 7.000 |
| −0.372 | 55.224 | 7.000 |
| −0.799 | 55.237 | 7.000 |
| −0.646 | 55.671 | 7.000 |
| −0.423 | 55.000 | 7.000 |
| −0.734 | 55.458 | 7.000 |
| −0.255 | 55.549 | 7.000 |
| −0.840 | 55.010 | 7.000 |
| −0.693 | 55.565 | 7.000 |
| −0.769 | 55.348 | 7.000 |
| −0.400 | 55.113 | 7.000 |
| −0.207 | 55.654 | 7.000 |
| −0.299 | 55.443 | 7.000 |
| −0.822 | 55.124 | 7.000 |
| −0.338 | 55.334 | 7.000 |
| −0.279 | 56.254 | 7.000 |
| −0.349 | 56.163 | 7.000 |
| 0.229 | 56.330 | 7.000 |
| −0.098 | 55.856 | 7.000 |
| −0.038 | 55.955 | 7.000 |
| −0.206 | 56.343 | 7.000 |
| −0.416 | 56.069 | 7.000 |
| −0.595 | 55.774 | 7.000 |
| 0.375 | 56.508 | 7.000 |
| −0.539 | 55.875 | 7.000 |
| −0.480 | 55.973 | 7.000 |
| 0.159 | 56.238 | 7.000 |
| −0.154 | 55.756 | 7.000 |
| 0.025 | 56.051 | 7.000 |
| 0.091 | 56.145 | 7.000 |
| −0.132 | 56.431 | 7.000 |
| −0.055 | 56.517 | 7.000 |
| 0.301 | 56.420 | 7.000 |
| 0.267 | 56.846 | 7.000 |
| 0.759 | 56.937 | 7.000 |
| 0.104 | 56.684 | 7.000 |
| 0.690 | 57.237 | 7.000 |
| 0.024 | 56.601 | 7.000 |
| 1.078 | 57.269 | 7.000 |
| 0.604 | 57.160 | 7.000 |
| 0.838 | 57.021 | 7.000 |
| 0.998 | 57.186 | 7.000 |
| 1.159 | 57.351 | 7.000 |
| 0.776 | 57.314 | 7.000 |
| 0.525 | 56.682 | 7.000 |
| 0.350 | 56.926 | 7.000 |
| 0.862 | 57.390 | 7.000 |
| 0.602 | 56.768 | 7.000 |
| 0.449 | 56.596 | 7.000 |
| 0.519 | 57.083 | 7.000 |
| 0.918 | 57.104 | 7.000 |
| 0.185 | 56.765 | 7.000 |

TABLE I-continued

| X | Y | Z |
|---|---|---|
| 0.680 | 56.853 | 7.000 |
| 0.434 | 57.004 | 7.000 |
| 1.734 | 57.916 | 7.000 |
| 0.949 | 57.466 | 7.000 |
| 1.322 | 57.514 | 7.000 |
| 1.818 | 57.995 | 7.000 |
| 1.387 | 57.840 | 7.000 |
| 1.486 | 57.675 | 7.000 |
| 1.036 | 57.541 | 7.000 |
| 1.564 | 57.986 | 7.000 |
| 1.404 | 57.595 | 7.000 |
| 1.475 | 57.913 | 7.000 |
| 1.210 | 57.691 | 7.000 |
| 1.298 | 57.766 | 7.000 |
| 1.123 | 57.616 | 7.000 |
| 1.241 | 57.432 | 7.000 |
| 1.568 | 57.756 | 7.000 |
| 1.651 | 57.836 | 7.000 |
| 2.200 | 58.403 | 7.000 |
| 2.013 | 58.347 | 7.000 |
| 1.743 | 58.131 | 7.000 |
| 1.986 | 58.152 | 7.000 |
| 1.654 | 58.059 | 7.000 |
| 1.923 | 58.275 | 7.000 |
| 2.103 | 58.419 | 7.000 |
| 1.833 | 58.203 | 7.000 |
| 1.902 | 58.074 | 7.000 |
| 2.071 | 58.230 | 7.000 |
| 2.157 | 58.307 | 7.000 |
| −0.442 | 53.881 | 7.500 |
| −0.635 | 53.354 | 7.500 |
| −0.669 | 53.463 | 7.500 |
| −0.356 | 53.433 | 7.500 |
| −0.273 | 52.985 | 7.500 |
| −0.759 | 53.793 | 7.500 |
| −0.310 | 53.210 | 7.500 |
| −0.270 | 52.871 | 7.500 |
| −0.520 | 53.032 | 7.500 |
| −0.807 | 54.016 | 7.500 |
| −0.422 | 53.769 | 7.500 |
| −0.701 | 53.572 | 7.500 |
| −0.474 | 52.928 | 7.500 |
| −0.784 | 53.904 | 7.500 |
| −0.401 | 53.657 | 7.500 |
| −0.416 | 52.830 | 7.500 |
| −0.731 | 53.682 | 7.500 |
| −0.459 | 53.994 | 7.500 |
| −0.323 | 52.777 | 7.500 |
| −0.599 | 53.246 | 7.500 |
| −0.561 | 53.138 | 7.500 |
| −0.289 | 53.098 | 7.500 |
| −0.333 | 53.322 | 7.500 |
| −0.379 | 53.545 | 7.500 |
| −0.858 | 54.354 | 7.500 |
| −0.867 | 54.809 | 7.500 |
| −0.492 | 54.676 | 7.500 |
| −0.867 | 54.468 | 7.500 |
| −0.473 | 54.107 | 7.500 |
| −0.482 | 54.790 | 7.500 |
| −0.828 | 54.128 | 7.500 |
| −0.492 | 54.334 | 7.500 |
| −0.496 | 54.448 | 7.500 |
| −0.872 | 54.581 | 7.500 |
| −0.496 | 54.562 | 7.500 |
| −0.844 | 54.241 | 7.500 |
| −0.872 | 54.695 | 7.500 |
| −0.484 | 54.220 | 7.500 |
| −0.466 | 54.903 | 7.500 |
| −0.818 | 55.148 | 7.500 |
| −0.840 | 55.036 | 7.500 |
| −0.388 | 55.235 | 7.500 |
| −0.716 | 55.474 | 7.500 |
| −0.211 | 55.655 | 7.500 |
| −0.446 | 55.015 | 7.500 |
| −0.790 | 55.258 | 7.500 |
| −0.756 | 55.367 | 7.500 |
| −0.309 | 55.449 | 7.500 |

TABLE I-continued

| X | Y | Z |
|---|---|---|
| −0.420 | 55.126 | 7.500 |
| −0.351 | 55.343 | 7.500 |
| −0.672 | 55.579 | 7.500 |
| −0.622 | 55.682 | 7.500 |
| −0.262 | 55.553 | 7.500 |
| −0.856 | 54.923 | 7.500 |
| −0.156 | 55.755 | 7.500 |
| −0.097 | 55.852 | 7.500 |
| −0.313 | 56.159 | 7.500 |
| 0.169 | 56.223 | 7.500 |
| 0.388 | 56.485 | 7.500 |
| 0.240 | 56.312 | 7.500 |
| −0.167 | 56.335 | 7.500 |
| −0.014 | 56.504 | 7.500 |
| 0.464 | 56.570 | 7.500 |
| 0.314 | 56.399 | 7.500 |
| 0.031 | 56.041 | 7.500 |
| −0.034 | 55.948 | 7.500 |
| −0.241 | 56.248 | 7.500 |
| −0.091 | 56.420 | 7.500 |
| −0.568 | 55.782 | 7.500 |
| 0.099 | 56.133 | 7.500 |
| −0.447 | 55.975 | 7.500 |
| −0.381 | 56.068 | 7.500 |
| −0.509 | 55.880 | 7.500 |
| 0.816 | 57.285 | 7.500 |
| 0.857 | 56.983 | 7.500 |
| 0.309 | 56.826 | 7.500 |
| 0.560 | 57.058 | 7.500 |
| 0.902 | 57.360 | 7.500 |
| 0.065 | 56.586 | 7.500 |
| 1.180 | 57.306 | 7.500 |
| 1.261 | 57.386 | 7.500 |
| 0.227 | 56.747 | 7.500 |
| 0.392 | 56.904 | 7.500 |
| 0.698 | 56.820 | 7.500 |
| 0.146 | 56.667 | 7.500 |
| 0.476 | 56.981 | 7.500 |
| 0.731 | 57.210 | 7.500 |
| 0.777 | 56.902 | 7.500 |
| 1.098 | 57.226 | 7.500 |
| 0.541 | 56.654 | 7.500 |
| 0.937 | 57.064 | 7.500 |
| 0.619 | 56.737 | 7.500 |
| 0.645 | 57.134 | 7.500 |
| 1.018 | 57.145 | 7.500 |
| 1.506 | 57.624 | 7.500 |
| 1.423 | 57.803 | 7.500 |
| 1.424 | 57.545 | 7.500 |
| 1.161 | 57.583 | 7.500 |
| 1.342 | 57.466 | 7.500 |
| 1.689 | 58.018 | 7.500 |
| 1.336 | 57.730 | 7.500 |
| 1.074 | 57.509 | 7.500 |
| 1.512 | 57.875 | 7.500 |
| 1.588 | 57.703 | 7.500 |
| 1.670 | 57.782 | 7.500 |
| 1.920 | 58.016 | 7.500 |
| 1.600 | 57.947 | 7.500 |
| 1.753 | 57.861 | 7.500 |
| 1.836 | 57.939 | 7.500 |
| 0.988 | 57.435 | 7.500 |
| 1.248 | 57.657 | 7.500 |
| 1.778 | 58.089 | 7.500 |
| 2.173 | 55.246 | 7.500 |
| 2.004 | 58.094 | 7.500 |
| 1.868 | 58.160 | 7.500 |
| 2.136 | 58.372 | 7.500 |
| 2.047 | 58.301 | 7.500 |
| 2.227 | 58.338 | 7.500 |
| 2.088 | 58.170 | 7.500 |
| 1.957 | 58.231 | 7.500 |
| −0.721 | 53.500 | 8.000 |
| −0.777 | 53.719 | 8.000 |
| −0.691 | 53.392 | 8.000 |
| −0.750 | 53.609 | 8.000 |
| −0.801 | 53.829 | 8.000 |

TABLE I-continued

| X | Y | Z |
|---|---|---|
| −0.543 | 52.965 | 8.000 |
| −0.397 | 53.352 | 8.000 |
| −0.377 | 53.241 | 8.000 |
| −0.843 | 54.051 | 8.000 |
| −0.358 | 53.130 | 8.000 |
| −0.624 | 53.176 | 8.000 |
| −0.418 | 53.463 | 8.000 |
| −0.488 | 52.867 | 8.000 |
| −0.492 | 53.908 | 8.000 |
| −0.586 | 53.070 | 8.000 |
| −0.658 | 53.284 | 8.000 |
| −0.507 | 54.020 | 8.000 |
| −0.823 | 53.940 | 8.000 |
| −0.344 | 52.905 | 8.000 |
| −0.397 | 52.813 | 8.000 |
| −0.345 | 53.018 | 8.000 |
| −0.476 | 53.797 | 8.000 |
| −0.438 | 53.574 | 8.000 |
| −0.458 | 53.685 | 8.000 |
| −0.531 | 54.471 | 8.000 |
| −0.872 | 54.275 | 8.000 |
| −0.886 | 54.500 | 8.000 |
| −0.530 | 54.358 | 8.000 |
| −0.882 | 54.726 | 8.000 |
| −0.526 | 54.245 | 8.000 |
| −0.519 | 54.696 | 8.000 |
| −0.859 | 54.163 | 8.000 |
| −0.887 | 54.613 | 8.000 |
| −0.881 | 54.387 | 8.000 |
| −0.872 | 54.838 | 8.000 |
| −0.528 | 54.584 | 8.000 |
| −0.518 | 54.133 | 8.000 |
| −0.506 | 54.808 | 8.000 |
| −0.596 | 55.691 | 8.000 |
| −0.314 | 55.455 | 8.000 |
| −0.740 | 55.385 | 8.000 |
| −0.210 | 55.655 | 8.000 |
| −0.264 | 55.556 | 8.000 |
| −0.434 | 55.139 | 8.000 |
| −0.777 | 55.279 | 8.000 |
| −0.696 | 55.489 | 8.000 |
| −0.359 | 55.352 | 8.000 |
| −0.648 | 55.591 | 8.000 |
| −0.399 | 55.246 | 8.000 |
| −0.857 | 54.950 | 8.000 |
| −0.463 | 55.030 | 8.000 |
| −0.487 | 54.920 | 8.000 |
| −0.836 | 55.061 | 8.000 |
| −0.810 | 55.170 | 8.000 |
| −0.152 | 55.752 | 8.000 |
| 0.481 | 56.544 | 8.000 |
| −0.478 | 55.883 | 8.000 |
| −0.413 | 55.976 | 8.000 |
| −0.027 | 55.940 | 8.000 |
| −0.091 | 55.847 | 8.000 |
| −0.051 | 56.408 | 8.000 |
| 0.107 | 56.570 | 8.000 |
| 0.027 | 56.490 | 8.000 |
| −0.275 | 56.155 | 8.000 |
| 0.254 | 56.293 | 8.000 |
| 0.181 | 56.207 | 8.000 |
| −0.346 | 56.066 | 8.000 |
| 0.328 | 56.378 | 8.000 |
| −0.203 | 56.241 | 8.000 |
| −0.128 | 56.325 | 8.000 |
| 0.109 | 56.120 | 8.000 |
| −0.538 | 55.788 | 8.000 |
| 0.040 | 56.031 | 8.000 |
| 0.404 | 56.462 | 8.000 |
| 0.351 | 56.804 | 8.000 |
| 0.876 | 56.947 | 8.000 |
| 0.796 | 56.868 | 8.000 |
| 0.716 | 56.788 | 8.000 |
| 0.187 | 56.649 | 8.000 |
| 1.037 | 57.105 | 8.000 |
| 0.601 | 57.032 | 8.000 |
| 0.517 | 56.957 | 8.000 |

TABLE I-continued

| X | Y | Z |
|---|---|---|
| 0.771 | 57.181 | 8.000 |
| 0.558 | 56.626 | 8.000 |
| 0.686 | 57.107 | 8.000 |
| 1.281 | 57.340 | 8.000 |
| 0.268 | 56.727 | 8.000 |
| 1.118 | 57.184 | 8.000 |
| 0.637 | 56.707 | 8.000 |
| 1.199 | 57.262 | 8.000 |
| 1.027 | 57.402 | 8.000 |
| 0.856 | 57.255 | 8.000 |
| 0.941 | 57.329 | 8.000 |
| 0.434 | 56.881 | 8.000 |
| 0.957 | 57.026 | 8.000 |
| 1.724 | 57.976 | 8.000 |
| 1.855 | 57.883 | 8.000 |
| 1.607 | 57.652 | 8.000 |
| 1.938 | 57.959 | 8.000 |
| 1.635 | 57.906 | 8.000 |
| 1.286 | 57.621 | 8.000 |
| 1.362 | 57.419 | 8.000 |
| 1.525 | 57.574 | 8.000 |
| 1.113 | 57.476 | 8.000 |
| 1.460 | 57.764 | 8.000 |
| 1.372 | 57.693 | 8.000 |
| 1.444 | 57.497 | 8.000 |
| 1.690 | 57.729 | 8.000 |
| 1.772 | 57.806 | 8.000 |
| 1.199 | 57.548 | 8.000 |
| 1.548 | 57.835 | 8.000 |
| 1.901 | 58.116 | 8.000 |
| 2.079 | 58.255 | 8.000 |
| 2.021 | 58.035 | 8.000 |
| 2.105 | 58.111 | 8.000 |
| 2.252 | 58.273 | 8.000 |
| 2.190 | 58.185 | 8.000 |
| 1.813 | 58.046 | 8.000 |
| 1.990 | 58.185 | 8.000 |
| 2.169 | 58.322 | 8.000 |
| −0.718 | 53.323 | 8.500 |
| −0.444 | 53.274 | 8.500 |
| −0.497 | 53.605 | 8.500 |
| −0.861 | 53.977 | 8.500 |
| −0.473 | 52.851 | 8.500 |
| −0.747 | 53.431 | 8.500 |
| −0.529 | 53.826 | 8.500 |
| −0.686 | 53.216 | 8.500 |
| −0.428 | 53.164 | 8.500 |
| −0.652 | 53.110 | 8.500 |
| −0.542 | 53.937 | 8.500 |
| −0.417 | 53.053 | 8.500 |
| −0.561 | 52.906 | 8.500 |
| −0.843 | 53.867 | 8.500 |
| −0.553 | 54.048 | 8.500 |
| −0.480 | 53.495 | 8.500 |
| −0.799 | 53.648 | 8.500 |
| −0.774 | 53.539 | 8.500 |
| −0.462 | 53.385 | 8.500 |
| −0.822 | 53.757 | 8.500 |
| −0.419 | 52.941 | 8.500 |
| −0.612 | 53.005 | 8.500 |
| −0.514 | 53.715 | 8.500 |
| −0.877 | 54.088 | 8.500 |
| −0.876 | 54.867 | 8.500 |
| −0.566 | 54.383 | 8.500 |
| −0.903 | 54.422 | 8.500 |
| −0.889 | 54.199 | 8.500 |
| −0.556 | 54.606 | 8.500 |
| −0.544 | 54.717 | 8.500 |
| −0.890 | 54.756 | 8.500 |
| −0.903 | 54.533 | 8.500 |
| −0.899 | 54.645 | 8.500 |
| −0.898 | 54.310 | 8.500 |
| −0.527 | 54.827 | 8.500 |
| −0.563 | 54.494 | 8.500 |
| −0.561 | 54.159 | 8.500 |
| −0.565 | 54.271 | 8.500 |
| −0.476 | 55.044 | 8.500 |

TABLE I-continued

| X | Y | Z |
|---|---|---|
| −0.623 | 55.602 | 8.500 |
| −0.262 | 55.559 | 8.500 |
| −0.314 | 55.460 | 8.500 |
| −0.799 | 55.193 | 8.500 |
| −0.567 | 55.699 | 8.500 |
| −0.721 | 55.402 | 8.500 |
| −0.504 | 54.936 | 8.500 |
| −0.206 | 55.655 | 8.500 |
| −0.405 | 55.256 | 8.500 |
| −0.856 | 54.977 | 8.500 |
| −0.362 | 55.359 | 8.500 |
| −0.443 | 55.151 | 8.500 |
| −0.674 | 55.503 | 8.500 |
| −0.763 | 55.298 | 8.500 |
| −0.830 | 55.085 | 8.500 |
| −0.017 | 55.932 | 8.500 |
| −0.378 | 55.975 | 8.500 |
| 0.068 | 56.475 | 8.500 |
| 0.344 | 56.358 | 8.500 |
| −0.238 | 56.149 | 8.500 |
| −0.164 | 56.233 | 8.500 |
| 0.147 | 56.553 | 8.500 |
| −0.146 | 55.749 | 8.500 |
| 0.498 | 56.519 | 8.500 |
| −0.088 | 56.315 | 8.500 |
| 0.051 | 56.020 | 8.500 |
| 0.268 | 56.275 | 8.500 |
| −0.083 | 55.842 | 8.500 |
| −0.444 | 55.885 | 8.500 |
| 0.420 | 56.439 | 8.500 |
| 0.122 | 56.106 | 8.500 |
| 0.194 | 56.191 | 8.500 |
| −0.011 | 56.395 | 8.500 |
| −0.508 | 55.793 | 8.500 |
| −0.309 | 56.063 | 8.500 |
| 0.576 | 56.599 | 8.500 |
| 0.392 | 56.782 | 8.500 |
| 0.309 | 56.707 | 8.500 |
| 0.895 | 56.912 | 8.500 |
| 0.734 | 56.756 | 8.500 |
| 1.381 | 57.372 | 8.500 |
| 0.895 | 57.224 | 8.500 |
| 0.814 | 56.834 | 8.500 |
| 0.642 | 57.005 | 8.500 |
| 0.474 | 56.857 | 8.500 |
| 1.065 | 57.369 | 8.500 |
| 0.558 | 56.931 | 8.500 |
| 0.655 | 56.678 | 8.500 |
| 0.975 | 56.989 | 8.500 |
| 0.810 | 57.151 | 8.500 |
| 0.228 | 56.630 | 8.500 |
| 1.056 | 57.066 | 8.500 |
| 1.219 | 57.219 | 8.500 |
| 1.300 | 57.296 | 8.500 |
| 0.726 | 57.078 | 8.500 |
| 0.980 | 57.297 | 8.500 |
| 1.137 | 57.143 | 8.500 |
| 1.322 | 57.584 | 8.500 |
| 2.039 | 57.977 | 8.500 |
| 1.790 | 57.752 | 8.500 |
| 1.463 | 57.449 | 8.500 |
| 1.236 | 57.512 | 8.500 |
| 1.873 | 57.827 | 8.500 |
| 1.495 | 57.725 | 8.500 |
| 1.956 | 57.902 | 8.500 |
| 1.670 | 57.864 | 8.500 |
| 1.582 | 57.794 | 8.500 |
| 1.846 | 58.001 | 8.500 |
| 1.626 | 57.601 | 8.500 |
| 1.544 | 57.525 | 8.500 |
| 1.151 | 57.441 | 8.500 |
| 1.409 | 57.654 | 8.500 |
| 1.708 | 57.676 | 8.500 |
| 1.758 | 57.933 | 8.500 |
| 1.934 | 58.070 | 8.500 |
| 2.206 | 58.124 | 8.500 |
| 2.111 | 58.206 | 8.500 |

TABLE I-continued

| X | Y | Z |
|---|---|---|
| 2.122 | 58.051 | 8.500 |
| 2.022 | 58.138 | 8.500 |
| 2.202 | 58.270 | 8.500 |
| 2.275 | 58.208 | 8.500 |
| −0.591 | 53.966 | 9.000 |
| −0.598 | 54.077 | 9.000 |
| −0.848 | 53.688 | 9.000 |
| −0.884 | 53.906 | 9.000 |
| −0.581 | 53.856 | 9.000 |
| −0.527 | 53.418 | 9.000 |
| −0.542 | 53.527 | 9.000 |
| −0.826 | 53.580 | 9.000 |
| −0.683 | 53.047 | 9.000 |
| −0.899 | 54.016 | 9.000 |
| −0.777 | 53.365 | 9.000 |
| −0.569 | 53.747 | 9.000 |
| −0.512 | 53.309 | 9.000 |
| −0.867 | 53.797 | 9.000 |
| −0.550 | 52.890 | 9.000 |
| −0.556 | 53.637 | 9.000 |
| −0.803 | 53.472 | 9.000 |
| −0.749 | 53.258 | 9.000 |
| −0.495 | 52.978 | 9.000 |
| −0.635 | 52.948 | 9.000 |
| −0.499 | 53.199 | 9.000 |
| −0.491 | 53.089 | 9.000 |
| −0.719 | 53.152 | 9.000 |
| −0.919 | 54.567 | 9.000 |
| −0.910 | 54.677 | 9.000 |
| −0.600 | 54.408 | 9.000 |
| −0.896 | 54.786 | 9.000 |
| −0.918 | 54.236 | 9.000 |
| −0.593 | 54.518 | 9.000 |
| −0.565 | 54.737 | 9.000 |
| −0.603 | 54.297 | 9.000 |
| −0.923 | 54.346 | 9.000 |
| −0.923 | 54.456 | 9.000 |
| −0.602 | 54.187 | 9.000 |
| −0.877 | 54.895 | 9.000 |
| −0.910 | 54.125 | 9.000 |
| −0.544 | 54.846 | 9.000 |
| −0.582 | 54.628 | 9.000 |
| −0.701 | 55.417 | 9.000 |
| −0.651 | 55.515 | 9.000 |
| −0.538 | 55.705 | 9.000 |
| −0.257 | 55.560 | 9.000 |
| −0.853 | 55.003 | 9.000 |
| −0.596 | 55.611 | 9.000 |
| −0.822 | 55.109 | 9.000 |
| −0.312 | 55.464 | 9.000 |
| −0.746 | 55.316 | 9.000 |
| −0.450 | 55.163 | 9.000 |
| −0.409 | 55.265 | 9.000 |
| −0.363 | 55.366 | 9.000 |
| −0.199 | 55.654 | 9.000 |
| −0.518 | 54.953 | 9.000 |
| −0.787 | 55.214 | 9.000 |
| −0.487 | 55.059 | 9.000 |
| 0.284 | 56.256 | 9.000 |
| −0.476 | 55.797 | 9.000 |
| 0.209 | 56.175 | 9.000 |
| −0.200 | 56.141 | 9.000 |
| 0.064 | 56.008 | 9.000 |
| 0.593 | 56.571 | 9.000 |
| 0.187 | 56.535 | 9.000 |
| −0.137 | 55.745 | 9.000 |
| 0.029 | 56.381 | 9.000 |
| −0.049 | 56.303 | 9.000 |
| −0.073 | 55.835 | 9.000 |
| 0.515 | 56.494 | 9.000 |
| 0.107 | 56.459 | 9.000 |
| 0.136 | 56.092 | 9.000 |
| 0.437 | 56.416 | 9.000 |
| −0.343 | 55.973 | 9.000 |
| −0.005 | 55.922 | 9.000 |
| −0.273 | 56.058 | 9.000 |
| 0.360 | 56.336 | 9.000 |

TABLE I-continued

| X | Y | Z |
|---|---|---|
| −0.411 | 55.886 | 9.000 |
| −0.125 | 56.223 | 9.000 |
| 1.318 | 57.251 | 9.000 |
| 0.431 | 56.759 | 9.000 |
| 1.017 | 57.263 | 9.000 |
| 0.681 | 56.977 | 9.000 |
| 1.187 | 57.405 | 9.000 |
| 0.349 | 56.685 | 9.000 |
| 0.994 | 56.952 | 9.000 |
| 1.400 | 57.326 | 9.000 |
| 0.913 | 56.876 | 9.000 |
| 0.832 | 56.801 | 9.000 |
| 1.481 | 57.401 | 9.000 |
| 0.764 | 57.049 | 9.000 |
| 0.933 | 57.192 | 9.000 |
| 1.102 | 57.334 | 9.000 |
| 1.156 | 57.102 | 9.000 |
| 0.514 | 56.832 | 9.000 |
| 0.752 | 56.725 | 9.000 |
| 1.075 | 57.027 | 9.000 |
| 0.268 | 56.610 | 9.000 |
| 0.597 | 56.905 | 9.000 |
| 0.849 | 57.121 | 9.000 |
| 0.672 | 56.648 | 9.000 |
| 1.237 | 57.177 | 9.000 |
| 1.808 | 57.698 | 9.000 |
| 1.973 | 57.845 | 9.000 |
| 1.790 | 57.888 | 9.000 |
| 1.563 | 57.475 | 9.000 |
| 1.878 | 57.956 | 9.000 |
| 1.644 | 57.550 | 9.000 |
| 1.703 | 57.820 | 9.000 |
| 1.530 | 57.684 | 9.000 |
| 1.358 | 57.545 | 9.000 |
| 1.965 | 58.023 | 9.000 |
| 1.890 | 57.771 | 9.000 |
| 1.616 | 57.752 | 9.000 |
| 2.139 | 57.991 | 9.000 |
| 1.272 | 57.475 | 9.000 |
| 2.056 | 57.918 | 9.000 |
| 1.443 | 57.614 | 9.000 |
| 1.726 | 57.624 | 9.000 |
| 2.233 | 58.215 | 9.000 |
| 2.053 | 58.090 | 9.000 |
| 2.296 | 58.143 | 9.000 |
| 2.141 | 58.157 | 9.000 |
| 2.222 | 58.063 | 9.000 |
| −0.615 | 53.670 | 9.500 |
| −0.565 | 53.126 | 9.500 |
| −0.633 | 53.888 | 9.500 |
| −0.813 | 53.301 | 9.500 |
| −0.592 | 53.453 | 9.500 |
| −0.897 | 53.729 | 9.500 |
| −0.625 | 53.779 | 9.500 |
| −0.639 | 53.997 | 9.500 |
| −0.580 | 53.344 | 9.500 |
| −0.603 | 53.561 | 9.500 |
| −0.786 | 53.195 | 9.500 |
| −0.925 | 53.946 | 9.500 |
| −0.710 | 52.990 | 9.500 |
| −0.936 | 54.055 | 9.500 |
| −0.571 | 53.235 | 9.500 |
| −0.859 | 53.514 | 9.500 |
| −0.753 | 53.091 | 9.500 |
| −0.627 | 52.931 | 9.500 |
| −0.912 | 53.837 | 9.500 |
| −0.837 | 53.407 | 9.500 |
| −0.572 | 53.017 | 9.500 |
| −0.879 | 53.622 | 9.500 |
| −0.947 | 54.273 | 9.500 |
| −0.606 | 54.650 | 9.500 |
| −0.943 | 54.491 | 9.500 |
| −0.947 | 54.382 | 9.500 |
| −0.585 | 54.757 | 9.500 |
| −0.943 | 54.164 | 9.500 |
| −0.632 | 54.433 | 9.500 |
| −0.920 | 54.708 | 9.500 |

TABLE I-continued

| X | Y | Z |
|---|---|---|
| −0.621 | 54.542 | 9.500 |
| −0.642 | 54.215 | 9.500 |
| −0.934 | 54.600 | 9.500 |
| −0.639 | 54.324 | 9.500 |
| −0.642 | 54.106 | 9.500 |
| −0.560 | 54.864 | 9.500 |
| −0.901 | 54.816 | 9.500 |
| −0.191 | 55.651 | 9.500 |
| −0.774 | 55.233 | 9.500 |
| −0.455 | 55.174 | 9.500 |
| −0.627 | 55.526 | 9.500 |
| −0.411 | 55.274 | 9.500 |
| −0.813 | 55.131 | 9.500 |
| −0.680 | 55.430 | 9.500 |
| −0.530 | 54.969 | 9.500 |
| −0.252 | 55.560 | 9.500 |
| −0.848 | 55.028 | 9.500 |
| −0.362 | 55.371 | 9.500 |
| −0.877 | 54.922 | 9.500 |
| −0.495 | 55.072 | 9.500 |
| −0.309 | 55.467 | 9.500 |
| −0.570 | 55.619 | 9.500 |
| −0.729 | 55.333 | 9.500 |
| −0.509 | 55.709 | 9.500 |
| −0.164 | 56.132 | 9.500 |
| 0.453 | 56.392 | 9.500 |
| 0.531 | 56.468 | 9.500 |
| 0.610 | 56.544 | 9.500 |
| −0.012 | 56.289 | 9.500 |
| 0.145 | 56.441 | 9.500 |
| −0.088 | 56.211 | 9.500 |
| 0.150 | 56.077 | 9.500 |
| −0.445 | 55.798 | 9.500 |
| −0.237 | 56.051 | 9.500 |
| −0.309 | 55.969 | 9.500 |
| 0.224 | 56.157 | 9.500 |
| 0.007 | 55.912 | 9.500 |
| −0.128 | 55.740 | 9.500 |
| −0.378 | 55.884 | 9.500 |
| 0.066 | 56.366 | 9.500 |
| −0.062 | 55.827 | 9.500 |
| 0.375 | 56.315 | 9.500 |
| 0.077 | 55.995 | 9.500 |
| 0.299 | 56.236 | 9.500 |
| 0.225 | 56.516 | 9.500 |
| 0.968 | 57.159 | 9.500 |
| 0.801 | 57.019 | 9.500 |
| 0.337 | 56.662 | 9.500 |
| 1.416 | 57.280 | 9.500 |
| 1.052 | 57.229 | 9.500 |
| 0.306 | 56.589 | 9.500 |
| 0.930 | 56.841 | 9.500 |
| 1.092 | 56.988 | 9.500 |
| 0.689 | 56.619 | 9.500 |
| 0.769 | 56.693 | 9.500 |
| 1.011 | 56.914 | 9.500 |
| 1.335 | 57.207 | 9.500 |
| 1.221 | 57.367 | 9.500 |
| 0.884 | 57.089 | 9.500 |
| 1.498 | 57.353 | 9.500 |
| 0.551 | 56.806 | 9.500 |
| 0.634 | 56.877 | 9.500 |
| 0.849 | 56.767 | 9.500 |
| 0.469 | 56.734 | 9.500 |
| 0.717 | 56.948 | 9.500 |
| 1.173 | 57.061 | 9.500 |
| 1.137 | 57.298 | 9.500 |
| 1.254 | 57.134 | 9.500 |
| 1.824 | 57.643 | 9.500 |
| 1.994 | 57.975 | 9.500 |
| 1.988 | 57.787 | 9.500 |
| 1.907 | 57.909 | 9.500 |
| 1.906 | 57.716 | 9.500 |
| 1.742 | 57.571 | 9.500 |
| 1.579 | 57.426 | 9.500 |
| 2.071 | 57.859 | 9.500 |
| 2.236 | 58.001 | 9.500 |

TABLE I-continued

| X | Y | Z |
|---|---|---|
| 2.153 | 57.931 | 9.500 |
| 1.561 | 57.641 | 9.500 |
| 1.820 | 57.843 | 9.500 |
| 1.647 | 57.709 | 9.500 |
| 1.733 | 57.776 | 9.500 |
| 1.391 | 57.505 | 9.500 |
| 1.661 | 57.498 | 9.500 |
| 1.476 | 57.573 | 9.500 |
| 1.306 | 57.436 | 9.500 |
| 2.313 | 58.078 | 9.500 |
| 2.081 | 58.041 | 9.500 |
| 2.262 | 58.157 | 9.500 |
| 2.168 | 58.106 | 9.500 |
| −0.783 | 53.035 | 10.000 |
| −0.647 | 53.058 | 10.000 |
| −0.823 | 53.136 | 10.000 |
| −0.638 | 53.166 | 10.000 |
| −0.664 | 53.597 | 10.000 |
| −0.974 | 54.202 | 10.000 |
| −0.851 | 53.240 | 10.000 |
| −0.704 | 52.974 | 10.000 |
| −0.648 | 53.381 | 10.000 |
| −0.955 | 53.879 | 10.000 |
| −0.930 | 53.664 | 10.000 |
| −0.672 | 53.704 | 10.000 |
| −0.678 | 53.812 | 10.000 |
| −0.913 | 53.558 | 10.000 |
| −0.674 | 54.352 | 10.000 |
| −0.685 | 54.136 | 10.000 |
| −0.641 | 53.274 | 10.000 |
| −0.895 | 53.451 | 10.000 |
| −0.944 | 53.771 | 10.000 |
| −0.681 | 54.244 | 10.000 |
| −0.971 | 54.094 | 10.000 |
| −0.875 | 53.345 | 10.000 |
| −0.965 | 53.986 | 10.000 |
| −0.683 | 53.920 | 10.000 |
| −0.656 | 53.489 | 10.000 |
| −0.973 | 54.310 | 10.000 |
| −0.685 | 54.028 | 10.000 |
| −0.876 | 54.949 | 10.000 |
| −0.662 | 54.459 | 10.000 |
| −0.647 | 54.566 | 10.000 |
| −0.575 | 54.881 | 10.000 |
| −0.969 | 54.418 | 10.000 |
| −0.928 | 54.739 | 10.000 |
| −0.905 | 54.844 | 10.000 |
| −0.604 | 54.777 | 10.000 |
| −0.628 | 54.672 | 10.000 |
| −0.960 | 54.525 | 10.000 |
| −0.541 | 54.984 | 10.000 |
| −0.947 | 54.633 | 10.000 |
| −0.712 | 55.347 | 10.000 |
| −0.119 | 55.733 | 10.000 |
| −0.760 | 55.251 | 10.000 |
| −0.544 | 55.624 | 10.000 |
| −0.412 | 55.281 | 10.000 |
| −0.502 | 55.085 | 10.000 |
| −0.842 | 55.051 | 10.000 |
| −0.246 | 55.559 | 10.000 |
| −0.804 | 55.152 | 10.000 |
| −0.459 | 55.184 | 10.000 |
| −0.604 | 55.534 | 10.000 |
| −0.184 | 55.647 | 10.000 |
| −0.360 | 55.376 | 10.000 |
| −0.660 | 55.442 | 10.000 |
| −0.305 | 55.468 | 10.000 |
| −0.481 | 55.712 | 10.000 |
| 0.163 | 56.061 | 10.000 |
| 0.313 | 56.216 | 10.000 |
| 0.237 | 56.139 | 10.000 |
| 0.089 | 55.981 | 10.000 |
| −0.204 | 56.043 | 10.000 |
| −0.415 | 55.797 | 10.000 |
| −0.347 | 55.881 | 10.000 |
| −0.054 | 56.193 | 10.000 |
| 0.018 | 55.900 | 10.000 |

TABLE I-continued

| X | Y | Z |
|---|---|---|
| −0.130 | 56.121 | 10.000 |
| −0.277 | 55.963 | 10.000 |
| −0.052 | 55.818 | 10.000 |
| 0.023 | 56.274 | 10.000 |
| 0.389 | 56.292 | 10.000 |
| 0.624 | 56.515 | 10.000 |
| 0.704 | 56.588 | 10.000 |
| 0.864 | 56.733 | 10.000 |
| 0.101 | 56.349 | 10.000 |
| 0.180 | 56.422 | 10.000 |
| 0.545 | 56.442 | 10.000 |
| 0.421 | 56.638 | 10.000 |
| 0.944 | 56.805 | 10.000 |
| 0.260 | 56.495 | 10.000 |
| 0.340 | 56.567 | 10.000 |
| 0.784 | 56.661 | 10.000 |
| 0.467 | 56.367 | 10.000 |
| 0.585 | 56.779 | 10.000 |
| 0.503 | 56.709 | 10.000 |
| 1.251 | 57.329 | 10.000 |
| 1.674 | 57.447 | 10.000 |
| 0.916 | 57.056 | 10.000 |
| 1.167 | 57.261 | 10.000 |
| 1.419 | 57.464 | 10.000 |
| 1.268 | 57.091 | 10.000 |
| 1.025 | 56.877 | 10.000 |
| 0.667 | 56.849 | 10.000 |
| 1.187 | 57.020 | 10.000 |
| 1.511 | 57.305 | 10.000 |
| 0.833 | 56.988 | 10.000 |
| 1.349 | 57.163 | 10.000 |
| 1.083 | 57.193 | 10.000 |
| 1.106 | 56.949 | 10.000 |
| 1.593 | 57.376 | 10.000 |
| 0.750 | 56.918 | 10.000 |
| 1.430 | 57.234 | 10.000 |
| 1.000 | 57.125 | 10.000 |
| 1.335 | 57.397 | 10.000 |
| 1.589 | 57.598 | 10.000 |
| 1.932 | 57.861 | 10.000 |
| 1.504 | 57.532 | 10.000 |
| 2.000 | 57.730 | 10.000 |
| 2.164 | 57.870 | 10.000 |
| 2.191 | 58.055 | 10.000 |
| 1.674 | 57.665 | 10.000 |
| 1.837 | 57.589 | 10.000 |
| 2.082 | 57.800 | 10.000 |
| 1.760 | 57.730 | 10.000 |
| 2.286 | 58.098 | 10.000 |
| 2.018 | 57.925 | 10.000 |
| 2.326 | 58.013 | 10.000 |
| 1.918 | 57.660 | 10.000 |
| 1.846 | 57.796 | 10.000 |
| 2.105 | 57.990 | 10.000 |
| 1.755 | 57.518 | 10.000 |
| 2.247 | 57.940 | 10.000 |
| −0.729 | 54.060 | 10.500 |
| −0.719 | 53.101 | 10.500 |
| −0.730 | 53.953 | 10.500 |
| −0.712 | 53.420 | 10.500 |
| −0.717 | 53.527 | 10.500 |
| −0.987 | 53.814 | 10.500 |
| −0.950 | 53.496 | 10.500 |
| −0.777 | 53.018 | 10.500 |
| −0.997 | 54.347 | 10.500 |
| −0.726 | 53.740 | 10.500 |
| −0.853 | 53.082 | 10.500 |
| −0.933 | 53.391 | 10.500 |
| −0.724 | 54.167 | 10.500 |
| −0.995 | 53.920 | 10.500 |
| −0.708 | 53.207 | 10.500 |
| −0.889 | 53.182 | 10.500 |
| −0.914 | 53.286 | 10.500 |
| −1.002 | 54.240 | 10.500 |
| −0.708 | 53.314 | 10.500 |
| −0.965 | 53.602 | 10.500 |
| −1.000 | 54.027 | 10.500 |

TABLE I-continued

| X | Y | Z |
|---|---|---|
| −0.722 | 53.633 | 10.500 |
| −0.717 | 54.273 | 10.500 |
| −1.003 | 54.134 | 10.500 |
| −0.729 | 53.847 | 10.500 |
| −0.977 | 53.708 | 10.500 |
| −0.691 | 54.485 | 10.500 |
| −0.957 | 54.664 | 10.500 |
| −0.620 | 54.797 | 10.500 |
| −0.706 | 54.379 | 10.500 |
| −0.648 | 54.694 | 10.500 |
| −0.874 | 54.973 | 10.500 |
| −0.587 | 54.898 | 10.500 |
| −0.550 | 54.998 | 10.500 |
| −0.671 | 54.590 | 10.500 |
| −0.988 | 54.453 | 10.500 |
| −0.975 | 54.559 | 10.500 |
| −0.934 | 54.768 | 10.500 |
| −0.907 | 54.871 | 10.500 |
| −0.463 | 55.193 | 10.500 |
| −0.456 | 55.713 | 10.500 |
| −0.747 | 55.267 | 10.500 |
| −0.582 | 55.541 | 10.500 |
| −0.696 | 55.360 | 10.500 |
| −0.241 | 55.557 | 10.500 |
| −0.509 | 55.096 | 10.500 |
| −0.413 | 55.287 | 10.500 |
| −0.301 | 55.469 | 10.500 |
| −0.521 | 55.628 | 10.500 |
| −0.836 | 55.073 | 10.500 |
| −0.794 | 55.171 | 10.500 |
| −0.641 | 55.452 | 10.500 |
| −0.177 | 55.643 | 10.500 |
| −0.359 | 55.379 | 10.500 |
| −0.111 | 55.726 | 10.500 |
| −0.025 | 56.185 | 10.500 |
| 0.052 | 56.259 | 10.500 |
| 0.173 | 56.045 | 10.500 |
| −0.248 | 55.956 | 10.500 |
| −0.101 | 56.110 | 10.500 |
| 0.400 | 56.270 | 10.500 |
| 0.248 | 56.121 | 10.500 |
| 0.099 | 55.967 | 10.500 |
| 0.027 | 55.888 | 10.500 |
| −0.175 | 56.034 | 10.500 |
| −0.389 | 55.796 | 10.500 |
| −0.320 | 55.877 | 10.500 |
| −0.043 | 55.808 | 10.500 |
| 0.324 | 56.196 | 10.500 |
| 0.635 | 56.487 | 10.500 |
| 0.695 | 56.820 | 10.500 |
| 0.130 | 56.332 | 10.500 |
| 0.955 | 56.770 | 10.500 |
| 0.875 | 56.700 | 10.500 |
| 0.715 | 56.558 | 10.500 |
| 0.531 | 56.684 | 10.500 |
| 0.209 | 56.403 | 10.500 |
| 0.289 | 56.474 | 10.500 |
| 0.478 | 56.343 | 10.500 |
| 0.556 | 56.415 | 10.500 |
| 0.450 | 56.614 | 10.500 |
| 0.613 | 56.752 | 10.500 |
| 0.794 | 56.629 | 10.500 |
| 1.035 | 56.840 | 10.500 |
| 0.369 | 56.545 | 10.500 |
| 1.025 | 57.091 | 10.500 |
| 0.942 | 57.023 | 10.500 |
| 1.358 | 57.119 | 10.500 |
| 0.777 | 56.888 | 10.500 |
| 1.682 | 57.397 | 10.500 |
| 1.358 | 57.357 | 10.500 |
| 1.439 | 57.188 | 10.500 |
| 0.860 | 56.956 | 10.500 |
| 1.191 | 57.224 | 10.500 |
| 1.520 | 57.258 | 10.500 |
| 1.601 | 57.327 | 10.500 |
| 1.116 | 56.910 | 10.500 |
| 1.275 | 57.291 | 10.500 |

TABLE I-continued

| X | Y | Z |
|---|---|---|
| 1.763 | 57.466 | 10.500 |
| 1.197 | 56.979 | 10.500 |
| 1.108 | 57.157 | 10.500 |
| 1.442 | 57.423 | 10.500 |
| 1.278 | 57.049 | 10.500 |
| 2.303 | 58.038 | 10.500 |
| 2.253 | 57.879 | 10.500 |
| 1.845 | 57.535 | 10.500 |
| 2.171 | 57.811 | 10.500 |
| 2.007 | 57.673 | 10.500 |
| 1.610 | 57.554 | 10.500 |
| 2.208 | 58.002 | 10.500 |
| 2.089 | 57.742 | 10.500 |
| 1.951 | 57.812 | 10.500 |
| 1.926 | 57.604 | 10.500 |
| 1.865 | 57.748 | 10.500 |
| 2.332 | 57.950 | 10.500 |
| 2.036 | 57.876 | 10.500 |
| 1.780 | 57.684 | 10.500 |
| 1.526 | 57.489 | 10.500 |
| 1.695 | 57.619 | 10.500 |
| 2.122 | 57.939 | 10.500 |
| −1.001 | 53.542 | 11.000 |
| −1.032 | 54.067 | 11.000 |
| −0.918 | 53.130 | 11.000 |
| −0.772 | 53.461 | 11.000 |
| −0.771 | 53.356 | 11.000 |
| −0.750 | 54.302 | 11.000 |
| −0.972 | 53.333 | 11.000 |
| −1.031 | 53.962 | 11.000 |
| −1.012 | 53.647 | 11.000 |
| −0.777 | 53.882 | 11.000 |
| −0.761 | 54.198 | 11.000 |
| −0.776 | 53.671 | 11.000 |
| −1.025 | 54.278 | 11.000 |
| −0.845 | 53.065 | 11.000 |
| −0.950 | 53.230 | 11.000 |
| −0.777 | 53.777 | 11.000 |
| −0.769 | 54.093 | 11.000 |
| −0.774 | 53.987 | 11.000 |
| −0.787 | 53.146 | 11.000 |
| −0.988 | 53.438 | 11.000 |
| −1.020 | 53.752 | 11.000 |
| −0.774 | 53.566 | 11.000 |
| −1.027 | 53.857 | 11.000 |
| −1.030 | 54.173 | 11.000 |
| −0.774 | 53.250 | 11.000 |
| −1.016 | 54.383 | 11.000 |
| −0.870 | 54.996 | 11.000 |
| −0.906 | 54.897 | 11.000 |
| −1.003 | 54.487 | 11.000 |
| −0.693 | 54.613 | 11.000 |
| −0.599 | 54.914 | 11.000 |
| −0.986 | 54.591 | 11.000 |
| −0.716 | 54.510 | 11.000 |
| −0.965 | 54.694 | 11.000 |
| −0.635 | 54.815 | 11.000 |
| −0.938 | 54.796 | 11.000 |
| −0.666 | 54.715 | 11.000 |
| −0.735 | 54.407 | 11.000 |
| −0.559 | 55.012 | 11.000 |
| −0.514 | 55.107 | 11.000 |
| −0.172 | 55.637 | 11.000 |
| −0.829 | 55.093 | 11.000 |
| −0.466 | 55.201 | 11.000 |
| −0.358 | 55.382 | 11.000 |
| −0.624 | 55.460 | 11.000 |
| −0.734 | 55.281 | 11.000 |
| −0.299 | 55.469 | 11.000 |
| −0.435 | 55.713 | 11.000 |
| −0.237 | 55.554 | 11.000 |
| −0.413 | 55.292 | 11.000 |
| −0.784 | 55.188 | 11.000 |
| −0.681 | 55.371 | 11.000 |
| −0.105 | 55.719 | 11.000 |
| −0.500 | 55.631 | 11.000 |
| −0.564 | 55.546 | 11.000 |

TABLE I-continued

| X | Y | Z |
|---|---|---|
| −0.296 | 55.872 | 11.000 |
| −0.036 | 55.798 | 11.000 |
| 0.180 | 56.028 | 11.000 |
| 0.035 | 55.876 | 11.000 |
| −0.224 | 55.949 | 11.000 |
| 0.107 | 55.953 | 11.000 |
| −0.076 | 56.098 | 11.000 |
| 0.408 | 56.247 | 11.000 |
| −0.151 | 56.024 | 11.000 |
| 0.077 | 56.243 | 11.000 |
| 0.000 | 56.171 | 11.000 |
| 0.331 | 56.175 | 11.000 |
| −0.366 | 55.793 | 11.000 |
| 0.255 | 56.102 | 11.000 |
| 0.554 | 56.658 | 11.000 |
| 0.801 | 56.598 | 11.000 |
| 0.716 | 56.792 | 11.000 |
| 0.642 | 56.459 | 11.000 |
| 0.392 | 56.522 | 11.000 |
| 0.721 | 56.529 | 11.000 |
| 0.881 | 56.667 | 11.000 |
| 0.635 | 56.725 | 11.000 |
| 0.485 | 56.319 | 11.000 |
| 1.041 | 56.803 | 11.000 |
| 0.961 | 56.735 | 11.000 |
| 0.564 | 56.389 | 11.000 |
| 0.233 | 56.384 | 11.000 |
| 0.313 | 56.454 | 11.000 |
| 0.473 | 56.590 | 11.000 |
| 0.155 | 56.314 | 11.000 |
| 0.962 | 56.990 | 11.000 |
| 0.798 | 56.858 | 11.000 |
| 1.202 | 56.939 | 11.000 |
| 0.880 | 56.924 | 11.000 |
| 1.292 | 57.252 | 11.000 |
| 1.044 | 57.056 | 11.000 |
| 1.542 | 57.446 | 11.000 |
| 1.766 | 57.414 | 11.000 |
| 1.375 | 57.317 | 11.000 |
| 1.605 | 57.279 | 11.000 |
| 1.685 | 57.347 | 11.000 |
| 1.363 | 57.075 | 11.000 |
| 1.458 | 57.382 | 11.000 |
| 1.282 | 57.007 | 11.000 |
| 1.524 | 57.211 | 11.000 |
| 1.121 | 56.871 | 11.000 |
| 1.127 | 57.122 | 11.000 |
| 1.443 | 57.143 | 11.000 |
| 1.209 | 57.187 | 11.000 |
| 2.218 | 57.949 | 11.000 |
| 2.089 | 57.684 | 11.000 |
| 2.008 | 57.617 | 11.000 |
| 1.962 | 57.763 | 11.000 |
| 1.847 | 57.482 | 11.000 |
| 1.709 | 57.574 | 11.000 |
| 2.332 | 57.887 | 11.000 |
| 2.132 | 57.887 | 11.000 |
| 1.878 | 57.700 | 11.000 |
| 2.312 | 57.976 | 11.000 |
| 1.625 | 57.510 | 11.000 |
| 2.252 | 57.818 | 11.000 |
| 2.047 | 57.825 | 11.000 |
| 1.927 | 57.549 | 11.000 |
| 1.793 | 57.637 | 11.000 |
| 2.170 | 57.751 | 11.000 |
| −1.063 | 53.900 | 11.500 |
| −1.008 | 53.279 | 11.500 |
| −1.046 | 54.315 | 11.500 |
| −0.816 | 54.022 | 11.500 |
| −0.796 | 54.229 | 11.500 |
| −1.060 | 53.796 | 11.500 |
| −0.781 | 54.332 | 11.500 |
| −0.909 | 53.114 | 11.500 |
| −1.063 | 54.004 | 11.500 |
| −0.829 | 53.503 | 11.500 |
| −1.039 | 53.485 | 11.500 |
| −0.980 | 53.180 | 11.500 |

TABLE I-continued

| X | Y | Z |
|---|---|---|
| −1.060 | 54.108 | 11.500 |
| −0.822 | 53.918 | 11.500 |
| −0.836 | 53.295 | 11.500 |
| −1.048 | 53.588 | 11.500 |
| −0.851 | 53.192 | 11.500 |
| −1.026 | 53.382 | 11.500 |
| −0.331 | 53.399 | 11.500 |
| −0.825 | 53.814 | 11.500 |
| −0.828 | 53.607 | 11.500 |
| −1.055 | 54.211 | 11.500 |
| −0.807 | 54.126 | 11.500 |
| −1.056 | 53.692 | 11.500 |
| −0.827 | 53.711 | 11.500 |
| −0.905 | 54.921 | 11.500 |
| −0.683 | 54.735 | 11.500 |
| −0.762 | 54.434 | 11.500 |
| −0.566 | 55.024 | 11.500 |
| −0.970 | 54.723 | 11.500 |
| −0.739 | 54.535 | 11.500 |
| −0.866 | 55.017 | 11.500 |
| −0.609 | 54.930 | 11.500 |
| −0.995 | 54.622 | 11.500 |
| −0.713 | 54.636 | 11.500 |
| −0.940 | 54.823 | 11.500 |
| −1.016 | 54.521 | 11.500 |
| −1.033 | 54.418 | 11.500 |
| −0.643 | 54.833 | 11.500 |
| −0.101 | 55.710 | 11.500 |
| −0.667 | 55.381 | 11.500 |
| −0.774 | 55.203 | 11.500 |
| −0.822 | 55.111 | 11.500 |
| −0.519 | 55.117 | 11.500 |
| −0.608 | 55.467 | 11.500 |
| −0.546 | 55.551 | 11.500 |
| −0.414 | 55.296 | 11.500 |
| −0.415 | 55.712 | 11.500 |
| −0.469 | 55.208 | 11.500 |
| −0.357 | 55.383 | 11.500 |
| −0.234 | 55.550 | 11.500 |
| −0.482 | 55.632 | 11.500 |
| −0.722 | 55.293 | 11.500 |
| −0.169 | 55.631 | 11.500 |
| −0.297 | 55.468 | 11.500 |
| −0.347 | 55.790 | 11.500 |
| 0.413 | 56.225 | 11.500 |
| 0.020 | 56.158 | 11.500 |
| −0.276 | 55.866 | 11.500 |
| 0.040 | 55.863 | 11.500 |
| −0.032 | 55.788 | 11.500 |
| −0.204 | 55.941 | 11.500 |
| −0.130 | 56.014 | 11.500 |
| 0.336 | 56.155 | 11.500 |
| 0.490 | 56.294 | 11.500 |
| 0.260 | 56.083 | 11.500 |
| −0.056 | 56.087 | 11.500 |
| 0.112 | 55.938 | 11.500 |
| 0.097 | 56.228 | 11.500 |
| 0.186 | 56.011 | 11.500 |
| 0.963 | 56.701 | 11.500 |
| 0.411 | 56.500 | 11.500 |
| 0.804 | 56.567 | 11.500 |
| 0.175 | 56.297 | 11.500 |
| 0.253 | 56.365 | 11.500 |
| 0.568 | 56.363 | 11.500 |
| 0.814 | 56.828 | 11.500 |
| 0.725 | 56.499 | 11.500 |
| 0.491 | 56.566 | 11.500 |
| 0.733 | 56.763 | 11.500 |
| 0.646 | 56.432 | 11.500 |
| 0.883 | 56.634 | 11.500 |
| 0.571 | 56.632 | 11.500 |
| 0.332 | 56.433 | 11.500 |
| 1.123 | 56.834 | 11.500 |
| 1.043 | 56.767 | 11.500 |
| 0.652 | 56.698 | 11.500 |
| 1.203 | 56.900 | 11.500 |
| 1.523 | 57.165 | 11.500 |

TABLE I-continued

| X | Y | Z |
|---|---|---|
| 1.140 | 57.086 | 11.500 |
| 1.764 | 57.363 | 11.500 |
| 1.363 | 57.032 | 11.500 |
| 1.305 | 57.213 | 11.500 |
| 1.552 | 57.403 | 11.500 |
| 1.844 | 57.429 | 11.500 |
| 1.635 | 57.466 | 11.500 |
| 1.222 | 57.149 | 11.500 |
| 1.387 | 57.277 | 11.500 |
| 1.684 | 57.297 | 11.500 |
| 1.059 | 57.021 | 11.500 |
| 1.603 | 57.231 | 11.500 |
| 1.443 | 57.098 | 11.500 |
| 0.977 | 56.957 | 11.500 |
| 1.469 | 57.340 | 11.500 |
| 1.283 | 56.966 | 11.500 |
| 0.895 | 56.893 | 11.500 |
| 2.222 | 57.895 | 11.500 |
| 1.924 | 57.495 | 11.500 |
| 2.085 | 57.627 | 11.500 |
| 2.005 | 57.561 | 11.500 |
| 1.969 | 57.713 | 11.500 |
| 2.247 | 57.758 | 11.500 |
| 1.718 | 57.528 | 11.500 |
| 1.885 | 57.652 | 11.500 |
| 2.137 | 57.835 | 11.500 |
| 2.316 | 57.915 | 11.500 |
| 1.801 | 57.590 | 11.500 |
| 2.053 | 57.774 | 11.500 |
| 2.166 | 57.692 | 11.500 |
| 2.326 | 57.824 | 11.500 |
| −1.088 | 53.533 | 12.000 |
| −0.872 | 53.852 | 12.000 |
| −1.064 | 53.329 | 12.000 |
| −0.856 | 54.057 | 12.000 |
| −0.865 | 53.955 | 12.000 |
| −1.039 | 53.230 | 12.000 |
| −0.881 | 53.648 | 12.000 |
| −1.098 | 53.840 | 12.000 |
| −1.064 | 54.351 | 12.000 |
| −0.888 | 53.443 | 12.000 |
| −1.078 | 53.431 | 12.000 |
| −0.912 | 53.239 | 12.000 |
| −0.896 | 53.340 | 12.000 |
| −0.971 | 53.163 | 12.000 |
| −1.087 | 54.147 | 12.000 |
| −1.093 | 54.045 | 12.000 |
| −0.884 | 53.545 | 12.000 |
| −0.844 | 54.159 | 12.000 |
| −1.097 | 53.738 | 12.000 |
| −1.077 | 54.249 | 12.000 |
| −1.097 | 53.943 | 12.000 |
| −0.828 | 54.260 | 12.000 |
| −1.094 | 53.635 | 12.000 |
| −0.877 | 53.750 | 12.000 |
| −0.732 | 54.658 | 12.000 |
| −1.048 | 54.452 | 12.000 |
| −0.573 | 55.036 | 12.000 |
| −0.974 | 54.751 | 12.000 |
| −0.903 | 54.943 | 12.000 |
| −0.660 | 54.850 | 12.000 |
| −0.940 | 54.847 | 12.000 |
| −0.810 | 54.361 | 12.000 |
| −0.861 | 55.036 | 12.000 |
| −1.003 | 54.652 | 12.000 |
| −0.619 | 54.944 | 12.000 |
| −1.027 | 54.553 | 12.000 |
| −0.698 | 54.755 | 12.000 |
| −0.762 | 54.560 | 12.000 |
| −0.788 | 54.461 | 12.000 |
| −0.398 | 55.710 | 12.000 |
| −0.531 | 55.554 | 12.000 |
| −0.466 | 55.633 | 12.000 |
| −0.814 | 55.128 | 12.000 |
| −0.416 | 55.300 | 12.000 |
| −0.711 | 55.305 | 12.000 |
| −0.296 | 55.466 | 12.000 |

TABLE I-continued

| X | Y | Z |
|---|---|---|
| −0.524 | 55.126 | 12.000 |
| −0.594 | 55.473 | 12.000 |
| −0.654 | 55.390 | 12.000 |
| −0.098 | 55.701 | 12.000 |
| −0.166 | 55.624 | 12.000 |
| −0.357 | 55.384 | 12.000 |
| −0.232 | 55.546 | 12.000 |
| −0.764 | 55.217 | 12.000 |
| −0.472 | 55.214 | 12.000 |
| 0.115 | 56.212 | 12.000 |
| −0.112 | 56.004 | 12.000 |
| 0.116 | 55.923 | 12.000 |
| 0.492 | 56.270 | 12.000 |
| 0.415 | 56.202 | 12.000 |
| 0.192 | 56.279 | 12.000 |
| −0.329 | 55.786 | 12.000 |
| −0.028 | 55.776 | 12.000 |
| −0.038 | 56.074 | 12.000 |
| −0.258 | 55.860 | 12.000 |
| 0.339 | 56.134 | 12.000 |
| 0.038 | 56.143 | 12.000 |
| 0.264 | 56.064 | 12.000 |
| 0.043 | 55.850 | 12.000 |
| −0.186 | 55.932 | 12.000 |
| 0.189 | 55.994 | 12.000 |
| 1.122 | 56.796 | 12.000 |
| 0.827 | 56.798 | 12.000 |
| 0.506 | 56.542 | 12.000 |
| 0.427 | 56.477 | 12.000 |
| 0.884 | 56.601 | 12.000 |
| 0.586 | 56.606 | 12.000 |
| 0.570 | 56.337 | 12.000 |
| 0.348 | 56.412 | 12.000 |
| 0.648 | 56.404 | 12.000 |
| 0.726 | 56.470 | 12.000 |
| 0.805 | 56.535 | 12.000 |
| 0.666 | 56.671 | 12.000 |
| 0.963 | 56.666 | 12.000 |
| 0.746 | 56.734 | 12.000 |
| 0.270 | 56.346 | 12.000 |
| 1.042 | 56.731 | 12.000 |
| 1.520 | 57.118 | 12.000 |
| 1.281 | 56.925 | 12.000 |
| 1.314 | 57.174 | 12.000 |
| 1.232 | 57.112 | 12.000 |
| 1.201 | 56.860 | 12.000 |
| 1.759 | 57.312 | 12.000 |
| 1.361 | 56.989 | 12.000 |
| 1.070 | 56.987 | 12.000 |
| 1.559 | 57.359 | 12.000 |
| 1.440 | 57.054 | 12.000 |
| 0.989 | 56.924 | 12.000 |
| 1.477 | 57.298 | 12.000 |
| 1.919 | 57.441 | 12.000 |
| 0.908 | 56.861 | 12.000 |
| 1.151 | 57.049 | 12.000 |
| 1.600 | 57.183 | 12.000 |
| 1.839 | 57.376 | 12.000 |
| 1.395 | 57.236 | 12.000 |
| 1.641 | 57.421 | 12.000 |
| 1.679 | 57.247 | 12.000 |
| 1.889 | 57.603 | 12.000 |
| 1.972 | 57.663 | 12.000 |
| 2.055 | 57.723 | 12.000 |
| 2.078 | 57.569 | 12.000 |
| 1.998 | 57.505 | 12.000 |
| 1.723 | 57.482 | 12.000 |
| 2.238 | 57.698 | 12.000 |
| 1.806 | 57.543 | 12.000 |
| 2.318 | 57.762 | 12.000 |
| 2.139 | 57.782 | 12.000 |
| 2.315 | 57.853 | 12.000 |
| 2.158 | 57.634 | 12.000 |
| 2.222 | 57.841 | 12.000 |
| −1.112 | 54.186 | 12.500 |
| −0.894 | 54.091 | 12.500 |
| −1.031 | 53.213 | 12.500 |

TABLE I-continued

| X | Y | Z |
|---|---|---|
| −1.130 | 53.985 | 12.500 |
| −0.954 | 53.386 | 12.500 |
| −1.122 | 54.086 | 12.500 |
| −1.118 | 53.379 | 12.500 |
| −0.944 | 53.487 | 12.500 |
| −0.925 | 53.790 | 12.500 |
| −0.879 | 54.191 | 12.500 |
| −0.860 | 54.291 | 12.500 |
| −0.933 | 53.588 | 12.500 |
| −0.932 | 53.689 | 12.500 |
| −1.129 | 53.480 | 12.500 |
| −1.135 | 53.581 | 12.500 |
| −1.096 | 53.281 | 12.500 |
| −1.134 | 53.884 | 12.500 |
| −0.917 | 53.890 | 12.500 |
| −0.907 | 53.991 | 12.500 |
| −1.137 | 53.783 | 12.500 |
| −1.137 | 53.682 | 12.500 |
| −0.972 | 53.287 | 12.500 |
| −1.098 | 54.286 | 12.500 |
| −0.977 | 54.776 | 12.500 |
| −0.673 | 54.866 | 12.500 |
| −0.713 | 54.774 | 12.500 |
| −0.581 | 55.046 | 12.500 |
| −1.061 | 54.485 | 12.500 |
| −0.941 | 54.871 | 12.500 |
| −0.813 | 54.487 | 12.500 |
| −1.037 | 54.583 | 12.500 |
| −1.009 | 54.680 | 12.500 |
| −0.838 | 54.389 | 12.500 |
| −0.900 | 54.963 | 12.500 |
| −0.628 | 54.957 | 12.500 |
| −0.783 | 54.584 | 12.500 |
| −0.750 | 54.679 | 12.500 |
| −1.081 | 54.386 | 12.500 |
| −0.580 | 55.477 | 12.500 |
| −0.530 | 55.133 | 12.500 |
| −0.358 | 55.383 | 12.500 |
| −0.231 | 55.541 | 12.500 |
| −0.517 | 55.556 | 12.500 |
| −0.807 | 55.143 | 12.500 |
| −0.451 | 55.632 | 12.500 |
| −0.296 | 55.463 | 12.500 |
| −0.418 | 55.302 | 12.500 |
| −0.164 | 55.617 | 12.500 |
| −0.475 | 55.219 | 12.500 |
| −0.096 | 55.691 | 12.500 |
| −0.755 | 55.230 | 12.500 |
| −0.383 | 55.707 | 12.500 |
| −0.700 | 55.314 | 12.500 |
| −0.641 | 55.397 | 12.500 |
| −0.856 | 55.054 | 12.500 |
| −0.026 | 55.764 | 12.500 |
| −0.242 | 55.853 | 12.500 |
| 0.118 | 55.907 | 12.500 |
| −0.096 | 55.993 | 12.500 |
| 0.130 | 56.195 | 12.500 |
| 0.191 | 55.976 | 12.500 |
| 0.207 | 56.261 | 12.500 |
| 0.265 | 56.045 | 12.500 |
| 0.493 | 56.245 | 12.500 |
| −0.022 | 56.061 | 12.500 |
| 0.341 | 56.112 | 12.500 |
| −0.170 | 55.923 | 12.500 |
| 0.045 | 55.836 | 12.500 |
| 0.054 | 56.128 | 12.500 |
| −0.313 | 55.781 | 12.500 |
| 0.417 | 56.179 | 12.500 |
| 0.917 | 56.829 | 12.500 |
| 0.570 | 56.310 | 12.500 |
| 0.678 | 56.643 | 12.500 |
| 0.757 | 56.705 | 12.500 |
| 1.119 | 56.758 | 12.500 |
| 0.804 | 56.504 | 12.500 |
| 1.040 | 56.695 | 12.500 |
| 0.284 | 56.326 | 12.500 |
| 0.440 | 56.454 | 12.500 |

TABLE I-continued

| X | Y | Z |
|---|---|---|
| 0.598 | 56.580 | 12.500 |
| 0.961 | 56.631 | 12.500 |
| 0.882 | 56.568 | 12.500 |
| 0.648 | 56.375 | 12.500 |
| 1.198 | 56.821 | 12.500 |
| 0.362 | 56.390 | 12.500 |
| 0.519 | 56.517 | 12.500 |
| 0.725 | 56.440 | 12.500 |
| 0.837 | 56.767 | 12.500 |
| 1.563 | 57.316 | 12.500 |
| 1.159 | 57.012 | 12.500 |
| 1.277 | 56.884 | 12.500 |
| 1.239 | 57.073 | 12.500 |
| 0.998 | 56.890 | 12.500 |
| 1.910 | 57.387 | 12.500 |
| 1.752 | 57.261 | 12.500 |
| 1.514 | 57.072 | 12.500 |
| 1.989 | 57.449 | 12.500 |
| 1.726 | 57.435 | 12.500 |
| 1.401 | 57.195 | 12.500 |
| 1.078 | 56.951 | 12.500 |
| 1.482 | 57.255 | 12.500 |
| 1.644 | 57.376 | 12.500 |
| 1.831 | 57.324 | 12.500 |
| 1.435 | 57.009 | 12.500 |
| 1.594 | 57.135 | 12.500 |
| 1.673 | 57.198 | 12.500 |
| 1.320 | 57.134 | 12.500 |
| 1.356 | 56.947 | 12.500 |
| 2.220 | 57.787 | 12.500 |
| 2.148 | 57.575 | 12.500 |
| 1.890 | 57.554 | 12.500 |
| 2.306 | 57.701 | 12.500 |
| 1.972 | 57.612 | 12.500 |
| 2.312 | 57.790 | 12.500 |
| 2.055 | 57.671 | 12.500 |
| 1.808 | 57.495 | 12.500 |
| 2.227 | 57.638 | 12.500 |
| 2.069 | 57.512 | 12.500 |
| 2.137 | 57.729 | 12.500 |
| −0.911 | 54.223 | 13.000 |
| −0.979 | 53.730 | 13.000 |
| −1.173 | 53.728 | 13.000 |
| −1.116 | 54.322 | 13.000 |
| −0.889 | 54.321 | 13.000 |
| −1.176 | 53.529 | 13.000 |
| −0.970 | 53.829 | 13.000 |
| −1.028 | 53.335 | 13.000 |
| −1.133 | 54.224 | 13.000 |
| −1.159 | 54.026 | 13.000 |
| −0.959 | 53.928 | 13.000 |
| −1.168 | 53.429 | 13.000 |
| −1.008 | 53.433 | 13.000 |
| −1.149 | 53.331 | 13.000 |
| −1.148 | 54.125 | 13.000 |
| −1.168 | 53.927 | 13.000 |
| −0.945 | 54.027 | 13.000 |
| −0.997 | 53.532 | 13.000 |
| −1.087 | 53.263 | 13.000 |
| −0.930 | 54.125 | 13.000 |
| −0.988 | 53.631 | 13.000 |
| −1.174 | 53.827 | 13.000 |
| −1.178 | 53.628 | 13.000 |
| −1.045 | 54.612 | 13.000 |
| −0.767 | 54.699 | 13.000 |
| −1.096 | 54.419 | 13.000 |
| −0.897 | 54.982 | 13.000 |
| −0.727 | 54.791 | 13.000 |
| −0.979 | 54.800 | 13.000 |
| −0.684 | 54.881 | 13.000 |
| −0.940 | 54.892 | 13.000 |
| −0.864 | 54.417 | 13.000 |
| −0.637 | 54.969 | 13.000 |
| −0.835 | 54.512 | 13.000 |
| −1.014 | 54.707 | 13.000 |
| −1.072 | 54.516 | 13.000 |
| −0.803 | 54.607 | 13.000 |

TABLE I-continued

| X | Y | Z |
|---|---|---|
| −0.231 | 55.534 | 13.000 |
| −0.535 | 55.140 | 13.000 |
| −0.850 | 55.070 | 13.000 |
| −0.164 | 55.608 | 13.000 |
| −0.479 | 55.222 | 13.000 |
| −0.630 | 55.402 | 13.000 |
| −0.096 | 55.680 | 13.000 |
| −0.420 | 55.303 | 13.000 |
| −0.504 | 55.556 | 13.000 |
| −0.438 | 55.630 | 13.000 |
| −0.568 | 55.480 | 13.000 |
| −0.690 | 55.322 | 13.000 |
| −0.359 | 55.382 | 13.000 |
| −0.800 | 55.156 | 13.000 |
| −0.370 | 55.703 | 13.000 |
| −0.296 | 55.459 | 13.000 |
| −0.587 | 55.055 | 13.000 |
| −0.747 | 55.240 | 13.000 |
| 0.567 | 56.284 | 13.000 |
| −0.009 | 56.047 | 13.000 |
| 0.191 | 55.958 | 13.000 |
| 0.218 | 56.242 | 13.000 |
| 0.141 | 56.178 | 13.000 |
| −0.084 | 55.981 | 13.000 |
| 0.415 | 56.155 | 13.000 |
| −0.300 | 55.774 | 13.000 |
| 0.265 | 56.024 | 13.000 |
| 0.491 | 56.220 | 13.000 |
| −0.026 | 55.752 | 13.000 |
| 0.066 | 56.113 | 13.000 |
| 0.045 | 55.821 | 13.000 |
| −0.157 | 55.913 | 13.000 |
| −0.229 | 55.844 | 13.000 |
| 0.339 | 56.090 | 13.000 |
| 0.117 | 55.890 | 13.000 |
| 0.843 | 56.736 | 13.000 |
| 0.644 | 56.347 | 13.000 |
| 0.685 | 56.615 | 13.000 |
| 1.033 | 56.658 | 13.000 |
| 1.190 | 56.781 | 13.000 |
| 1.269 | 56.843 | 13.000 |
| 0.923 | 56.796 | 13.000 |
| 0.372 | 56.368 | 13.000 |
| 1.112 | 56.720 | 13.000 |
| 0.722 | 56.410 | 13.000 |
| 0.606 | 56.553 | 13.000 |
| 0.877 | 56.535 | 13.000 |
| 0.450 | 56.430 | 13.000 |
| 0.955 | 56.597 | 13.000 |
| 0.295 | 56.305 | 13.000 |
| 0.764 | 56.675 | 13.000 |
| 0.799 | 56.472 | 13.000 |
| 0.528 | 56.492 | 13.000 |
| 1.002 | 56.856 | 13.000 |
| 2.055 | 57.456 | 13.000 |
| 1.562 | 57.272 | 13.000 |
| 1.426 | 56.965 | 13.000 |
| 1.805 | 57.447 | 13.000 |
| 1.724 | 57.389 | 13.000 |
| 1.321 | 57.095 | 13.000 |
| 1.740 | 57.210 | 13.000 |
| 1.162 | 56.976 | 13.000 |
| 1.819 | 57.271 | 13.000 |
| 1.082 | 56.916 | 13.000 |
| 1.976 | 57.394 | 13.000 |
| 1.482 | 57.213 | 13.000 |
| 1.583 | 57.088 | 13.000 |
| 1.241 | 57.035 | 13.000 |
| 1.643 | 57.330 | 13.000 |
| 1.347 | 56.904 | 13.000 |
| 1.897 | 57.333 | 13.000 |
| 1.505 | 57.026 | 13.000 |
| 1.402 | 57.154 | 13.000 |
| 1.662 | 57.149 | 13.000 |
| 2.133 | 57.517 | 13.000 |
| 2.302 | 57.728 | 13.000 |
| 2.049 | 57.619 | 13.000 |

TABLE I-continued

| X | Y | Z |
|---|---|---|
| 1.967 | 57.562 | 13.000 |
| 2.211 | 57.578 | 13.000 |
| 2.213 | 57.733 | 13.000 |
| 2.131 | 57.676 | 13.000 |
| 1.886 | 57.505 | 13.000 |
| 2.290 | 57.640 | 13.000 |
| −0.939 | 54.254 | 13.500 |
| −1.022 | 53.771 | 13.500 |
| −1.138 | 53.314 | 13.500 |
| −1.184 | 54.066 | 13.500 |
| −0.914 | 54.349 | 13.500 |
| −1.009 | 53.869 | 13.500 |
| −1.079 | 53.384 | 13.500 |
| −1.213 | 53.774 | 13.500 |
| −1.217 | 53.676 | 13.500 |
| −0.996 | 53.966 | 13.500 |
| −1.057 | 53.479 | 13.500 |
| −1.213 | 53.480 | 13.500 |
| −1.151 | 54.260 | 13.500 |
| −0.979 | 54.062 | 13.500 |
| −1.044 | 53.576 | 13.500 |
| −1.198 | 53.383 | 13.500 |
| −1.196 | 53.969 | 13.500 |
| −1.206 | 53.871 | 13.500 |
| −0.960 | 54.159 | 13.500 |
| −1.169 | 54.163 | 13.500 |
| −1.033 | 53.674 | 13.500 |
| −1.218 | 53.578 | 13.500 |
| −0.738 | 54.806 | 13.500 |
| −0.892 | 54.997 | 13.500 |
| −1.015 | 54.730 | 13.500 |
| −1.049 | 54.638 | 13.500 |
| −0.692 | 54.893 | 13.500 |
| −0.885 | 54.443 | 13.500 |
| −1.130 | 54.356 | 13.500 |
| −0.644 | 54.978 | 13.500 |
| −0.854 | 54.536 | 13.500 |
| −0.978 | 54.821 | 13.500 |
| −0.936 | 54.910 | 13.500 |
| −0.818 | 54.627 | 13.500 |
| −1.080 | 54.545 | 13.500 |
| −1.107 | 54.451 | 13.500 |
| −0.780 | 54.718 | 13.500 |
| −0.844 | 55.083 | 13.500 |
| −0.482 | 55.224 | 13.500 |
| −0.494 | 55.555 | 13.500 |
| −0.422 | 55.302 | 13.500 |
| −0.558 | 55.481 | 13.500 |
| −0.738 | 55.248 | 13.500 |
| −0.361 | 55.378 | 13.500 |
| −0.232 | 55.527 | 13.500 |
| −0.792 | 55.166 | 13.500 |
| −0.097 | 55.669 | 13.500 |
| −0.165 | 55.598 | 13.500 |
| −0.359 | 55.698 | 13.500 |
| −0.028 | 55.738 | 13.500 |
| −0.297 | 55.453 | 13.500 |
| −0.593 | 55.062 | 13.500 |
| −0.427 | 55.627 | 13.500 |
| −0.620 | 55.405 | 13.500 |
| −0.539 | 55.144 | 13.500 |
| −0.680 | 55.327 | 13.500 |
| −0.075 | 55.968 | 13.500 |
| 0.073 | 56.097 | 13.500 |
| 0.224 | 56.222 | 13.500 |
| −0.219 | 55.835 | 13.500 |
| −0.290 | 55.767 | 13.500 |
| 0.043 | 55.806 | 13.500 |
| −0.001 | 56.033 | 13.500 |
| 0.115 | 55.873 | 13.500 |
| 0.148 | 56.160 | 13.500 |
| 0.187 | 55.939 | 13.500 |
| 0.561 | 56.257 | 13.500 |
| −0.148 | 55.902 | 13.500 |
| 0.261 | 56.004 | 13.500 |
| 0.335 | 56.068 | 13.500 |
| 0.410 | 56.131 | 13.500 |

TABLE I-continued

| X | Y | Z |
|---|---|---|
| 0.485 | 56.194 | 13.500 |
| 0.300 | 56.284 | 13.500 |
| 1.100 | 56.682 | 13.500 |
| 0.945 | 56.562 | 13.500 |
| 1.178 | 56.742 | 13.500 |
| 0.921 | 56.763 | 13.500 |
| 1.022 | 56.622 | 13.500 |
| 0.686 | 56.586 | 13.500 |
| 0.714 | 56.380 | 13.500 |
| 0.453 | 56.406 | 13.500 |
| 0.637 | 56.318 | 13.500 |
| 0.608 | 56.527 | 13.500 |
| 0.791 | 56.441 | 13.500 |
| 0.376 | 56.345 | 13.500 |
| 1.256 | 56.801 | 13.500 |
| 0.531 | 56.467 | 13.500 |
| 0.843 | 56.705 | 13.500 |
| 1.000 | 56.822 | 13.500 |
| 0.764 | 56.646 | 13.500 |
| 0.868 | 56.501 | 13.500 |
| 1.793 | 57.399 | 13.500 |
| 1.713 | 57.342 | 13.500 |
| 1.645 | 57.100 | 13.500 |
| 1.237 | 56.997 | 13.500 |
| 1.878 | 57.280 | 13.500 |
| 1.316 | 57.055 | 13.500 |
| 1.722 | 57.160 | 13.500 |
| 1.158 | 56.939 | 13.500 |
| 1.955 | 57.340 | 13.500 |
| 1.800 | 57.220 | 13.500 |
| 1.633 | 57.285 | 13.500 |
| 1.554 | 57.228 | 13.500 |
| 1.489 | 56.980 | 13.500 |
| 1.474 | 57.170 | 13.500 |
| 1.411 | 56.921 | 13.500 |
| 1.567 | 57.040 | 13.500 |
| 1.395 | 57.113 | 13.500 |
| 1.079 | 56.880 | 13.500 |
| 2.033 | 57.400 | 13.500 |
| 1.333 | 56.861 | 13.500 |
| 2.111 | 57.460 | 13.500 |
| 1.873 | 57.455 | 13.500 |
| 2.188 | 57.520 | 13.500 |
| 2.196 | 57.678 | 13.500 |
| 2.115 | 57.623 | 13.500 |
| 2.035 | 57.567 | 13.500 |
| 2.266 | 57.580 | 13.500 |
| 2.284 | 57.666 | 13.500 |
| 1.954 | 57.511 | 13.500 |
| −1.072 | 53.717 | 14.000 |
| −0.986 | 54.191 | 14.000 |
| −1.220 | 54.010 | 14.000 |
| −1.240 | 53.435 | 14.000 |
| −1.085 | 53.621 | 14.000 |
| −1.008 | 54.097 | 14.000 |
| −1.243 | 53.819 | 14.000 |
| −1.101 | 53.526 | 14.000 |
| −1.027 | 54.003 | 14.000 |
| −1.233 | 53.915 | 14.000 |
| −1.164 | 54.294 | 14.000 |
| −1.251 | 53.723 | 14.000 |
| −1.123 | 53.432 | 14.000 |
| −1.254 | 53.626 | 14.000 |
| −1.044 | 53.908 | 14.000 |
| −1.185 | 54.200 | 14.000 |
| −1.059 | 53.812 | 14.000 |
| −0.962 | 54.284 | 14.000 |
| −1.204 | 54.105 | 14.000 |
| −1.183 | 53.365 | 14.000 |
| −1.252 | 53.530 | 14.000 |
| −0.931 | 54.926 | 14.000 |
| −1.114 | 54.480 | 14.000 |
| −0.868 | 54.558 | 14.000 |
| −0.831 | 54.647 | 14.000 |
| −0.649 | 54.986 | 14.000 |
| −1.140 | 54.388 | 14.000 |
| −0.903 | 54.468 | 14.000 |

TABLE I-continued

| X | Y | Z |
|---|---|---|
| −0.699 | 54.904 | 14.000 |
| −1.014 | 54.752 | 14.000 |
| −0.885 | 55.010 | 14.000 |
| −0.934 | 54.377 | 14.000 |
| −0.746 | 54.820 | 14.000 |
| −1.051 | 54.662 | 14.000 |
| −0.974 | 54.839 | 14.000 |
| −0.790 | 54.734 | 14.000 |
| −1.084 | 54.572 | 14.000 |
| −0.484 | 55.552 | 14.000 |
| −0.784 | 55.174 | 14.000 |
| −0.299 | 55.446 | 14.000 |
| −0.419 | 55.622 | 14.000 |
| −0.728 | 55.253 | 14.000 |
| −0.362 | 55.374 | 14.000 |
| −0.031 | 55.723 | 14.000 |
| −0.351 | 55.691 | 14.000 |
| −0.424 | 55.300 | 14.000 |
| −0.100 | 55.656 | 14.000 |
| −0.671 | 55.331 | 14.000 |
| −0.611 | 55.406 | 14.000 |
| −0.484 | 55.224 | 14.000 |
| −0.167 | 55.587 | 14.000 |
| −0.549 | 55.480 | 14.000 |
| −0.836 | 55.093 | 14.000 |
| −0.541 | 55.146 | 14.000 |
| −0.234 | 55.517 | 14.000 |
| −0.596 | 55.067 | 14.000 |
| 0.040 | 55.739 | 14.000 |
| 0.402 | 56.107 | 14.000 |
| 0.226 | 56.203 | 14.000 |
| −0.141 | 55.890 | 14.000 |
| 0.328 | 56.045 | 14.000 |
| −0.069 | 55.954 | 14.000 |
| −0.282 | 55.759 | 14.000 |
| 0.477 | 56.168 | 14.000 |
| 0.255 | 55.983 | 14.000 |
| 0.627 | 56.289 | 14.000 |
| 0.004 | 56.018 | 14.000 |
| 0.182 | 55.919 | 14.000 |
| 0.551 | 56.229 | 14.000 |
| 0.077 | 56.080 | 14.000 |
| −0.212 | 55.825 | 14.000 |
| 0.110 | 55.855 | 14.000 |
| 0.151 | 56.142 | 14.000 |
| 0.301 | 56.263 | 14.000 |
| 1.161 | 56.702 | 14.000 |
| 0.778 | 56.409 | 14.000 |
| 0.837 | 56.673 | 14.000 |
| 0.606 | 56.500 | 14.000 |
| 1.238 | 56.760 | 14.000 |
| 0.854 | 56.468 | 14.000 |
| 0.683 | 56.558 | 14.000 |
| 0.453 | 56.382 | 14.000 |
| 0.702 | 56.349 | 14.000 |
| 1.314 | 56.819 | 14.000 |
| 0.931 | 56.527 | 14.000 |
| 0.992 | 56.788 | 14.000 |
| 0.914 | 56.731 | 14.000 |
| 0.377 | 56.323 | 14.000 |
| 1.007 | 56.585 | 14.000 |
| 0.529 | 56.441 | 14.000 |
| 1.084 | 56.644 | 14.000 |
| 1.070 | 56.845 | 14.000 |
| 0.760 | 56.616 | 14.000 |
| 1.699 | 57.110 | 14.000 |
| 2.005 | 57.344 | 14.000 |
| 1.538 | 57.184 | 14.000 |
| 1.460 | 57.128 | 14.000 |
| 1.622 | 57.052 | 14.000 |
| 1.928 | 57.286 | 14.000 |
| 1.933 | 57.461 | 14.000 |
| 1.304 | 57.015 | 14.000 |
| 1.226 | 56.959 | 14.000 |
| 1.617 | 57.240 | 14.000 |
| 1.148 | 56.902 | 14.000 |
| 1.696 | 57.296 | 14.000 |

TABLE I-continued

| X | Y | Z |
|---|---|---|
| 1.775 | 57.168 | 14.000 |
| 1.391 | 56.877 | 14.000 |
| 2.081 | 57.403 | 14.000 |
| 2.158 | 57.462 | 14.000 |
| 1.382 | 57.072 | 14.000 |
| 1.468 | 56.935 | 14.000 |
| 1.854 | 57.406 | 14.000 |
| 1.775 | 57.351 | 14.000 |
| 1.852 | 57.227 | 14.000 |
| 1.545 | 56.993 | 14.000 |
| 2.092 | 57.570 | 14.000 |
| 2.234 | 57.520 | 14.000 |
| 2.172 | 57.623 | 14.000 |
| 2.013 | 57.515 | 14.000 |
| 2.257 | 57.605 | 14.000 |
| −1.255 | 53.957 | 14.500 |
| −1.275 | 53.486 | 14.500 |
| −1.105 | 53.759 | 14.500 |
| −0.980 | 54.313 | 14.500 |
| −1.239 | 54.051 | 14.500 |
| −1.285 | 53.580 | 14.500 |
| −1.120 | 53.666 | 14.500 |
| −1.008 | 54.222 | 14.500 |
| −1.220 | 54.143 | 14.500 |
| −1.284 | 53.675 | 14.500 |
| −1.137 | 53.573 | 14.500 |
| −1.221 | 53.417 | 14.500 |
| −1.032 | 54.131 | 14.500 |
| −1.199 | 54.236 | 14.500 |
| −1.278 | 53.769 | 14.500 |
| −1.161 | 53.481 | 14.500 |
| −1.054 | 54.039 | 14.500 |
| −1.073 | 53.946 | 14.500 |
| −1.174 | 54.327 | 14.500 |
| −1.268 | 53.864 | 14.500 |
| −1.090 | 53.853 | 14.500 |
| −0.840 | 54.664 | 14.500 |
| −0.751 | 54.832 | 14.500 |
| −1.118 | 54.508 | 14.500 |
| −0.702 | 54.913 | 14.500 |
| −0.877 | 55.021 | 14.500 |
| −1.085 | 54.597 | 14.500 |
| −0.651 | 54.993 | 14.500 |
| −0.879 | 54.578 | 14.500 |
| −1.050 | 54.685 | 14.500 |
| −0.916 | 54.491 | 14.500 |
| −1.011 | 54.771 | 14.500 |
| −0.925 | 54.939 | 14.500 |
| −0.797 | 54.749 | 14.500 |
| −0.950 | 54.403 | 14.500 |
| −0.970 | 54.856 | 14.500 |
| −1.148 | 54.418 | 14.500 |
| −0.485 | 55.222 | 14.500 |
| −0.343 | 55.683 | 14.500 |
| −0.661 | 55.332 | 14.500 |
| −0.235 | 55.507 | 14.500 |
| −0.169 | 55.575 | 14.500 |
| −0.425 | 55.296 | 14.500 |
| −0.601 | 55.405 | 14.500 |
| −0.034 | 55.708 | 14.500 |
| −0.102 | 55.642 | 14.500 |
| −0.363 | 55.367 | 14.500 |
| −0.539 | 55.477 | 14.500 |
| −0.827 | 55.102 | 14.500 |
| −0.300 | 55.438 | 14.500 |
| −0.598 | 55.071 | 14.500 |
| −0.475 | 55.547 | 14.500 |
| −0.774 | 55.180 | 14.500 |
| −0.542 | 55.147 | 14.500 |
| −0.410 | 55.615 | 14.500 |
| −0.719 | 55.257 | 14.500 |
| 0.007 | 56.001 | 14.500 |
| 0.467 | 56.142 | 14.500 |
| 0.079 | 56.062 | 14.500 |
| −0.275 | 55.748 | 14.500 |
| 0.320 | 56.022 | 14.500 |
| 0.105 | 55.836 | 14.500 |

TABLE I-continued

| X | Y | Z |
|---|---|---|
| 0.393 | 56.082 | 14.500 |
| 0.152 | 56.122 | 14.500 |
| −0.206 | 55.813 | 14.500 |
| 0.035 | 55.772 | 14.500 |
| 0.226 | 56.182 | 14.500 |
| 0.614 | 56.260 | 14.500 |
| 0.300 | 56.241 | 14.500 |
| −0.065 | 55.939 | 14.500 |
| −0.136 | 55.877 | 14.500 |
| 0.176 | 55.899 | 14.500 |
| 0.248 | 55.960 | 14.500 |
| 0.540 | 56.201 | 14.500 |
| 0.752 | 56.585 | 14.500 |
| 0.375 | 56.299 | 14.500 |
| 0.839 | 56.434 | 14.500 |
| 1.217 | 56.720 | 14.500 |
| 0.828 | 56.642 | 14.500 |
| 0.449 | 56.357 | 14.500 |
| 0.764 | 56.377 | 14.500 |
| 1.141 | 56.663 | 14.500 |
| 0.904 | 56.698 | 14.500 |
| 0.525 | 56.415 | 14.500 |
| 0.689 | 56.319 | 14.500 |
| 1.065 | 56.606 | 14.500 |
| 0.980 | 56.754 | 14.500 |
| 0.600 | 56.472 | 14.500 |
| 1.292 | 56.776 | 14.500 |
| 0.990 | 56.549 | 14.500 |
| 1.057 | 56.809 | 14.500 |
| 0.676 | 56.529 | 14.500 |
| 1.368 | 56.833 | 14.500 |
| 0.914 | 56.492 | 14.500 |
| 1.595 | 57.004 | 14.500 |
| 1.596 | 57.195 | 14.500 |
| 1.830 | 57.357 | 14.500 |
| 1.211 | 56.920 | 14.500 |
| 2.048 | 57.347 | 14.500 |
| 1.973 | 57.290 | 14.500 |
| 1.822 | 57.175 | 14.500 |
| 1.752 | 57.303 | 14.500 |
| 2.193 | 57.462 | 14.500 |
| 1.287 | 56.976 | 14.500 |
| 1.520 | 56.947 | 14.500 |
| 1.134 | 56.865 | 14.500 |
| 1.519 | 57.140 | 14.500 |
| 1.671 | 57.061 | 14.500 |
| 1.364 | 57.031 | 14.500 |
| 1.908 | 57.410 | 14.500 |
| 1.444 | 56.890 | 14.500 |
| 1.442 | 57.086 | 14.500 |
| 1.674 | 57.249 | 14.500 |
| 2.123 | 57.404 | 14.500 |
| 1.897 | 57.232 | 14.500 |
| 1.746 | 57.118 | 14.500 |
| 1.986 | 57.463 | 14.500 |
| 2.143 | 57.569 | 14.500 |
| 2.064 | 57.517 | 14.500 |
| 2.224 | 57.544 | 14.500 |
| −1.254 | 54.090 | 15.000 |
| −1.300 | 53.816 | 15.000 |
| −1.149 | 53.710 | 15.000 |
| −1.304 | 53.538 | 15.000 |
| −1.051 | 54.164 | 15.000 |
| −1.272 | 53.999 | 15.000 |
| −1.168 | 53.619 | 15.000 |
| −1.075 | 54.074 | 15.000 |
| −1.288 | 53.908 | 15.000 |
| −1.193 | 53.530 | 15.000 |
| −1.096 | 53.983 | 15.000 |
| −1.208 | 54.270 | 15.000 |
| −1.115 | 53.893 | 15.000 |
| −0.995 | 54.341 | 15.000 |
| −1.232 | 54.181 | 15.000 |
| −1.253 | 53.468 | 15.000 |
| −1.133 | 53.801 | 15.000 |
| −1.309 | 53.723 | 15.000 |
| −1.024 | 54.253 | 15.000 |

TABLE I-continued

| X | Y | Z |
|---|---|---|
| −1.312 | 53.630 | 15.000 |
| −1.120 | 54.535 | 15.000 |
| −0.917 | 54.952 | 15.000 |
| −0.887 | 54.598 | 15.000 |
| −1.152 | 54.448 | 15.000 |
| −0.963 | 54.871 | 15.000 |
| −0.846 | 54.681 | 15.000 |
| −0.926 | 54.513 | 15.000 |
| −1.182 | 54.359 | 15.000 |
| −1.007 | 54.789 | 15.000 |
| −0.962 | 54.428 | 15.000 |
| −0.754 | 54.842 | 15.000 |
| −0.652 | 54.998 | 15.000 |
| −1.047 | 54.706 | 15.000 |
| −0.801 | 54.762 | 15.000 |
| −0.704 | 54.921 | 15.000 |
| −1.085 | 54.621 | 15.000 |
| −0.868 | 55.031 | 15.000 |
| −0.763 | 55.184 | 15.000 |
| −0.401 | 55.607 | 15.000 |
| −0.424 | 55.291 | 15.000 |
| −0.170 | 55.562 | 15.000 |
| −0.708 | 55.259 | 15.000 |
| −0.542 | 55.147 | 15.000 |
| −0.465 | 55.540 | 15.000 |
| −0.236 | 55.496 | 15.000 |
| −0.590 | 55.402 | 15.000 |
| −0.037 | 55.691 | 15.000 |
| −0.650 | 55.331 | 15.000 |
| −0.817 | 55.108 | 15.000 |
| −0.268 | 55.736 | 15.000 |
| −0.300 | 55.429 | 15.000 |
| −0.529 | 55.472 | 15.000 |
| −0.598 | 55.073 | 15.000 |
| −0.335 | 55.672 | 15.000 |
| −0.484 | 55.220 | 15.000 |
| −0.362 | 55.360 | 15.000 |
| −0.104 | 55.627 | 15.000 |
| 0.171 | 55.877 | 15.000 |
| −0.061 | 55.923 | 15.000 |
| 0.101 | 55.816 | 15.000 |
| 0.298 | 56.218 | 15.000 |
| 0.456 | 56.115 | 15.000 |
| −0.130 | 55.862 | 15.000 |
| 0.032 | 55.754 | 15.000 |
| 0.384 | 56.057 | 15.000 |
| 0.226 | 56.160 | 15.000 |
| 0.529 | 56.173 | 15.000 |
| −0.200 | 55.800 | 15.000 |
| 0.372 | 56.275 | 15.000 |
| 0.313 | 55.997 | 15.000 |
| 0.675 | 56.288 | 15.000 |
| 0.153 | 56.102 | 15.000 |
| 0.081 | 56.043 | 15.000 |
| 0.241 | 55.938 | 15.000 |
| 0.602 | 56.231 | 15.000 |
| 0.010 | 55.983 | 15.000 |
| 0.897 | 56.457 | 15.000 |
| 0.892 | 56.664 | 15.000 |
| 0.593 | 56.444 | 15.000 |
| 1.118 | 56.828 | 15.000 |
| 1.045 | 56.568 | 15.000 |
| 1.418 | 56.845 | 15.000 |
| 0.519 | 56.388 | 15.000 |
| 0.967 | 56.719 | 15.000 |
| 0.971 | 56.513 | 15.000 |
| 1.343 | 56.790 | 15.000 |
| 0.749 | 56.344 | 15.000 |
| 1.269 | 56.735 | 15.000 |
| 0.445 | 56.331 | 15.000 |
| 0.823 | 56.401 | 15.000 |
| 0.817 | 56.610 | 15.000 |
| 1.194 | 56.679 | 15.000 |
| 0.668 | 56.499 | 15.000 |
| 0.742 | 56.554 | 15.000 |
| 1.120 | 56.624 | 15.000 |
| 1.043 | 56.773 | 15.000 |

TABLE I-continued

| X | Y | Z |
|---|---|---|
| 1.641 | 57.012 | 15.000 |
| 1.497 | 57.096 | 15.000 |
| 1.879 | 57.360 | 15.000 |
| 2.160 | 57.404 | 15.000 |
| 1.790 | 57.124 | 15.000 |
| 1.421 | 57.043 | 15.000 |
| 1.803 | 57.307 | 15.000 |
| 2.189 | 57.484 | 15.000 |
| 1.864 | 57.180 | 15.000 |
| 1.345 | 56.989 | 15.000 |
| 1.726 | 57.255 | 15.000 |
| 2.111 | 57.514 | 15.000 |
| 1.938 | 57.236 | 15.000 |
| 1.716 | 57.068 | 15.000 |
| 1.269 | 56.936 | 15.000 |
| 1.649 | 57.202 | 15.000 |
| 2.033 | 57.464 | 15.000 |
| 1.567 | 56.956 | 15.000 |
| 2.012 | 57.292 | 15.000 |
| 1.193 | 56.882 | 15.000 |
| 1.573 | 57.149 | 15.000 |
| 1.956 | 57.412 | 15.000 |
| 1.493 | 56.901 | 15.000 |
| 2.086 | 57.348 | 15.000 |
| −1.218 | 53.578 | 15.500 |
| −1.114 | 54.021 | 15.500 |
| −1.328 | 53.589 | 15.500 |
| −1.192 | 53.665 | 15.500 |
| −1.333 | 53.680 | 15.500 |
| −1.328 | 53.771 | 15.500 |
| −1.135 | 53.932 | 15.500 |
| −1.241 | 54.218 | 15.500 |
| −1.317 | 53.862 | 15.500 |
| −1.303 | 53.952 | 15.500 |
| −1.173 | 53.754 | 15.500 |
| −1.154 | 53.843 | 15.500 |
| −1.036 | 54.283 | 15.500 |
| −1.285 | 54.041 | 15.500 |
| −1.265 | 54.130 | 15.500 |
| −1.065 | 54.196 | 15.500 |
| −1.215 | 54.305 | 15.500 |
| −1.280 | 53.520 | 15.500 |
| −1.091 | 54.109 | 15.500 |
| −1.043 | 54.726 | 15.500 |
| −0.970 | 54.452 | 15.500 |
| −0.754 | 54.852 | 15.500 |
| −0.955 | 54.886 | 15.500 |
| −1.004 | 54.368 | 15.500 |
| −1.120 | 54.561 | 15.500 |
| −0.802 | 54.775 | 15.500 |
| −0.908 | 54.963 | 15.500 |
| −1.154 | 54.476 | 15.500 |
| −0.848 | 54.697 | 15.500 |
| −0.858 | 55.039 | 15.500 |
| −1.083 | 54.644 | 15.500 |
| −0.891 | 54.617 | 15.500 |
| −0.650 | 55.002 | 15.500 |
| −1.186 | 54.391 | 15.500 |
| −1.000 | 54.806 | 15.500 |
| −0.932 | 54.535 | 15.500 |
| −0.703 | 54.928 | 15.500 |
| −0.752 | 55.188 | 15.500 |
| −0.481 | 55.216 | 15.500 |
| −0.169 | 55.549 | 15.500 |
| −0.391 | 55.597 | 15.500 |
| −0.696 | 55.259 | 15.500 |
| −0.539 | 55.146 | 15.500 |
| −0.234 | 55.484 | 15.500 |
| −0.325 | 55.661 | 15.500 |
| −0.638 | 55.330 | 15.500 |
| −0.596 | 55.075 | 15.500 |
| −0.298 | 55.419 | 15.500 |
| −0.259 | 55.723 | 15.500 |
| 0.030 | 55.735 | 15.500 |
| −0.578 | 55.399 | 15.500 |
| −0.421 | 55.285 | 15.500 |
| −0.360 | 55.353 | 15.500 |

TABLE I-continued

| X | Y | Z |
|---|---|---|
| −0.037 | 55.674 | 15.500 |
| −0.517 | 55.466 | 15.500 |
| −0.806 | 55.114 | 15.500 |
| −0.104 | 55.612 | 15.500 |
| −0.455 | 55.532 | 15.500 |
| 0.236 | 55.915 | 15.500 |
| 0.590 | 56.201 | 15.500 |
| 0.297 | 56.193 | 15.500 |
| −0.055 | 55.905 | 15.500 |
| 0.167 | 55.856 | 15.500 |
| 0.519 | 56.145 | 15.500 |
| 0.369 | 56.249 | 15.500 |
| 0.014 | 55.964 | 15.500 |
| 0.098 | 55.796 | 15.500 |
| 0.448 | 56.088 | 15.500 |
| 0.084 | 56.022 | 15.500 |
| 0.377 | 56.031 | 15.500 |
| 0.155 | 56.080 | 15.500 |
| −0.192 | 55.785 | 15.500 |
| 0.306 | 55.973 | 15.500 |
| 0.662 | 56.257 | 15.500 |
| 0.226 | 56.137 | 15.500 |
| −0.124 | 55.845 | 15.500 |
| 0.880 | 56.631 | 15.500 |
| 0.953 | 56.476 | 15.500 |
| 0.735 | 56.312 | 15.500 |
| 0.806 | 56.577 | 15.500 |
| 1.176 | 56.843 | 15.500 |
| 0.880 | 56.422 | 15.500 |
| 1.246 | 56.693 | 15.500 |
| 0.733 | 56.523 | 15.500 |
| 1.102 | 56.790 | 15.500 |
| 1.319 | 56.747 | 15.500 |
| 0.807 | 56.367 | 15.500 |
| 1.172 | 56.639 | 15.500 |
| 0.441 | 56.305 | 15.500 |
| 0.660 | 56.469 | 15.500 |
| 1.028 | 56.737 | 15.500 |
| 1.099 | 56.585 | 15.500 |
| 0.514 | 56.360 | 15.500 |
| 0.954 | 56.684 | 15.500 |
| 1.026 | 56.531 | 15.500 |
| 1.392 | 56.801 | 15.500 |
| 0.587 | 56.414 | 15.500 |
| 1.250 | 56.896 | 15.500 |
| 1.685 | 57.018 | 15.500 |
| 2.049 | 57.292 | 15.500 |
| 1.549 | 57.104 | 15.500 |
| 1.926 | 57.360 | 15.500 |
| 1.612 | 56.964 | 15.500 |
| 1.976 | 57.237 | 15.500 |
| 1.474 | 57.052 | 15.500 |
| 1.850 | 57.309 | 15.500 |
| 1.539 | 56.909 | 15.500 |
| 1.903 | 57.182 | 15.500 |
| 2.078 | 57.459 | 15.500 |
| 1.399 | 57.000 | 15.500 |
| 1.775 | 57.258 | 15.500 |
| 2.001 | 57.411 | 15.500 |
| 1.466 | 56.855 | 15.500 |
| 1.831 | 57.128 | 15.500 |
| 2.153 | 57.425 | 15.500 |
| 1.624 | 57.156 | 15.500 |
| 1.325 | 56.948 | 15.500 |
| 1.699 | 57.207 | 15.500 |
| 1.758 | 57.073 | 15.500 |
| 2.121 | 57.347 | 15.500 |
| −1.239 | 53.626 | 16.000 |
| −1.127 | 54.058 | 16.000 |
| −1.246 | 54.254 | 16.000 |
| −1.314 | 53.995 | 16.000 |
| −1.211 | 53.711 | 16.000 |
| −1.150 | 53.972 | 16.000 |
| −1.294 | 54.082 | 16.000 |
| −1.171 | 53.885 | 16.000 |
| −1.043 | 54.312 | 16.000 |
| −1.272 | 54.169 | 16.000 |

TABLE I-continued

| X | Y | Z |
|---|---|---|
| −1.346 | 53.641 | 16.000 |
| −1.301 | 53.571 | 16.000 |
| −1.190 | 53.798 | 16.000 |
| −1.074 | 54.229 | 16.000 |
| −1.342 | 53.819 | 16.000 |
| −1.350 | 53.730 | 16.000 |
| −1.218 | 54.339 | 16.000 |
| −1.102 | 54.144 | 16.000 |
| −1.330 | 53.908 | 16.000 |
| −0.973 | 54.476 | 16.000 |
| −1.078 | 54.667 | 16.000 |
| −0.846 | 55.048 | 16.000 |
| −0.750 | 54.862 | 16.000 |
| −1.117 | 54.587 | 16.000 |
| −0.897 | 54.975 | 16.000 |
| −1.010 | 54.395 | 16.000 |
| −0.800 | 54.788 | 16.000 |
| −1.153 | 54.505 | 16.000 |
| −0.946 | 54.900 | 16.000 |
| −0.847 | 54.712 | 16.000 |
| −1.187 | 54.423 | 16.000 |
| −0.992 | 54.824 | 16.000 |
| −0.892 | 54.635 | 16.000 |
| −0.645 | 55.007 | 16.000 |
| −1.036 | 54.746 | 16.000 |
| −0.934 | 54.556 | 16.000 |
| −0.699 | 54.935 | 16.000 |
| −0.416 | 55.280 | 16.000 |
| −0.101 | 55.597 | 16.000 |
| −0.249 | 55.710 | 16.000 |
| −0.682 | 55.260 | 16.000 |
| −0.475 | 55.213 | 16.000 |
| −0.166 | 55.535 | 16.000 |
| −0.315 | 55.649 | 16.000 |
| −0.625 | 55.328 | 16.000 |
| −0.379 | 55.587 | 16.000 |
| −0.533 | 55.146 | 16.000 |
| −0.230 | 55.473 | 16.000 |
| −0.739 | 55.191 | 16.000 |
| −0.590 | 55.077 | 16.000 |
| −0.293 | 55.410 | 16.000 |
| 0.031 | 55.717 | 16.000 |
| −0.793 | 55.120 | 16.000 |
| −0.442 | 55.524 | 16.000 |
| −0.355 | 55.345 | 16.000 |
| −0.036 | 55.657 | 16.000 |
| −0.565 | 55.394 | 16.000 |
| −0.504 | 55.460 | 16.000 |
| 0.088 | 56.001 | 16.000 |
| 0.234 | 55.892 | 16.000 |
| 0.582 | 56.171 | 16.000 |
| 0.098 | 55.776 | 16.000 |
| 0.020 | 55.944 | 16.000 |
| 0.166 | 55.834 | 16.000 |
| 0.511 | 56.116 | 16.000 |
| −0.049 | 55.887 | 16.000 |
| 0.298 | 56.168 | 16.000 |
| 0.441 | 56.061 | 16.000 |
| −0.116 | 55.828 | 16.000 |
| 0.368 | 56.223 | 16.000 |
| 0.227 | 56.113 | 16.000 |
| 0.372 | 56.005 | 16.000 |
| 0.723 | 56.280 | 16.000 |
| 0.439 | 56.277 | 16.000 |
| 0.158 | 56.058 | 16.000 |
| 0.302 | 55.948 | 16.000 |
| 0.652 | 56.226 | 16.000 |
| −0.183 | 55.769 | 16.000 |
| 0.510 | 56.331 | 16.000 |
| 0.938 | 56.440 | 16.000 |
| 1.297 | 56.705 | 16.000 |
| 0.941 | 56.649 | 16.000 |
| 0.581 | 56.385 | 16.000 |
| 0.866 | 56.387 | 16.000 |
| 1.225 | 56.652 | 16.000 |
| 1.014 | 56.701 | 16.000 |
| 0.653 | 56.438 | 16.000 |

TABLE I-continued

| X | Y | Z |
|---|---|---|
| 0.794 | 56.333 | 16.000 |
| 1.153 | 56.599 | 16.000 |
| 1.087 | 56.752 | 16.000 |
| 0.725 | 56.491 | 16.000 |
| 1.081 | 56.546 | 16.000 |
| 1.441 | 56.810 | 16.000 |
| 1.159 | 56.804 | 16.000 |
| 0.797 | 56.544 | 16.000 |
| 1.009 | 56.493 | 16.000 |
| 1.369 | 56.758 | 16.000 |
| 0.869 | 56.596 | 16.000 |
| 1.970 | 57.358 | 16.000 |
| 2.013 | 57.237 | 16.000 |
| 1.656 | 56.969 | 16.000 |
| 1.673 | 57.159 | 16.000 |
| 1.306 | 56.907 | 16.000 |
| 1.896 | 57.309 | 16.000 |
| 2.085 | 57.291 | 16.000 |
| 1.585 | 56.916 | 16.000 |
| 1.379 | 56.958 | 16.000 |
| 1.871 | 57.130 | 16.000 |
| 1.942 | 57.183 | 16.000 |
| 2.117 | 57.367 | 16.000 |
| 1.513 | 56.863 | 16.000 |
| 1.452 | 57.008 | 16.000 |
| 1.747 | 57.209 | 16.000 |
| 2.046 | 57.405 | 16.000 |
| 1.526 | 57.059 | 16.000 |
| 1.822 | 57.259 | 16.000 |
| 1.799 | 57.076 | 16.000 |
| 1.728 | 57.023 | 16.000 |
| 1.600 | 57.109 | 16.000 |
| 1.232 | 56.856 | 16.000 |
| −1.203 | 53.842 | 16.500 |
| −1.248 | 54.291 | 16.500 |
| −1.353 | 53.867 | 16.500 |
| −1.160 | 54.012 | 16.500 |
| −1.339 | 53.954 | 16.500 |
| −1.135 | 54.096 | 16.500 |
| −1.046 | 54.342 | 16.500 |
| −1.321 | 54.039 | 16.500 |
| −1.109 | 54.179 | 16.500 |
| −1.317 | 53.624 | 16.500 |
| −1.254 | 53.675 | 16.500 |
| −1.300 | 54.124 | 16.500 |
| −1.182 | 53.927 | 16.500 |
| −1.360 | 53.693 | 16.500 |
| −1.079 | 54.261 | 16.500 |
| −1.275 | 54.208 | 16.500 |
| −1.362 | 53.781 | 16.500 |
| −1.225 | 53.758 | 16.500 |
| −0.842 | 54.728 | 16.500 |
| −0.972 | 54.501 | 16.500 |
| −0.794 | 54.801 | 16.500 |
| −1.027 | 54.766 | 16.500 |
| −1.218 | 54.373 | 16.500 |
| −0.743 | 54.872 | 16.500 |
| −0.982 | 54.841 | 16.500 |
| −1.185 | 54.454 | 16.500 |
| −0.888 | 54.654 | 16.500 |
| −0.637 | 55.011 | 16.500 |
| −0.934 | 54.914 | 16.500 |
| −1.149 | 54.534 | 16.500 |
| −1.011 | 54.422 | 16.500 |
| −0.884 | 54.986 | 16.500 |
| −1.111 | 54.613 | 16.500 |
| −0.931 | 54.578 | 16.500 |
| −1.070 | 54.690 | 16.500 |
| −0.691 | 54.943 | 16.500 |
| −0.160 | 55.522 | 16.500 |
| −0.490 | 55.453 | 16.500 |
| −0.779 | 55.126 | 16.500 |
| −0.407 | 55.275 | 16.500 |
| −0.096 | 55.582 | 16.500 |
| −0.428 | 55.515 | 16.500 |
| −0.724 | 55.194 | 16.500 |
| −0.285 | 55.400 | 16.500 |

TABLE I-continued

| X | Y | Z |
|---|---|---|
| −0.582 | 55.079 | 16.500 |
| −0.366 | 55.576 | 16.500 |
| −0.668 | 55.260 | 16.500 |
| −0.467 | 55.211 | 16.500 |
| −0.525 | 55.145 | 16.500 |
| 0.034 | 55.698 | 16.500 |
| −0.302 | 55.636 | 16.500 |
| −0.610 | 55.326 | 16.500 |
| −0.031 | 55.640 | 16.500 |
| −0.238 | 55.695 | 16.500 |
| −0.550 | 55.390 | 16.500 |
| −0.223 | 55.462 | 16.500 |
| −0.833 | 55.056 | 16.500 |
| −0.347 | 55.338 | 16.500 |
| 0.301 | 55.924 | 16.500 |
| 0.163 | 56.034 | 16.500 |
| −0.172 | 55.753 | 16.500 |
| 0.231 | 56.089 | 16.500 |
| −0.106 | 55.811 | 16.500 |
| 0.100 | 55.756 | 16.500 |
| 0.645 | 56.195 | 16.500 |
| 0.300 | 56.143 | 16.500 |
| −0.040 | 55.868 | 16.500 |
| 0.438 | 56.034 | 16.500 |
| 0.167 | 55.812 | 16.500 |
| 0.234 | 55.869 | 16.500 |
| 0.369 | 56.196 | 16.500 |
| 0.576 | 56.141 | 16.500 |
| 0.027 | 55.924 | 16.500 |
| 0.714 | 56.247 | 16.500 |
| 0.439 | 56.249 | 16.500 |
| 0.369 | 55.979 | 16.500 |
| 0.095 | 55.979 | 16.500 |
| 0.506 | 56.088 | 16.500 |
| 0.508 | 56.302 | 16.500 |
| 1.065 | 56.508 | 16.500 |
| 1.489 | 56.818 | 16.500 |
| 0.931 | 56.613 | 16.500 |
| 0.578 | 56.355 | 16.500 |
| 1.418 | 56.766 | 16.500 |
| 1.002 | 56.664 | 16.500 |
| 0.648 | 56.407 | 16.500 |
| 1.216 | 56.815 | 16.500 |
| 0.925 | 56.404 | 16.500 |
| 0.854 | 56.352 | 16.500 |
| 1.348 | 56.714 | 16.500 |
| 0.995 | 56.456 | 16.500 |
| 1.073 | 56.714 | 16.500 |
| 0.719 | 56.459 | 16.500 |
| 0.784 | 56.300 | 16.500 |
| 1.277 | 56.663 | 16.500 |
| 1.136 | 56.560 | 16.500 |
| 1.145 | 56.765 | 16.500 |
| 0.789 | 56.510 | 16.500 |
| 1.207 | 56.611 | 16.500 |
| 0.860 | 56.562 | 16.500 |
| 1.840 | 57.078 | 16.500 |
| 2.083 | 57.309 | 16.500 |
| 2.015 | 57.350 | 16.500 |
| 1.649 | 57.111 | 16.500 |
| 1.283 | 56.865 | 16.500 |
| 1.770 | 57.025 | 16.500 |
| 1.432 | 56.964 | 16.500 |
| 1.722 | 57.160 | 16.500 |
| 1.360 | 56.915 | 16.500 |
| 1.700 | 56.973 | 16.500 |
| 2.051 | 57.235 | 16.500 |
| 1.794 | 57.209 | 16.500 |
| 1.630 | 56.921 | 16.500 |
| 1.981 | 57.182 | 16.500 |
| 1.867 | 57.257 | 16.500 |
| 1.504 | 57.014 | 16.500 |
| 1.559 | 56.869 | 16.500 |
| 1.910 | 57.130 | 16.500 |
| 1.940 | 57.305 | 16.500 |
| 1.577 | 57.063 | 16.500 |
| −1.080 | 54.294 | 17.000 |

TABLE I-continued

| X | Y | Z |
|---|---|---|
| −1.301 | 54.166 | 17.000 |
| −1.235 | 53.805 | 17.000 |
| −1.369 | 53.832 | 17.000 |
| −1.111 | 54.214 | 17.000 |
| −1.343 | 54.001 | 17.000 |
| −1.189 | 53.970 | 17.000 |
| −1.166 | 54.052 | 17.000 |
| −1.212 | 53.887 | 17.000 |
| −1.328 | 53.677 | 17.000 |
| −1.140 | 54.134 | 17.000 |
| −1.359 | 53.916 | 17.000 |
| −1.369 | 53.746 | 17.000 |
| −1.265 | 53.725 | 17.000 |
| −1.246 | 54.329 | 17.000 |
| −1.324 | 54.084 | 17.000 |
| −1.275 | 54.248 | 17.000 |
| −0.734 | 54.883 | 17.000 |
| −1.016 | 54.786 | 17.000 |
| −0.627 | 55.016 | 17.000 |
| −1.142 | 54.563 | 17.000 |
| −0.785 | 54.814 | 17.000 |
| −0.681 | 54.950 | 17.000 |
| −0.834 | 54.744 | 17.000 |
| −1.045 | 54.372 | 17.000 |
| −1.060 | 54.713 | 17.000 |
| −1.214 | 54.408 | 17.000 |
| −0.869 | 54.997 | 17.000 |
| −0.881 | 54.672 | 17.000 |
| −1.180 | 54.486 | 17.000 |
| −0.926 | 54.599 | 17.000 |
| −0.968 | 54.525 | 17.000 |
| −0.969 | 54.858 | 17.000 |
| −0.920 | 54.928 | 17.000 |
| −1.008 | 54.449 | 17.000 |
| −1.102 | 54.639 | 17.000 |
| −0.651 | 55.261 | 17.000 |
| −0.159 | 55.737 | 17.000 |
| −0.397 | 55.270 | 17.000 |
| −0.534 | 55.385 | 17.000 |
| −0.287 | 55.623 | 17.000 |
| −0.412 | 55.506 | 17.000 |
| −0.025 | 55.624 | 17.000 |
| −0.215 | 55.450 | 17.000 |
| −0.456 | 55.208 | 17.000 |
| −0.337 | 55.331 | 17.000 |
| −0.473 | 55.446 | 17.000 |
| −0.593 | 55.323 | 17.000 |
| 0.104 | 55.736 | 17.000 |
| −0.152 | 55.509 | 17.000 |
| −0.707 | 55.196 | 17.000 |
| −0.763 | 55.131 | 17.000 |
| 0.039 | 55.680 | 17.000 |
| −0.817 | 55.065 | 17.000 |
| −0.514 | 55.145 | 17.000 |
| −0.350 | 55.565 | 17.000 |
| −0.571 | 55.081 | 17.000 |
| −0.276 | 55.391 | 17.000 |
| −0.224 | 55.680 | 17.000 |
| −0.089 | 55.567 | 17.000 |
| 0.170 | 56.010 | 17.000 |
| −0.029 | 55.848 | 17.000 |
| 0.503 | 56.059 | 17.000 |
| 0.639 | 56.164 | 17.000 |
| 0.372 | 56.168 | 17.000 |
| 0.304 | 56.116 | 17.000 |
| 0.103 | 55.956 | 17.000 |
| 0.170 | 55.791 | 17.000 |
| −0.094 | 55.792 | 17.000 |
| 0.571 | 56.112 | 17.000 |
| 0.440 | 56.220 | 17.000 |
| 0.237 | 56.063 | 17.000 |
| 0.302 | 55.900 | 17.000 |
| 0.235 | 55.846 | 17.000 |
| 0.707 | 56.215 | 17.000 |
| 0.775 | 56.267 | 17.000 |
| 0.037 | 55.902 | 17.000 |
| 0.436 | 56.006 | 17.000 |

TABLE I-continued

| X | Y | Z |
|---|---|---|
| 0.508 | 56.272 | 17.000 |
| 0.368 | 55.953 | 17.000 |
| 0.577 | 56.323 | 17.000 |
| 1.131 | 56.725 | 17.000 |
| 1.061 | 56.675 | 17.000 |
| 1.466 | 56.772 | 17.000 |
| 0.922 | 56.576 | 17.000 |
| 1.327 | 56.672 | 17.000 |
| 1.201 | 56.774 | 17.000 |
| 0.913 | 56.369 | 17.000 |
| 1.272 | 56.823 | 17.000 |
| 1.258 | 56.621 | 17.000 |
| 1.189 | 56.571 | 17.000 |
| 0.853 | 56.526 | 17.000 |
| 1.535 | 56.823 | 17.000 |
| 0.645 | 56.374 | 17.000 |
| 0.714 | 56.425 | 17.000 |
| 0.981 | 56.419 | 17.000 |
| 1.120 | 56.521 | 17.000 |
| 0.783 | 56.476 | 17.000 |
| 0.992 | 56.626 | 17.000 |
| 1.396 | 56.722 | 17.000 |
| 0.844 | 56.318 | 17.000 |
| 1.050 | 56.470 | 17.000 |
| 1.810 | 57.026 | 17.000 |
| 1.604 | 56.873 | 17.000 |
| 1.626 | 57.063 | 17.000 |
| 1.879 | 57.077 | 17.000 |
| 1.911 | 57.252 | 17.000 |
| 1.484 | 56.967 | 17.000 |
| 2.050 | 57.251 | 17.000 |
| 2.017 | 57.179 | 17.000 |
| 1.840 | 57.205 | 17.000 |
| 1.555 | 57.015 | 17.000 |
| 1.697 | 57.110 | 17.000 |
| 1.742 | 56.975 | 17.000 |
| 1.413 | 56.919 | 17.000 |
| 1.948 | 57.128 | 17.000 |
| 1.985 | 57.294 | 17.000 |
| 1.768 | 57.158 | 17.000 |
| 1.342 | 56.871 | 17.000 |
| 1.673 | 56.924 | 17.000 |
| −1.298 | 54.209 | 17.500 |
| −1.343 | 54.048 | 17.500 |
| −1.270 | 54.288 | 17.500 |
| −1.168 | 54.094 | 17.500 |
| −1.371 | 53.883 | 17.500 |
| −1.373 | 53.800 | 17.500 |
| −1.141 | 54.173 | 17.500 |
| −1.272 | 53.776 | 17.500 |
| −1.322 | 54.129 | 17.500 |
| −1.111 | 54.251 | 17.500 |
| −1.241 | 53.854 | 17.500 |
| −1.335 | 53.731 | 17.500 |
| −1.359 | 53.966 | 17.500 |
| −1.073 | 54.328 | 17.500 |
| −1.217 | 53.934 | 17.500 |
| −1.193 | 54.014 | 17.500 |
| −0.774 | 54.827 | 17.500 |
| −1.003 | 54.477 | 17.500 |
| −1.170 | 54.519 | 17.500 |
| −1.132 | 54.593 | 17.500 |
| −1.047 | 54.737 | 17.500 |
| −0.723 | 54.893 | 17.500 |
| −1.240 | 54.366 | 17.500 |
| −0.903 | 54.942 | 17.500 |
| −0.962 | 54.550 | 17.500 |
| −0.953 | 54.875 | 17.500 |
| −0.670 | 54.958 | 17.500 |
| −0.918 | 54.621 | 17.500 |
| −1.001 | 54.807 | 17.500 |
| −1.207 | 54.443 | 17.500 |
| −0.615 | 55.021 | 17.500 |
| −0.872 | 54.691 | 17.500 |
| −1.090 | 54.665 | 17.500 |
| −0.824 | 54.760 | 17.500 |
| −1.042 | 54.403 | 17.500 |

TABLE I-continued

| X | Y | Z |
|---|---|---|
| −0.851 | 55.008 | 17.500 |
| −0.454 | 55.438 | 17.500 |
| −0.744 | 55.136 | 17.500 |
| −0.144 | 55.719 | 17.500 |
| 0.108 | 55.716 | 17.500 |
| −0.206 | 55.439 | 17.500 |
| −0.503 | 55.145 | 17.500 |
| −0.631 | 55.260 | 17.500 |
| −0.207 | 55.664 | 17.500 |
| −0.144 | 55.496 | 17.500 |
| −0.327 | 55.324 | 17.500 |
| −0.514 | 55.380 | 17.500 |
| −0.445 | 55.206 | 17.500 |
| −0.270 | 55.609 | 17.500 |
| −0.573 | 55.320 | 17.500 |
| −0.082 | 55.552 | 17.500 |
| −0.386 | 55.265 | 17.500 |
| −0.332 | 55.553 | 17.500 |
| −0.019 | 55.607 | 17.500 |
| −0.688 | 55.199 | 17.500 |
| −0.394 | 55.496 | 17.500 |
| −0.798 | 55.073 | 17.500 |
| 0.044 | 55.662 | 17.500 |
| −0.560 | 55.084 | 17.500 |
| −0.267 | 55.382 | 17.500 |
| 0.765 | 56.233 | 17.500 |
| 0.433 | 55.979 | 17.500 |
| 0.179 | 55.985 | 17.500 |
| 0.510 | 56.240 | 17.500 |
| 0.832 | 56.283 | 17.500 |
| 0.499 | 56.031 | 17.500 |
| 0.114 | 55.932 | 17.500 |
| 0.172 | 55.769 | 17.500 |
| 0.443 | 56.190 | 17.500 |
| 0.565 | 56.082 | 17.500 |
| 0.049 | 55.880 | 17.500 |
| 0.237 | 55.823 | 17.500 |
| 0.377 | 56.139 | 17.500 |
| 0.632 | 56.133 | 17.500 |
| 0.302 | 55.875 | 17.500 |
| 0.310 | 56.088 | 17.500 |
| −0.016 | 55.826 | 17.500 |
| 0.698 | 56.183 | 17.500 |
| −0.080 | 55.773 | 17.500 |
| 0.367 | 55.927 | 17.500 |
| 0.245 | 56.036 | 17.500 |
| 0.577 | 56.291 | 17.500 |
| 1.187 | 56.731 | 17.500 |
| 1.509 | 56.776 | 17.500 |
| 1.170 | 56.530 | 17.500 |
| 1.441 | 56.727 | 17.500 |
| 0.778 | 56.440 | 17.500 |
| 1.119 | 56.683 | 17.500 |
| 0.346 | 56.489 | 17.500 |
| 1.576 | 56.825 | 17.500 |
| 1.238 | 56.580 | 17.500 |
| 0.900 | 56.333 | 17.500 |
| 0.711 | 56.390 | 17.500 |
| 1.050 | 56.635 | 17.500 |
| 1.305 | 56.629 | 17.500 |
| 0.967 | 56.383 | 17.500 |
| 0.644 | 56.341 | 17.500 |
| 0.982 | 56.587 | 17.500 |
| 1.325 | 56.826 | 17.500 |
| 1.373 | 56.678 | 17.500 |
| 1.035 | 56.432 | 17.500 |
| 0.914 | 56.538 | 17.500 |
| 1.256 | 56.779 | 17.500 |
| 1.102 | 56.481 | 17.500 |
| 1.533 | 56.967 | 17.500 |
| 1.882 | 57.197 | 17.500 |
| 1.846 | 57.023 | 17.500 |
| 1.981 | 57.122 | 17.500 |
| 1.464 | 56.920 | 17.500 |
| 1.812 | 57.151 | 17.500 |
| 1.913 | 57.073 | 17.500 |
| 1.394 | 56.873 | 17.500 |

TABLE I-continued

| X | Y | Z |
|---|---|---|
| 1.742 | 57.105 | 17.500 |
| 1.644 | 56.875 | 17.500 |
| 1.779 | 56.973 | 17.500 |
| 1.672 | 57.059 | 17.500 |
| 2.016 | 57.192 | 17.500 |
| 1.711 | 56.924 | 17.500 |
| 1.603 | 57.013 | 17.500 |
| 1.955 | 57.237 | 17.500 |
| −1.368 | 53.936 | 18.000 |
| −1.316 | 54.175 | 18.000 |
| −1.193 | 54.059 | 18.000 |
| −1.262 | 54.330 | 18.000 |
| −1.218 | 53.981 | 18.000 |
| −1.372 | 53.855 | 18.000 |
| −1.356 | 54.017 | 18.000 |
| −1.338 | 54.097 | 18.000 |
| −1.243 | 53.904 | 18.000 |
| −1.107 | 54.288 | 18.000 |
| −1.291 | 54.253 | 18.000 |
| −1.275 | 53.828 | 18.000 |
| −1.138 | 54.213 | 18.000 |
| −1.337 | 53.787 | 18.000 |
| −1.167 | 54.136 | 18.000 |
| −0.983 | 54.827 | 18.000 |
| −1.118 | 54.622 | 18.000 |
| −1.035 | 54.435 | 18.000 |
| −0.811 | 54.776 | 18.000 |
| −1.158 | 54.551 | 18.000 |
| −0.761 | 54.840 | 18.000 |
| −0.656 | 54.965 | 18.000 |
| −1.072 | 54.362 | 18.000 |
| −0.860 | 54.711 | 18.000 |
| −0.602 | 55.026 | 18.000 |
| −1.075 | 54.692 | 18.000 |
| −1.031 | 54.760 | 18.000 |
| −0.709 | 54.903 | 18.000 |
| −0.907 | 54.644 | 18.000 |
| −0.884 | 54.956 | 18.000 |
| −0.831 | 55.019 | 18.000 |
| −0.934 | 54.892 | 18.000 |
| −0.952 | 54.575 | 18.000 |
| −1.230 | 54.405 | 18.000 |
| −1.196 | 54.479 | 18.000 |
| −0.994 | 54.506 | 18.000 |
| −0.490 | 55.145 | 18.000 |
| −0.610 | 55.259 | 18.000 |
| −0.196 | 55.429 | 18.000 |
| 0.113 | 55.696 | 18.000 |
| −0.128 | 55.700 | 18.000 |
| −0.546 | 55.086 | 18.000 |
| −0.256 | 55.373 | 18.000 |
| 0.050 | 55.644 | 18.000 |
| −0.315 | 55.317 | 18.000 |
| −0.012 | 55.591 | 18.000 |
| −0.313 | 55.540 | 18.000 |
| −0.434 | 55.430 | 18.000 |
| −0.494 | 55.374 | 18.000 |
| −0.252 | 55.594 | 18.000 |
| −0.374 | 55.261 | 18.000 |
| −0.667 | 55.201 | 18.000 |
| −0.778 | 55.031 | 18.000 |
| −0.074 | 55.537 | 18.000 |
| −0.723 | 55.141 | 18.000 |
| −0.190 | 55.647 | 18.000 |
| −0.432 | 55.203 | 18.000 |
| −0.374 | 55.485 | 18.000 |
| −0.135 | 55.483 | 18.000 |
| −0.552 | 55.317 | 18.000 |
| 0.367 | 55.902 | 18.000 |
| 0.176 | 55.748 | 18.000 |
| 0.303 | 55.851 | 18.000 |
| −0.066 | 55.752 | 18.000 |
| 0.560 | 56.052 | 18.000 |
| 0.821 | 56.249 | 18.000 |
| 0.756 | 56.200 | 18.000 |
| 0.252 | 56.009 | 18.000 |
| 0.239 | 55.800 | 18.000 |

TABLE I-continued

| X | Y | Z |
|---|---|---|
| 0.124 | 55.907 | 18.000 |
| 0.061 | 55.856 | 18.000 |
| 0.431 | 55.952 | 18.000 |
| 0.381 | 56.109 | 18.000 |
| 0.625 | 56.102 | 18.000 |
| 0.188 | 55.958 | 18.000 |
| 0.003 | 55.804 | 18.000 |
| 0.496 | 56.002 | 18.000 |
| 0.690 | 56.151 | 18.000 |
| 0.511 | 56.208 | 18.000 |
| 0.446 | 56.159 | 18.000 |
| 0.317 | 56.059 | 18.000 |
| 0.576 | 56.257 | 18.000 |
| 1.172 | 56.688 | 18.000 |
| 0.887 | 56.297 | 18.000 |
| 0.972 | 56.547 | 18.000 |
| 0.839 | 56.451 | 18.000 |
| 1.614 | 56.825 | 18.000 |
| 0.905 | 56.499 | 18.000 |
| 1.482 | 56.729 | 18.000 |
| 0.773 | 56.403 | 18.000 |
| 1.548 | 56.777 | 18.000 |
| 1.349 | 56.633 | 18.000 |
| 1.283 | 56.586 | 18.000 |
| 1.019 | 56.394 | 18.000 |
| 1.105 | 56.641 | 18.000 |
| 1.217 | 56.538 | 18.000 |
| 1.307 | 56.780 | 18.000 |
| 1.151 | 56.490 | 18.000 |
| 1.415 | 56.681 | 18.000 |
| 0.707 | 56.355 | 18.000 |
| 1.375 | 56.826 | 18.000 |
| 0.642 | 56.306 | 18.000 |
| 1.239 | 56.734 | 18.000 |
| 1.085 | 56.442 | 18.000 |
| 0.953 | 56.346 | 18.000 |
| 1.038 | 56.594 | 18.000 |
| 1.680 | 56.873 | 18.000 |
| 1.579 | 56.961 | 18.000 |
| 1.878 | 57.017 | 18.000 |
| 1.783 | 57.096 | 18.000 |
| 1.715 | 57.051 | 18.000 |
| 1.510 | 56.916 | 18.000 |
| 1.923 | 57.179 | 18.000 |
| 1.746 | 56.921 | 18.000 |
| 1.944 | 57.066 | 18.000 |
| 1.852 | 57.140 | 18.000 |
| 1.647 | 57.006 | 18.000 |
| 1.442 | 56.871 | 18.000 |
| 1.812 | 56.969 | 18.000 |
| 1.981 | 57.132 | 18.000 |
| −1.270 | 53.832 | 18.500 |
| −1.333 | 53.844 | 18.500 |
| −1.331 | 54.146 | 18.500 |
| −1.212 | 54.030 | 18.500 |
| −1.367 | 53.911 | 18.500 |
| −1.128 | 54.253 | 18.500 |
| −1.095 | 54.326 | 18.500 |
| −1.364 | 53.990 | 18.500 |
| −1.186 | 54.105 | 18.500 |
| −1.350 | 54.069 | 18.500 |
| −1.309 | 54.222 | 18.500 |
| −1.238 | 53.955 | 18.500 |
| −1.282 | 54.297 | 18.500 |
| −1.158 | 54.180 | 18.500 |
| −0.813 | 55.031 | 18.500 |
| −0.890 | 54.667 | 18.500 |
| −0.936 | 54.601 | 18.500 |
| −1.220 | 54.444 | 18.500 |
| −1.146 | 54.585 | 18.500 |
| −0.583 | 55.032 | 18.500 |
| −0.866 | 54.971 | 18.500 |
| −0.742 | 54.854 | 18.500 |
| −1.184 | 54.515 | 18.500 |
| −1.021 | 54.467 | 18.500 |
| −0.842 | 54.730 | 18.500 |
| −0.967 | 54.848 | 18.500 |

TABLE I-continued

| X | Y | Z |
|---|---|---|
| −1.105 | 54.653 | 18.500 |
| −0.690 | 54.915 | 18.500 |
| −1.061 | 54.720 | 18.500 |
| −1.015 | 54.785 | 18.500 |
| −0.979 | 54.535 | 18.500 |
| −1.059 | 54.397 | 18.500 |
| −0.917 | 54.910 | 18.500 |
| −0.793 | 54.793 | 18.500 |
| −1.253 | 54.371 | 18.500 |
| −0.637 | 54.974 | 18.500 |
| −0.299 | 55.311 | 18.500 |
| −0.357 | 55.257 | 18.500 |
| 0.000 | 55.575 | 18.500 |
| −0.181 | 55.418 | 18.500 |
| −0.298 | 55.528 | 18.500 |
| −0.116 | 55.683 | 18.500 |
| −0.534 | 55.315 | 18.500 |
| −0.592 | 55.260 | 18.500 |
| 0.184 | 55.727 | 18.500 |
| −0.415 | 55.202 | 18.500 |
| −0.704 | 55.147 | 18.500 |
| −0.358 | 55.476 | 18.500 |
| −0.054 | 55.734 | 18.500 |
| −0.238 | 55.580 | 18.500 |
| −0.649 | 55.204 | 18.500 |
| −0.472 | 55.146 | 18.500 |
| −0.417 | 55.423 | 18.500 |
| 0.061 | 55.626 | 18.500 |
| −0.759 | 55.090 | 18.500 |
| −0.240 | 55.365 | 18.500 |
| −0.061 | 55.523 | 18.500 |
| −0.121 | 55.471 | 18.500 |
| −0.177 | 55.632 | 18.500 |
| −0.476 | 55.369 | 18.500 |
| 0.122 | 55.677 | 18.500 |
| −0.528 | 55.089 | 18.500 |
| 0.194 | 55.933 | 18.500 |
| 0.433 | 55.925 | 18.500 |
| 0.623 | 56.070 | 18.500 |
| 0.246 | 55.777 | 18.500 |
| 0.446 | 56.129 | 18.500 |
| 0.686 | 56.118 | 18.500 |
| 0.878 | 56.261 | 18.500 |
| 0.370 | 55.876 | 18.500 |
| 0.319 | 56.031 | 18.500 |
| 0.750 | 56.166 | 18.500 |
| 0.559 | 56.022 | 18.500 |
| 0.573 | 56.225 | 18.500 |
| 0.636 | 56.272 | 18.500 |
| 0.257 | 55.983 | 18.500 |
| 0.069 | 55.834 | 18.500 |
| 0.509 | 56.177 | 18.500 |
| 0.132 | 55.884 | 18.500 |
| 0.814 | 56.213 | 18.500 |
| 0.382 | 56.080 | 18.500 |
| 0.496 | 55.974 | 18.500 |
| 0.308 | 55.827 | 18.500 |
| 0.007 | 55.784 | 18.500 |
| 1.394 | 56.634 | 18.500 |
| 1.523 | 56.727 | 18.500 |
| 1.023 | 56.553 | 18.500 |
| 1.154 | 56.644 | 18.500 |
| 1.071 | 56.402 | 18.500 |
| 1.418 | 56.822 | 18.500 |
| 0.764 | 56.367 | 18.500 |
| 0.829 | 56.414 | 18.500 |
| 1.588 | 56.774 | 18.500 |
| 1.653 | 56.820 | 18.500 |
| 1.351 | 56.778 | 18.500 |
| 1.136 | 56.448 | 18.500 |
| 0.958 | 56.507 | 18.500 |
| 0.893 | 56.461 | 18.500 |
| 0.700 | 56.320 | 18.500 |
| 1.459 | 56.681 | 18.500 |
| 1.285 | 56.734 | 18.500 |
| 1.329 | 56.588 | 18.500 |
| 1.088 | 56.599 | 18.500 |

TABLE I-continued

| X | Y | Z |
|---|---|---|
| 1.265 | 56.542 | 18.500 |
| 1.007 | 56.355 | 18.500 |
| 0.942 | 56.308 | 18.500 |
| 1.219 | 56.689 | 18.500 |
| 1.200 | 56.495 | 18.500 |
| 1.684 | 56.997 | 18.500 |
| 1.618 | 56.953 | 18.500 |
| 1.782 | 56.914 | 18.500 |
| 1.945 | 57.074 | 18.500 |
| 1.551 | 56.910 | 18.500 |
| 1.818 | 57.084 | 18.500 |
| 1.751 | 57.040 | 18.500 |
| 1.888 | 57.119 | 18.500 |
| 1.484 | 56.866 | 18.500 |
| 1.717 | 56.867 | 18.500 |
| 1.910 | 57.008 | 18.500 |
| 1.846 | 56.961 | 18.500 |
| −1.138 | 54.222 | 19.000 |
| −1.222 | 54.005 | 19.000 |
| −1.107 | 54.293 | 19.000 |
| −1.359 | 54.044 | 19.000 |
| −1.345 | 54.120 | 19.000 |
| −1.194 | 54.078 | 19.000 |
| −1.303 | 54.270 | 19.000 |
| −1.321 | 53.904 | 19.000 |
| −1.276 | 54.342 | 19.000 |
| −1.256 | 53.936 | 19.000 |
| −1.326 | 54.196 | 19.000 |
| −1.361 | 53.967 | 19.000 |
| −1.167 | 54.150 | 19.000 |
| −1.003 | 54.810 | 19.000 |
| −0.863 | 54.689 | 19.000 |
| −0.663 | 54.926 | 19.000 |
| −1.036 | 54.431 | 19.000 |
| −0.610 | 54.983 | 19.000 |
| −0.854 | 54.989 | 19.000 |
| −0.954 | 54.563 | 19.000 |
| −0.955 | 54.871 | 19.000 |
| −0.801 | 55.046 | 19.000 |
| −1.050 | 54.748 | 19.000 |
| −0.905 | 54.930 | 19.000 |
| −1.094 | 54.684 | 19.000 |
| −0.766 | 54.810 | 19.000 |
| −1.211 | 54.483 | 19.000 |
| −0.815 | 54.750 | 19.000 |
| −0.910 | 54.627 | 19.000 |
| −1.073 | 54.363 | 19.000 |
| −0.996 | 54.498 | 19.000 |
| −1.175 | 54.552 | 19.000 |
| −0.556 | 55.038 | 19.000 |
| −1.245 | 54.414 | 19.000 |
| −1.136 | 54.619 | 19.000 |
| −0.715 | 54.868 | 19.000 |
| −0.408 | 55.420 | 19.000 |
| −0.100 | 55.459 | 19.000 |
| −0.217 | 55.357 | 19.000 |
| −0.041 | 55.509 | 19.000 |
| −0.290 | 55.521 | 19.000 |
| 0.139 | 55.657 | 19.000 |
| −0.637 | 55.211 | 19.000 |
| −0.501 | 55.093 | 19.000 |
| 0.079 | 55.608 | 19.000 |
| −0.159 | 55.409 | 19.000 |
| −0.389 | 55.201 | 19.000 |
| −0.333 | 55.254 | 19.000 |
| −0.171 | 55.621 | 19.000 |
| −0.051 | 55.719 | 19.000 |
| −0.349 | 55.471 | 19.000 |
| 0.019 | 55.559 | 19.000 |
| −0.747 | 55.102 | 19.000 |
| −0.524 | 55.317 | 19.000 |
| −0.693 | 55.156 | 19.000 |
| −0.446 | 55.147 | 19.000 |
| −0.581 | 55.264 | 19.000 |
| −0.111 | 55.670 | 19.000 |
| −0.275 | 55.306 | 19.000 |
| −0.231 | 55.571 | 19.000 |

TABLE I-continued

| X | Y | Z |
|---|---|---|
| −0.466 | 55.369 | 19.000 |
| 0.199 | 55.706 | 19.000 |
| 0.562 | 56.195 | 19.000 |
| 0.816 | 56.177 | 19.000 |
| 0.505 | 55.945 | 19.000 |
| 0.376 | 56.054 | 19.000 |
| 0.253 | 55.960 | 19.000 |
| 0.321 | 55.802 | 19.000 |
| 0.687 | 56.287 | 19.000 |
| 0.691 | 56.085 | 19.000 |
| 0.629 | 56.039 | 19.000 |
| 0.500 | 56.148 | 19.000 |
| 0.382 | 55.850 | 19.000 |
| 0.878 | 56.223 | 19.000 |
| 0.315 | 56.007 | 19.000 |
| 0.192 | 55.912 | 19.000 |
| 0.131 | 55.864 | 19.000 |
| 0.010 | 55.767 | 19.000 |
| 0.941 | 56.269 | 19.000 |
| 0.624 | 56.241 | 19.000 |
| 0.444 | 55.898 | 19.000 |
| 0.567 | 55.992 | 19.000 |
| 0.753 | 56.131 | 19.000 |
| 0.438 | 56.101 | 19.000 |
| 0.260 | 55.754 | 19.000 |
| 0.070 | 55.816 | 19.000 |
| 1.066 | 56.558 | 19.000 |
| 1.698 | 56.812 | 19.000 |
| 1.067 | 56.360 | 19.000 |
| 0.875 | 56.424 | 19.000 |
| 1.129 | 56.602 | 19.000 |
| 1.382 | 56.586 | 19.000 |
| 1.387 | 56.775 | 19.000 |
| 1.193 | 56.451 | 19.000 |
| 1.194 | 56.646 | 19.000 |
| 1.004 | 56.315 | 19.000 |
| 1.452 | 56.817 | 19.000 |
| 0.812 | 56.378 | 19.000 |
| 1.322 | 56.732 | 19.000 |
| 0.749 | 56.333 | 19.000 |
| 1.508 | 56.676 | 19.000 |
| 1.635 | 56.766 | 19.000 |
| 1.572 | 56.721 | 19.000 |
| 1.445 | 56.631 | 19.000 |
| 1.002 | 56.513 | 19.000 |
| 1.256 | 56.496 | 19.000 |
| 1.258 | 56.689 | 19.000 |
| 1.130 | 56.406 | 19.000 |
| 0.938 | 56.469 | 19.000 |
| 1.319 | 56.541 | 19.000 |
| 1.517 | 56.859 | 19.000 |
| 1.847 | 57.060 | 19.000 |
| 1.824 | 56.902 | 19.000 |
| 1.713 | 56.986 | 19.000 |
| 1.761 | 56.857 | 19.000 |
| 1.582 | 56.902 | 19.000 |
| 1.648 | 56.944 | 19.000 |
| 1.907 | 57.019 | 19.000 |
| 1.886 | 56.949 | 19.000 |
| 1.778 | 57.028 | 19.000 |
| −1.302 | 53.968 | 19.500 |
| −1.297 | 54.316 | 19.500 |
| −1.340 | 54.171 | 19.500 |
| −1.168 | 54.126 | 19.500 |
| −1.321 | 54.244 | 19.500 |
| −1.234 | 53.990 | 19.500 |
| −1.351 | 54.022 | 19.500 |
| −1.139 | 54.195 | 19.500 |
| −1.109 | 54.265 | 19.500 |
| −1.197 | 54.056 | 19.500 |
| −1.077 | 54.333 | 19.500 |
| −1.353 | 54.097 | 19.500 |
| −0.876 | 54.652 | 19.500 |
| −0.897 | 54.952 | 19.500 |
| −1.127 | 54.652 | 19.500 |
| −0.681 | 54.883 | 19.500 |
| −1.238 | 54.455 | 19.500 |

TABLE I-continued

| X | Y | Z |
|---|---|---|
| −1.041 | 54.400 | 19.500 |
| −0.577 | 54.992 | 19.500 |
| −1.085 | 54.715 | 19.500 |
| −0.523 | 55.045 | 19.500 |
| −1.269 | 54.386 | 19.500 |
| −1.040 | 54.776 | 19.500 |
| −0.629 | 54.938 | 19.500 |
| −1.003 | 54.465 | 19.500 |
| −0.994 | 54.836 | 19.500 |
| −0.946 | 54.895 | 19.500 |
| −0.781 | 54.770 | 19.500 |
| −0.732 | 54.827 | 19.500 |
| −0.829 | 54.712 | 19.500 |
| −1.203 | 54.522 | 19.500 |
| −1.166 | 54.588 | 19.500 |
| −0.920 | 54.591 | 19.500 |
| −0.846 | 55.007 | 19.500 |
| −0.963 | 54.529 | 19.500 |
| −0.231 | 55.566 | 19.500 |
| −0.348 | 55.470 | 19.500 |
| −0.794 | 55.062 | 19.500 |
| −0.073 | 55.449 | 19.500 |
| −0.358 | 55.201 | 19.500 |
| 0.280 | 55.733 | 19.500 |
| −0.290 | 55.518 | 19.500 |
| −0.131 | 55.400 | 19.500 |
| −0.576 | 55.271 | 19.500 |
| −0.463 | 55.371 | 19.500 |
| −0.189 | 55.351 | 19.500 |
| −0.015 | 55.497 | 19.500 |
| −0.519 | 55.322 | 19.500 |
| −0.631 | 55.220 | 19.500 |
| 0.102 | 55.592 | 19.500 |
| −0.469 | 55.098 | 19.500 |
| −0.173 | 55.613 | 19.500 |
| −0.740 | 55.116 | 19.500 |
| 0.161 | 55.639 | 19.500 |
| −0.246 | 55.302 | 19.500 |
| −0.114 | 55.661 | 19.500 |
| −0.405 | 55.421 | 19.500 |
| 0.220 | 55.686 | 19.500 |
| −0.686 | 55.163 | 19.500 |
| −0.302 | 55.251 | 19.500 |
| −0.414 | 55.150 | 19.500 |
| 0.043 | 55.545 | 19.500 |
| −0.055 | 55.708 | 19.500 |
| 0.946 | 56.230 | 19.500 |
| 0.762 | 56.096 | 19.500 |
| 0.424 | 56.076 | 19.500 |
| 0.460 | 55.871 | 19.500 |
| 0.304 | 55.985 | 19.500 |
| 0.005 | 55.754 | 19.500 |
| 0.823 | 56.141 | 19.500 |
| 0.400 | 55.825 | 19.500 |
| 0.667 | 56.256 | 19.500 |
| 0.364 | 56.031 | 19.500 |
| 0.064 | 55.801 | 19.500 |
| 0.124 | 55.847 | 19.500 |
| 0.641 | 56.007 | 19.500 |
| 1.007 | 56.274 | 19.500 |
| 0.340 | 55.779 | 19.500 |
| 0.606 | 56.211 | 19.500 |
| 0.520 | 55.916 | 19.500 |
| 0.702 | 56.052 | 19.500 |
| 0.485 | 56.121 | 19.500 |
| 0.546 | 56.166 | 19.500 |
| 0.885 | 56.185 | 19.500 |
| 0.184 | 55.894 | 19.500 |
| 0.580 | 55.962 | 19.500 |
| 0.244 | 55.939 | 19.500 |
| 1.623 | 56.711 | 19.500 |
| 1.685 | 56.754 | 19.500 |
| 0.913 | 56.431 | 19.500 |
| 1.562 | 56.667 | 19.500 |
| 1.315 | 56.493 | 19.500 |
| 1.288 | 56.686 | 19.500 |
| 0.975 | 56.474 | 19.500 |

TABLE I-continued

| X | Y | Z |
|---|---|---|
| 1.500 | 56.623 | 19.500 |
| 1.225 | 56.644 | 19.500 |
| 1.808 | 56.842 | 19.500 |
| 1.037 | 56.517 | 19.500 |
| 0.729 | 56.300 | 19.500 |
| 1.253 | 56.449 | 19.500 |
| 1.376 | 56.536 | 19.500 |
| 1.191 | 56.405 | 19.500 |
| 1.746 | 56.798 | 19.500 |
| 1.415 | 56.768 | 19.500 |
| 1.352 | 56.727 | 19.500 |
| 1.100 | 56.560 | 19.500 |
| 1.162 | 56.602 | 19.500 |
| 1.068 | 56.318 | 19.500 |
| 1.130 | 56.362 | 19.500 |
| 1.478 | 56.809 | 19.500 |
| 0.790 | 56.344 | 19.500 |
| 0.852 | 56.388 | 19.500 |
| 1.438 | 56.580 | 19.500 |
| 1.542 | 56.850 | 19.500 |
| 1.606 | 56.890 | 19.500 |
| 1.863 | 56.964 | 19.500 |
| 1.669 | 56.931 | 19.500 |
| 1.864 | 56.892 | 19.500 |
| 1.733 | 56.972 | 19.500 |
| 1.801 | 57.001 | 19.500 |
| −1.100 | 54.277 | 19.640 |
| −1.293 | 54.329 | 19.640 |
| −1.199 | 54.533 | 19.640 |
| −1.317 | 54.258 | 19.640 |
| −1.160 | 54.140 | 19.640 |
| −1.068 | 54.345 | 19.640 |
| −1.347 | 54.038 | 19.640 |
| −1.337 | 54.186 | 19.640 |
| −1.234 | 54.467 | 19.640 |
| −1.265 | 54.399 | 19.640 |
| −1.227 | 54.006 | 19.640 |
| −1.296 | 53.986 | 19.640 |
| −1.131 | 54.209 | 19.640 |
| −1.349 | 54.112 | 19.640 |
| −1.190 | 54.071 | 19.640 |
| −0.819 | 54.718 | 19.640 |
| −0.672 | 54.888 | 19.640 |
| −0.990 | 54.843 | 19.640 |
| −1.123 | 54.662 | 19.640 |
| −0.994 | 54.475 | 19.640 |
| −1.162 | 54.598 | 19.640 |
| −0.866 | 54.660 | 19.640 |
| −0.953 | 54.538 | 19.640 |
| −0.620 | 54.942 | 19.640 |
| −0.771 | 54.776 | 19.640 |
| −1.032 | 54.411 | 19.640 |
| −0.893 | 54.957 | 19.640 |
| −0.942 | 54.901 | 19.640 |
| −1.081 | 54.724 | 19.640 |
| −0.790 | 55.067 | 19.640 |
| −0.722 | 54.832 | 19.640 |
| −0.911 | 54.600 | 19.640 |
| −0.842 | 55.013 | 19.640 |
| −1.036 | 54.784 | 19.640 |
| −0.347 | 55.469 | 19.640 |
| −0.567 | 54.995 | 19.640 |
| −0.289 | 55.517 | 19.640 |
| −0.294 | 55.252 | 19.640 |
| −0.573 | 55.273 | 19.640 |
| −0.629 | 55.223 | 19.640 |
| −0.683 | 55.172 | 19.640 |
| −0.518 | 55.323 | 19.640 |
| −0.405 | 55.151 | 19.640 |
| −0.461 | 55.372 | 19.640 |
| −0.181 | 55.350 | 19.640 |
| −0.238 | 55.301 | 19.640 |
| −0.231 | 55.564 | 19.640 |
| −0.514 | 55.048 | 19.640 |
| −0.124 | 55.398 | 19.640 |
| −0.737 | 55.120 | 19.640 |
| −0.404 | 55.421 | 19.640 |

TABLE I-continued

| X | Y | Z |
|---|---|---|
| −0.350 | 55.202 | 19.640 |
| −0.460 | 55.100 | 19.640 |
| 0.301 | 55.979 | 19.640 |
| 0.361 | 56.024 | 19.640 |
| −0.009 | 55.494 | 19.640 |
| 0.049 | 55.541 | 19.640 |
| 0.403 | 55.818 | 19.640 |
| −0.173 | 55.611 | 19.640 |
| 0.167 | 55.635 | 19.640 |
| −0.067 | 55.446 | 19.640 |
| 0.108 | 55.588 | 19.640 |
| −0.055 | 55.705 | 19.640 |
| 0.004 | 55.751 | 19.640 |
| 0.285 | 55.727 | 19.640 |
| 0.463 | 55.864 | 19.640 |
| 0.122 | 55.843 | 19.640 |
| 0.182 | 55.888 | 19.640 |
| 0.063 | 55.797 | 19.640 |
| 0.225 | 55.681 | 19.640 |
| 0.241 | 55.934 | 19.640 |
| −0.114 | 55.658 | 19.640 |
| 0.344 | 55.773 | 19.640 |
| 0.541 | 56.158 | 19.640 |
| 0.946 | 56.219 | 19.640 |
| 0.764 | 56.087 | 19.640 |
| 0.421 | 56.069 | 19.640 |
| 0.885 | 56.175 | 19.640 |
| 0.481 | 56.113 | 19.640 |
| 0.703 | 56.043 | 19.640 |
| 0.723 | 56.290 | 19.640 |
| 1.007 | 56.262 | 19.640 |
| 0.643 | 55.998 | 19.640 |
| 0.523 | 55.909 | 19.640 |
| 0.662 | 56.246 | 19.640 |
| 0.345 | 56.377 | 19.640 |
| 0.602 | 56.202 | 19.640 |
| 0.824 | 56.131 | 19.640 |
| 0.784 | 56.334 | 19.640 |
| 0.583 | 55.953 | 19.640 |
| 0.906 | 56.420 | 19.640 |
| 1.154 | 56.589 | 19.640 |
| 1.435 | 56.565 | 19.640 |
| 1.092 | 56.547 | 19.640 |
| 1.279 | 56.672 | 19.640 |
| 1.030 | 56.505 | 19.640 |
| 1.373 | 56.522 | 19.640 |
| 1.068 | 56.306 | 19.640 |
| 1.216 | 56.630 | 19.640 |
| 1.557 | 56.652 | 19.640 |
| 1.404 | 56.753 | 19.640 |
| 1.341 | 56.713 | 19.640 |
| 1.129 | 56.349 | 19.640 |
| 1.312 | 56.479 | 19.640 |
| 1.496 | 56.609 | 19.640 |
| 1.251 | 56.436 | 19.640 |
| 1.467 | 56.794 | 19.640 |
| 1.190 | 56.393 | 19.640 |
| 0.968 | 56.463 | 19.640 |
| 1.741 | 56.782 | 19.640 |
| 1.850 | 56.948 | 19.640 |
| 1.680 | 56.738 | 19.640 |
| 1.594 | 56.874 | 19.640 |
| 1.855 | 56.876 | 19.640 |
| 1.720 | 56.955 | 19.640 |
| 1.788 | 56.983 | 19.640 |
| 1.802 | 56.825 | 19.640 |
| 1.531 | 56.834 | 19.640 |
| 1.618 | 56.695 | 19.640 |
| 1.657 | 56.915 | 19.640 |

It will also be appreciated that the airfoil disclosed in the above Table may be scaled up or down geometrically for use in other similar turbine designs. Consequently, the coordinate values set forth in Table I may be scaled upwardly or downwardly such that the airfoil section shape remains unchanged. A scaled version of the coordinates in Table I would be represented by X, Y and Z coordinate values multiplied or divided by the same constant or number.

Figure 6:
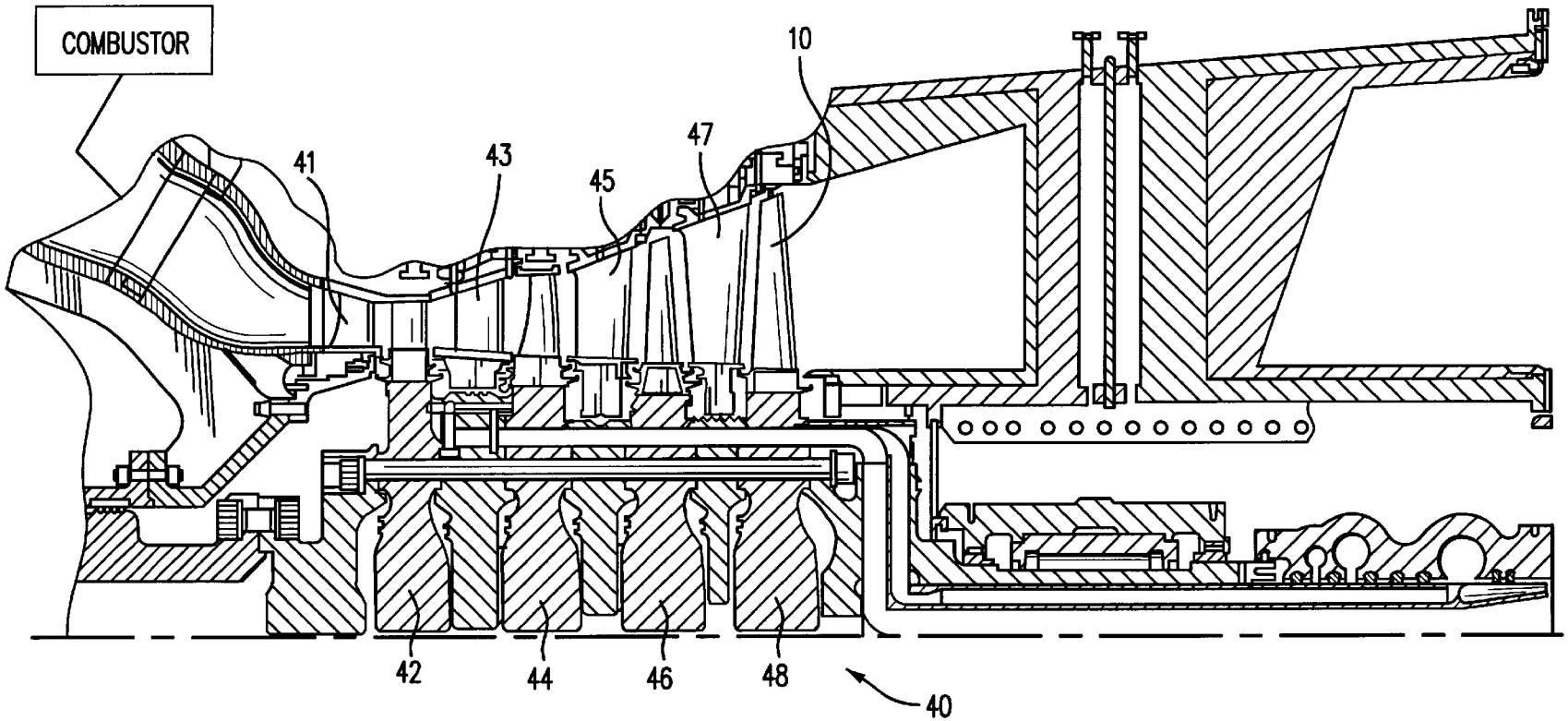
FIG. 6 is a schematic illustration of a turbine having a fourth-stage turbine wheel employing the buckets hereof.

Referring now to FIG. 6, there is illustrated a turbine in which the turbine bucket having the airfoil defined herein may be utilized. In the illustrated turbine, the turbine rotor, designated 40, has first, second, third and fourth-stage rotor wheels 42, 44, 46 and 48, respectively, mounting buckets which, in conjunction with respective stator vanes 41, 43, 45 and 47, form the various stages of the rotor. Particularly, the fourth stage comprises a fourth-stage rotor wheel 48 on which the airfoils 10 hereof are mounted in opposition to fourth-stage stator vanes 47. It will be appreciated that a plurality of the airfoils 10 are spaced circumferentially one from the other about the fourth-stage wheel 48 and, in this instance, there are eighty-eight buckets mounted on the fourth-stage wheel 48.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket having a bucket airfoil shape in an envelope within ±0.160 inches in a direction normal to any airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

2. A turbine bucket according to claim 1 forming part of a fourth stage of a turbine.

3. A turbine bucket having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil bucket profile;

the X, Y and Z values being scaled as a function of the same constant or number to provide a scaled-up or scaled-down bucket airfoil.

4. A turbine bucket according to claim 3 forming part of a fourth stage of a turbine.

5. A turbine comprising a turbine wheel having a plurality of buckets, each of said buckets having an airfoil shape in an envelope within ±0.160 inches in a direction normal to any bucket airfoil surface location wherein the airfoil has an uncoated nominal profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in the X, Y plane at a radially innermost aerodynamic section of the airfoil and X and Y are coordinate values defining the airfoil profile at each distance Z, the profiles at the Z distances being joined smoothly with one another to form the complete airfoil shape.

6. A turbine according to claim 5 wherein the turbine wheel comprises the fourth stage of the turbine.

7. A turbine according to claim 5 wherein the turbine wheel has eighty-eight buckets and the Y direction represents a distance parallel to a rotary axis of the turbine wheel.

8. A turbine comprising a turbine wheel having a plurality of buckets, each of said buckets having an uncoated nominal airfoil profile substantially in accordance with Cartesian coordinate values of X, Y and Z set forth in inches in Table I wherein Z is a perpendicular distance from a plane normal to a radius of the turbine centerline and containing the X and Y values with the Z value commencing at zero in an X, Y plane at the radially innermost aerodynamic section of the airfoil and X and Y are coordinate values defining the airfoil profile at each distance Z, the profiles at the Z distances being joined smoothly with one another to form the complete airfoil shape;

the X, Y and Z values being scaled as a function of the same constant or number to provide a scaled-up or scaled-down bucket airfoil.

9. A turbine according to claim 8 wherein the turbine wheel comprises the fourth stage of the turbine.

10. A turbine according to claim 8 wherein the turbine wheel has eighty-eight buckets and the Y direction represents a distance parallel to a rotary axis of the turbine wheel.

* * * * *

UNITED STATES PATENT AND TRADEMARK OFFICE

CERTIFICATE OF CORRECTION

PATENT NO. : 6,503,059 B1
DATED : January 7, 2003
INVENTOR(S) : Frost et al.

It is certified that error appears in the above-identified patent and that said Letters Patent is hereby corrected as shown below:

Column 5,
Line 38, Table I, delete Y coordinate "53.794" and insert -- 58.794 -- therefor.

Column 8,
Line 34, Table I, delete Y coordinate "53.333" and insert -- 58.333 -- therefor.
Line 47, Table I, delete X coordinate "0.193" and insert -- 0.198 -- therefor.

Column 11,
Line 23, Table I, delete Y coordinate "56.398" and insert -- 56.898 -- therefor.

Column 12,
Line 63, Table I, delete Y coordinate "55.113" and insert -- 58.113 -- therefor.

Column 13,
Line 5, Table I, delete Y coordinate "55.204" and insert -- 58.204 -- therefor.

Column 21,
Line 17, Table I, delete Y coordinate "52.693" and insert -- 52.698 -- therefor.

Column 23,
Line 16, Table I, delete Y coordinate "54.338" and insert -- 54.388 -- therefor.

Column 25,
Line 18, Table I, delete Y coordinate "56.733" and insert -- 56.783 -- therefor.
Line 46, Table I, delete X coordinate "1.898" and insert -- 1.888 -- therefor.
Line 46, Table I, delete Y coordinate "53.317" and insert -- 58.317 -- therefor.

Column 28,
Line 56, Table I, delete Y coordinate "55.246" and insert -- 58.246 -- therefor.

Column 34,
Line 43, Table I, delete X coordinate "0.337" and insert -- 0.387 -- therefor.

UNITED STATES PATENT AND TRADEMARK OFFICE

CERTIFICATE OF CORRECTION

PATENT NO. : 6,503,059 B1
DATED : January 7, 2003
INVENTOR(S) : Frost et al.

It is certified that error appears in the above-identified patent and that said Letters Patent is hereby corrected as shown below:

Column 35,
Line 65, Table I, delete Y coordinate "56.193" and insert -- 56.198 -- therefor.

Column 40,
Line 10, Table I, delete X coordinate "-0.331" and insert -- -0.831 -- therefor.
Line 26, Table I, delete X coordinate "-0.643" and insert -- -0.648 -- therefor.

Column 43,
Line 11, Table I, delete X coordinate "-0.933" and insert -- -0.938 -- therefor.

Column 44,
Line 39, Table I, delete X coordinate "-1.173" and insert -- -1/178 -- therefor.

Column 48,
Line 27, Table I, delete Y coordinate "55.739" and insert -- 55.789 -- therefor.

Column 50,
Line 37, Table I, delete X coordinate "2.193" and insert -- 2.198 -- therefor.

Column 56,
Line 53, Table I, delete X coordinate "1.283" and insert -- 1.288 -- therefor.

Column 58,
Line 49, Table I, delete X coordinate "-1.073" and insert -- -1.078 -- therefor.

Column 59,
Line 48, Table I, delete X coordinate "0.346" and insert -- 0.846 -- therefor.

Column 60,
Line 53, Table I, delete Y coordinate "55.031" and insert -- 55.081 -- therefor.
Line 65, Table 1, delete Z coordinate "1S.000" and insert -- 18.000 -- therefor.

UNITED STATES PATENT AND TRADEMARK OFFICE

CERTIFICATE OF CORRECTION

PATENT NO. : 6,503,059 B1
DATED : January 7, 2003
INVENTOR(S) : Frost et al.

It is certified that error appears in the above-identified patent and that said Letters Patent is hereby corrected as shown below:

Column 61,
Line 46, Table I, delete Y coordinate "53.832" and insert -- 53.882 -- therefor.

Column 65,
Line 38, Table I, delete Y coordinate "55.163" and insert -- 55.168 -- therefor.

Column 67,
Line 32, Table I, delete X coordinate "0.345" and insert -- 0.845 -- therefor.

Signed and Sealed this

Seventeenth Day of June, 2003

JAMES E. ROGAN
*Director of the United States Patent and Trademark Office*